US012790819B2

(12) United States Patent
Remmele et al.

(10) Patent No.: US 12,790,819 B2
(45) Date of Patent: Nov. 10, 2026

(54) EXTERIOR WALL SYSTEM ASSEMBLIES, EXTERIOR WALL SYSTEM COMPONENT SUBASSEMBLIES, AND EXTERIOR WALL SYSTEM COMPONENTS WITH DRAINAGE FEATURES

(71) Applicant: Sto Corp., Atlanta, GA (US)

(72) Inventors: Thomas E Remmele, Marietta, GA (US); Terry L Viness, Marietta, GA (US)

(73) Assignee: Sto Corp., Atlanta, GA (US)

( * ) Notice: Subject to any disclaimer, the term of this patent is extended or adjusted under 35 U.S.C. 154(b) by 182 days.

(21) Appl. No.: 18/931,534

(22) Filed: Oct. 30, 2024

(65) Prior Publication Data

US 2025/0146270 A1 May 8, 2025

Related U.S. Application Data

(60) Provisional application No. 63/644,195, filed on May 8, 2024, provisional application No. 63/547,006, filed on Nov. 2, 2023.

(51) Int. Cl.
*E04B 1/94* (2006.01)
*E04B 1/66* (2006.01)
*E04B 1/68* (2006.01)

(52) U.S. Cl.
CPC ..... *E04B 1/948* (2013.01); *E04B 1/665* (2013.01); *E04B 1/6806* (2013.01)

(58) Field of Classification Search
CPC ..... E04B 1/948; E04B 1/665; E04B 1/6806; E04B 1/7645; E04B 1/765; E04B 1/70;
(Continued)

(56) References Cited

U.S. PATENT DOCUMENTS 2,645,824 A * 7/1953 Titsworth ..... E04B 1/7069 220/592.01
4,745,716 A * 5/1988 Kuypers ..... E04F 17/00 52/302.3

(Continued)

FOREIGN PATENT DOCUMENTS

WO WO-2020112977 A1 * 6/2020 ..... E04F 13/04

OTHER PUBLICATIONS

Dryvit Systems, Inc., Outsulation® Plus MD System® DS445 Product Data, 1998, 1 page, USA.

(Continued)

*Primary Examiner* — Patrick J Maestri
(74) *Attorney, Agent, or Firm* — Thomas B. McGurk

(57) ABSTRACT

Exterior wall system assemblies, exterior wall system component subassemblies, and exterior wall system components that incorporate drainage features are disclosed. The drainage features can include a channel or conduit assembly by which moisture that collects within concealed spaces of the respective exterior wall system assembly can migrate via gravity from the concealed spaces out through the exterior wall system assembly, wall panel, or wall panel system to the outside of the building. The exterior wall system assemblies, exterior wall system component subassemblies, and exterior wall system components also can include fireblocking features that can inhibit the propagation of fire through the concealed spaces of the exterior wall system assembly.

25 Claims, 33 Drawing Sheets

(58) Field of Classification Search
CPC ..... E04B 1/7038; E04B 1/6801; E04B 1/947; E04F 13/007
See application file for complete search history.

(56) References Cited

U.S. PATENT DOCUMENTS

| | | | | |
|---|---|---|---|---|
| 4,924,647 | A | 5/1990 | Drucker | |
| 5,027,572 | A | 7/1991 | Purcell | |
| 5,048,254 | A | 9/1991 | Merlau | |
| 5,289,664 | A | 3/1994 | Rizza | |
| 5,410,852 | A | 5/1995 | Edgar | |
| 5,836,135 | A | 11/1998 | Hagan | |
| 5,870,864 | A | 2/1999 | Snyder | |
| 5,979,123 | A | 11/1999 | Brockman | |
| 6,105,323 | A | 8/2000 | Paulle | |
| 6,108,991 | A | 8/2000 | Hagan | |
| 6,745,531 | B1 | 6/2004 | Egan | |
| 6,823,633 | B2 | 11/2004 | Ryan | |
| 6,964,136 | B2 | 11/2005 | Collins | |
| 8,621,799 | B2 | 1/2014 | Sade | |
| 8,919,062 | B1 | 12/2014 | Viness | |
| 10,081,939 | B1 * | 9/2018 | Robinson | F16J 15/065 |
| 10,196,812 | B1 * | 2/2019 | Duffy | E04F 13/007 |
| 10,472,820 | B2 * | 11/2019 | Lutz | E04B 1/7038 |
| 10,633,854 | B1 * | 4/2020 | Zeigler, Jr. | E04B 1/70 |
| 10,731,338 | B1 * | 8/2020 | Zemler | E04B 1/948 |
| 11,492,809 | B1 * | 11/2022 | Randle | E04F 13/26 |
| 2004/0003558 | A1 | 1/2004 | Collins | |
| 2006/0283113 | A1 * | 12/2006 | Trotter | E04B 1/7023 52/302.3 |
| 2007/0044402 | A1 * | 3/2007 | Hess | E04B 1/7046 52/302.1 |
| 2008/0016808 | A1 | 1/2008 | Pilz | |
| 2011/0277393 | A1 | 11/2011 | Hohmann | |
| 2011/0296781 | A1 | 12/2011 | McCary | |
| 2012/0198784 | A1 * | 8/2012 | Shaw | E04B 1/948 52/515 |
| 2013/0180203 | A1 * | 7/2013 | Xiangli | E04B 1/62 427/256 |
| 2016/0069071 | A1 * | 3/2016 | Remmele | E04F 13/068 52/302.1 |

OTHER PUBLICATIONS

Dryvit Systems, Inc., Outsulation® Plus MD System® Specifications DS137, 1996, 13 pages, USA.
Dryvit Systems, Inc., Outsulation® Plus MD System® Installation Details DS110, 1998, 36 pages, USA.

* cited by examiner

EXTERIOR WALL SYSTEM ASSEMBLIES, EXTERIOR WALL SYSTEM COMPONENT SUBASSEMBLIES, AND EXTERIOR WALL SYSTEM COMPONENTS WITH DRAINAGE FEATURES

CROSS REFERENCE TO RELATED APPLICATIONS

This application claims priority to both U.S. Provisional Patent Application Ser. No. 63/547,006 entitled "Exterior Wall Assemblies and Exterior wall system assembly Components With Fireblocking And Drainage Features", filed Nov. 2, 2023, and U.S. Provisional Patent Application Ser. No. 63/644,195, entitled "Exterior Wall System Assemblies, Exterior Wall System Component Subassemblies, And Exterior Wall System Components With Drainage Features", filed May 8, 2024, both of which are hereby incorporated by reference in their entirety herein to provide continuity of disclosure.

TECHNICAL FIELD

The present disclosure relates generally to exterior wall assemblies and, more specifically, to exterior wall system assemblies and exterior wall system component subassemblies with drainage features.

BACKGROUND

In modern construction, exterior wall assemblies are often made of multiple layers and components that provide various desired performance characteristics to the wall assemblies. Water and moisture can accumulate between the layers of the exterior wall assemblies, potentially leading to degradation of the wall components. Consequently, there is a need for means by which water and moisture that accumulates within an exterior wall system assembly to migrate therefrom and for exterior wall system assemblies that may address some of the limitations of the current technology.

SUMMARY

The present disclosure encompasses exterior wall system assemblies, exterior wall system component subassemblies and/or exterior wall system components with drainage features.

The present disclosure encompasses an exterior wall system component subassembly comprising: a wedge comprising a front side, a rear side spaced apart from the front side, a bottom side extending between the front side and the rear side, a top side extending between the front side and the rear side, wherein the top side is aligned oblique to the front side, wherein the top side and the front side cooperate to form a top front edge, wherein the top side and the rear side cooperate to form a top rear edge; a waterproof membrane aligned on the top side of the wedge; a first water-resistant ribbon aligned on the waterproof membrane, wherein the first water-resistant ribbon comprises a first water-resistant ribbon end; and, a second water-resistant ribbon aligned on the waterproof membrane, wherein the second water-resistant ribbon comprises a second water-resistant ribbon end, wherein the second water-resistant ribbon end is spaced apart from the first water-resistant ribbon end, wherein the waterproof membrane, the first water-resistant ribbon and the second water-resistant ribbon cooperate to form a channel, and wherein the first water-resistant ribbon end and the second water-resistant ribbon end cooperate to define a channel outlet of the channel.

In one aspect, the first water-resistant ribbon can extend from the first water-resistant end to a first water-resistant ribbon apex. In another aspect, the second water-resistant ribbon can extend from the second water-resistant end to a second water-resistant ribbon apex. In a further aspect, the first water-resistant ribbon apex and the second water-resistant apex can be aligned proximal to the top rear edge of the wedge and the channel outlet is aligned distal to the top rear edge of the wedge. In yet another aspect, the first water-resistant ribbon apex can be disposed at the top rear edge of the wedge. In still a further aspect, the first water-resistant apex can be disposed intermediate between the top rear edge and the top front edge of the wedge. In one aspect, the channel can be in fluid communication with a weep tube. In another aspect, the weep tube can be aligned on the top side of the wedge. In a further aspect, the first water-resistant ribbon and the second water-resistant ribbon can contact the weep tube. In still a further aspect, the wedge, the first water-resistant ribbon, the second water-resistant ribbon, and the waterproof membrane can be disposed in an exterior wall panel, wherein the wall panel can comprise a support frame and a front face, wherein the wedge can be mounted to the support frame and disposed intermediate between the support frame and the front face, wherein wall panel can comprise a plurality of weep holes defined in the front face, and wherein the channel can be in fluid communication with a weep hole of the plurality of weep holes. In one aspect, the exterior wall system component subassembly can comprise a fireblocking base form aligned below the wedge. In another aspect, the wedge can comprise a fire-resistant material.

The present disclosure encompasses an exterior wall system component subassembly comprising: a wedge comprising a front side and a top side aligned oblique to the front side, wherein the top side comprises a top front edge and a top rear edge; a plurality of channels aligned on the top side of the wedge, wherein each channel of the plurality of channels comprises a waterproof membrane aligned on the top side of the wedge, a first water-resistant ribbon aligned on the waterproof membrane, and a second water-resistant ribbon on the waterproof membrane, and wherein each channel of the plurality of channels comprises a channel outlet aligned distal to the top rear edge and proximal to the top front edge.

In one aspect, the exterior wall system component subassembly can comprise a fireblocking base form, and wherein the wedge can be aligned above the fireblocking base form. In another aspect, the first water-resistant ribbon can extend from a first water-resistant ribbon apex to a first water-resistant ribbon end, wherein the first water-resistant ribbon apex can be aligned proximal to the top rear edge and distal to the top front edge, and wherein the first water-resistant ribbon end can be aligned proximal to the top front edge and distal to the top rear edge. In a further aspect, the first water-resistant ribbon apex can be disposed at the top rear edge. In yet another aspect, the first water-resistant ribbon apex can be disposed intermediate between the top rear edge and the top front edge. In still a further aspect, the first water-resistant ribbon end can be disposed at the top front edge. In one aspect, the first water-resistant ribbon end can be disposed intermediate between the top rear edge and the top front edge. In another aspect, the first water-resistant ribbon can be arcuate. In a further aspect, the exterior wall system component subassembly can comprise a plurality of weep tubes aligned on the top side of the wedge. In yet another aspect, each weep tube of the plurality of weep tubes can be in fluid communication with a channel outlet of a channel of the plurality of channels. In still a further aspect, the wedge and the plurality of channels can be disposed in an exterior wall panel, wherein the wall panel can comprise a support frame and a front face, wherein the wedge can be mounted to the support frame and can be disposed intermediate between the support frame and the front face, wherein wall panel can comprise a plurality of weep holes defined in the front face, and each channel of the plurality of channels can be in fluid communication with a weep hole of the plurality of weep holes. In one aspect, the exterior wall panel further can comprise a plurality of weep tubes, wherein each weep tube of the plurality of weep tubes can be in fluid communication with a channel of the plurality of channels, and wherein each weep tube of the plurality of weep tubes can be in fluid communication with a weep hole of the plurality of weep holes.

The present disclosure also encompasses an exterior wall system component subassembly comprising: a wedge comprising a front side, a rear side spaced apart from the front side, a bottom side extending between the front side and the rear side, a top side extending between the front side and the rear side, wherein the top side is aligned oblique to the front side, wherein the top side and the front side cooperate to form a top front edge, wherein the top side and the rear side cooperate to form a top rear edge; a waterproof membrane aligned on the top side of the wedge; a plurality of channels aligned on the top side of the wedge, wherein each channel of the plurality of channels comprises the waterproof membrane, a first water-resistant ribbon aligned on the waterproof membrane, and a second water-resistant ribbon on the waterproof membrane, wherein the first water-resistant ribbon extends from a first water-resistant ribbon end to a first water-resistant ribbon apex, wherein the second water-resistant ribbon extends from a second water-resistant ribbon end to a second water-resistant ribbon apex, wherein the first water-resistant end is spaced apart from the second water resistant end, wherein the first water-resistant end and the second water-resistant end cooperate to form a channel outlet, and wherein the channel outlet is aligned distal to the top rear edge and proximal to the top front edge of the wedge.

These and other aspects are set forth in greater detail below and in the drawings for which a brief description is provided as follows.

DETAILED DESCRIPTION

Figure 1:
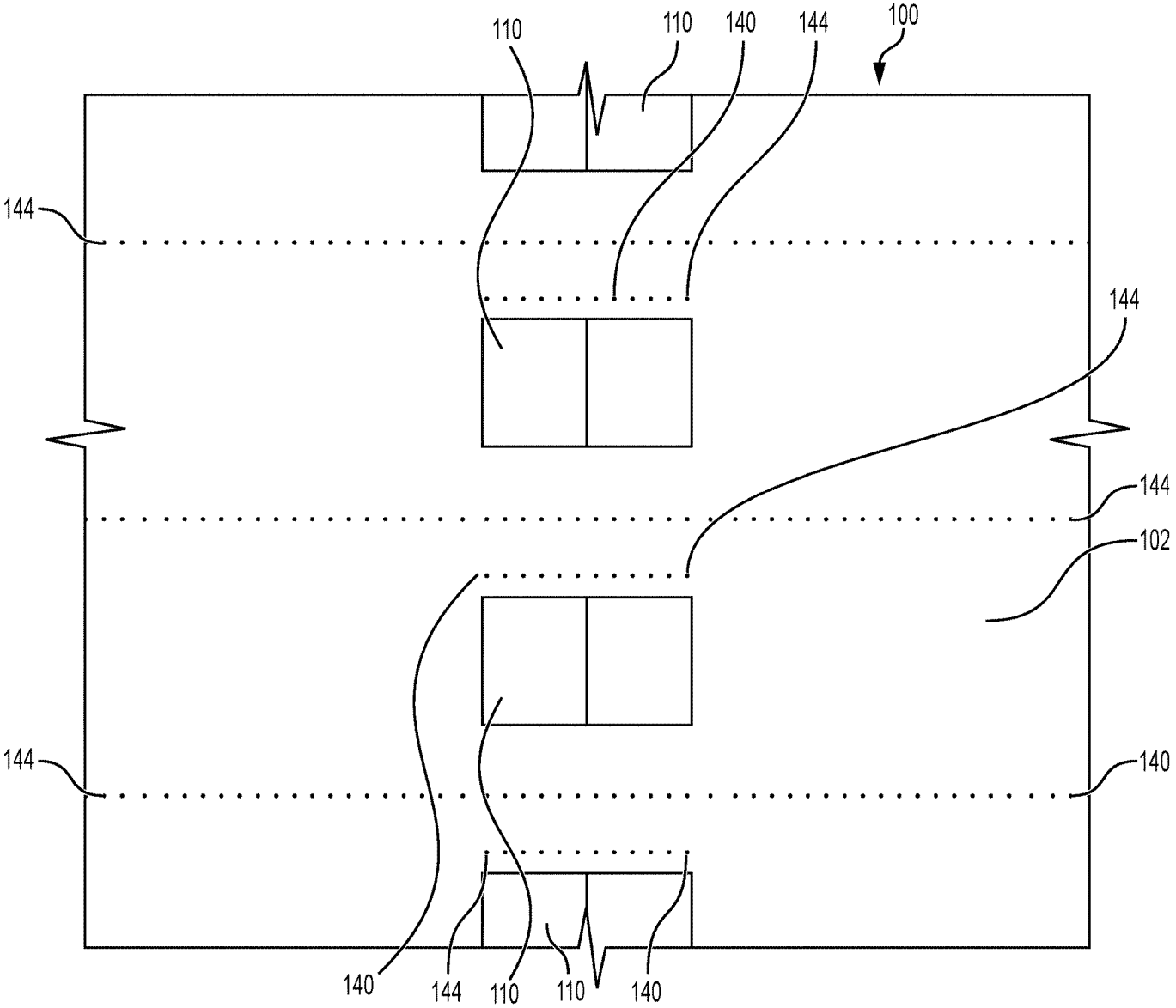
FIG. 1 is a front elevation view of a portion of an exterior wall system assembly encompassing aspects of the present disclosure.

The present disclosure encompasses exterior wall system assemblies, wall system component subassemblies, and wall system components that include drainage features for addressing the accumulation of moisture within air cavities or interior void spaces of exterior wall assemblies. The present disclosure encompasses exterior wall system assemblies that are assembled on-site, also known as field installation, exterior wall system assemblies assembled from prefabricated components and component subassemblies that include drainage features or combinations of drainage features and fireblocking features, exterior wall system component subassemblies that are field installed and include drainage features or combinations of both fireblocking and drainage features, prefabricated exterior wall system components and component subassemblies that include drainage features or combinations of both fireblocking and drainage features.

The present disclosure also encompasses exterior wall system assemblies that comprise one or more components having drainage features and a fireblocking framework composed of fireblocking rows and/or intersecting fireblocking columns. The fireblocking columns and fireblocking rows are composed of fireblocking vertical forms and fireblocking base forms, respectively, each of which comprises fire-resistant material provided in a lamella comprising a plurality of lamellar layers aligned transverse to the front face of the wall. The fireblocking base forms can comprise a top side that is aligned perpendicular to the front face of the exterior wall system assembly or a top side that is sloped downward from the interior of the wall assembly to the front face of the wall so as to allow moisture that collects within the concealed spaces of the wall assembly to migrate out through channels and/or tubes disposed within the wall assembly and that open to the outside of the front face of the wall. Wall system component subassemblies comprising a fireblocking base form with a top side aligned perpendicular to a front face of an exterior wall system assembly can also include a wedge disposed atop and/or superior to the fireblocking base form, the wedge comprising a sloped wedge top side and a plurality of drainage channels formed by a plurality of ribbons disposed on a waterproof membrane that is disposed on the wedge top side.

As used herein, the term "wedge" refers to an object with a body having a top side, a bottom side, opposing the top side, a rear side extending between the top side and the bottom side, a front side opposing the rear side and extending between the top side and the bottom side, wherein the rear side height is greater than the front side height, and wherein the top side is aligned oblique to the bottom side, the rear side and the front side. The body of a wedge has an acute angle formed between the rear side and the top side and an obtuse angle formed between the top side and the front side.

As used herein, the term "oblique" refers to an alignment of one surface or structure that is non-parallel and non-perpendicular to another surface or structure.

As used herein, the term "obtuse" refers to an angle or alignment that is greater than 90° and less than 180°.

As used herein, the term "acute" refers to an angle or alignment that is greater than 0° and less than 90°.

As used herein, the term "air cavity" refers to a void space between two layers of material intentionally included within a wall assembly for the movement of water.

As used herein, the term "concealed space" refers to an enclosed space within a partition, a floor, a roof, a set of stairs, a furring, a pipe chase, a column, and/or an external wall assembly. A concealed space can encompass one or more air cavities and/or internal void spaces that are not interrupted by a firebreak.

As used herein, the term "fireblocking" refers to a material that resists the free passage of flame and/or hot gasses through a building through concealed spaces. Examples of fireblocking materials include, but are not limited to, two-inch (50.8 mm) nominal lumber, two thicknesses of one-inch (25.4 mm) nominal lumber with broken lap joints, one thickness of 0.719-inch (18.3 mm) wood structural panel with joints backed by 0719-inch (18.3 mm) wood structural panels, one thickness of 0.75-inch (19.1 mm) particleboard with joints backed by 0.75-inch (19.1 mm) particleboard, one-half inch (12.7 mm) gypsum board, one-fourth inch (6.4 mm) cement-based millboard, batts, blocks or blankets of mineral wool and/or mineral fiber.

As used herein, the term "non-combustible" refers to (i) a material no part of which will ignite and burn when subjected to fire and/or a material passing ASTM E136-22; or (ii) a material having a structural base as defined in (i) with a surfacing material of not greater than one-eighth of an inch (3.2 mm) thickness which has a flame-spread index of 50 or less.

As used herein, the term "fire-resistant" refers to a material that is considered "non-combustible" and/or a "fireblocking" material and/or otherwise tends to resist combustion when exposed to fire or a source of ignition.

As used herein, the term "water-resistant" refers to a material or object that tends to inhibit or to prevent water migrating therethrough or penetrating therein under atmospheric conditions.

As used herein, the term "waterproof" refers to a material or object that is generally impermeable to water under atmospheric conditions.

As used herein, the term "aligned on" refers to a material or object being directly or indirectly situated above another material or object with either no or one or more materials or objects situated therebetween.

As used herein, the term "anterior" refers to being situated in front of a part or toward the front and/or outer face of an exterior wall system assembly, and the term "posterior" refers to being situated behind a part or toward the rear and/or interior of the exterior wall system assembly. As used herein, the term "superior" refers to being situated higher up or toward the roof of the structure upon which the wall assembly is mounted, and the term "inferior" refers to being situated below a part or closer to the base of the structure upon which the wall assembly is mounted.

FIG. 1 illustrates a portion of an exterior wall system assembly 100 encompassing aspects of the present disclosure. FIG. 1 illustrates a portion of an exterior wall system assembly 100 of a multi-story building with a column of windows disposed therein with one window per floor of the multi-story building. The exterior wall system assembly 100 comprises a plurality of weep hole rows 144, each of which comprises a plurality of weep holes 140. The weep hole rows 144 are aligned proximal either to the floor slab of each floor of the multi-story building or the top side of each window opening. Each weep hole 140 is open to the front face of the exterior wall system assembly 100 and in fluid communication with a channel 162 disposed in the interior of the exterior wall system assembly 100.

Figure 2:
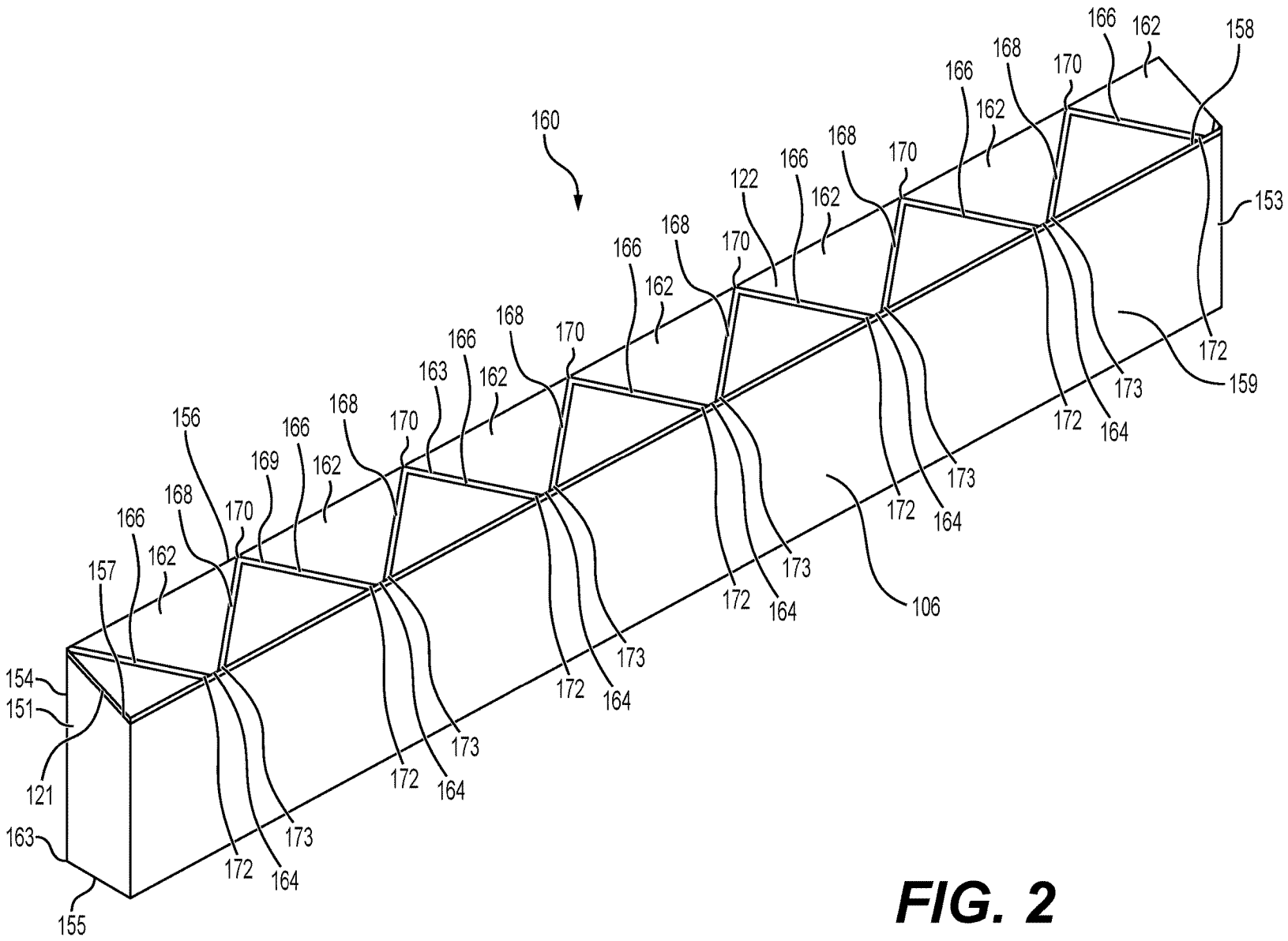
FIG. 2 a perspective view of an exterior wall system component subassembly encompassing aspects of the present disclosure.

FIG. 2 illustrates an exterior wall system component subassembly 160 that encompasses aspects of the present disclosure. The exterior wall system component subassembly 160 comprises a wedge 106. The wedge 106 comprises an insulative material, such as, for example, polystyrene or mineral wool. The wedge 106 comprises a wedge front side 159 and a wedge rear side 154 spaced apart from and opposing the wedge front side 159. The wedge rear side 154 can be aligned generally parallel to the wedge front side 159. The wedge front side 159 exhibits a wedge front side height, and the wedge rear side 154 exhibits a wedge rear side height. The wedge rear side height is greater than the wedge front side height. A wedge bottom side 155 extends between the wedge front side 159 and the wedge rear side 154. The wedge bottom side 155 can be aligned perpendicular to the wedge front side 159 and/or the wedge rear side 154. The wedge 106 also includes a wedge top side 121 that is aligned non-parallel and/or oblique to the wedge bottom side 155 and is sloped and/or inclined downward from a wedge top rear edge 156 to a wedge top front edge 158. A wedge first side 157 extends between the wedge rear side 154 to the wedge front side 159, and a wedge second side 153 is opposed to the wedge first side 157 and extends between the wedge rear side 154 to the wedge front side 159.

A waterproof membrane 122 is disposed directly or indirectly on the wedge top side 121. The waterproof membrane 122 is composed of a waterproof composition that generally prevents penetration of water therethrough at atmospheric pressure. The waterproof membrane 122 can cover the entirety of the wedge top side 121 or a portion thereof. The waterproof membrane 122 covers the wedge top side 121 and extends between the wedge top rear edge 156 to the wedge top front edge 158 and between the wedge first side 157 and the wedge second side 153.

A plurality of channels 162 is aligned on the wedge top side 121. Each channel 162 of the plurality of channels is bounded by the waterproof membrane 122, which forms the floor of each channel 162, a first water-resistant ribbon 166, and a second water-resistant ribbon 168. Each first ribbon 166 and each second ribbon 168 of each channel 162 separately forms a sidewall of the channel 162. Each channel 162 is open to the wedge top rear edge 156. Each first ribbon 166 of each channel 162 extends from a first water-resistant ribbon end 172, disposed at the wedge top front edge 158, to a first water-resistant ribbon apex 170 disposed at the wedge top rear edge 156. Each second ribbon 168 of each channel 162 extends from a second water-resistant ribbon end 173, disposed at the wedge top front edge 158, to a second water-resistant ribbon apex 170 disposed at the wedge top rear edge 156. A first water-resistant ribbon 166 of one channel 162 can connect to a second water-resistant ribbon 168 of an adjacent channel 162 at a water-resistant ribbon apex 170. Each first ribbon end 172 of each channel 162 is spaced apart from each second ribbon end 173 of the channel 162, thereby forming a channel outlet 164 therebetween. Each first ribbon 166 of each channel 162 is disposed at an angle and oblique to the second water-resistant ribbon 168 of the respective channel 162. Accordingly, the sidewalls of each channel 162 extend from two adjacent apexes 170. The first and second apexes 170 of each channel 162 are spaced farther apart than the first and second ribbon ends 172 and 173, respectively, of the channel 162. Each channel 162 exhibits an apex width as measured proximal to the wedge top rear edge 156 and an outlet width measured proximal to the wedge top front edge 158. The apex width of each channel 162 is greater than the outlet width of the channel 162. Thus, the side walls of each channel 162 are angled toward the channel outlet 164. Water that collects within a wall system assembly can migrate down the inclined surface of the wedge top side 121 and can be directed by the side walls of the channels 162 to the channel outlets 164. The first water-resistant ribbons 166 and the second water-resistant ribbons 168 are formed of a water-resistant material that prevents or inhibits the migration of water therethrough under atmospheric pressure.

Figure 3:
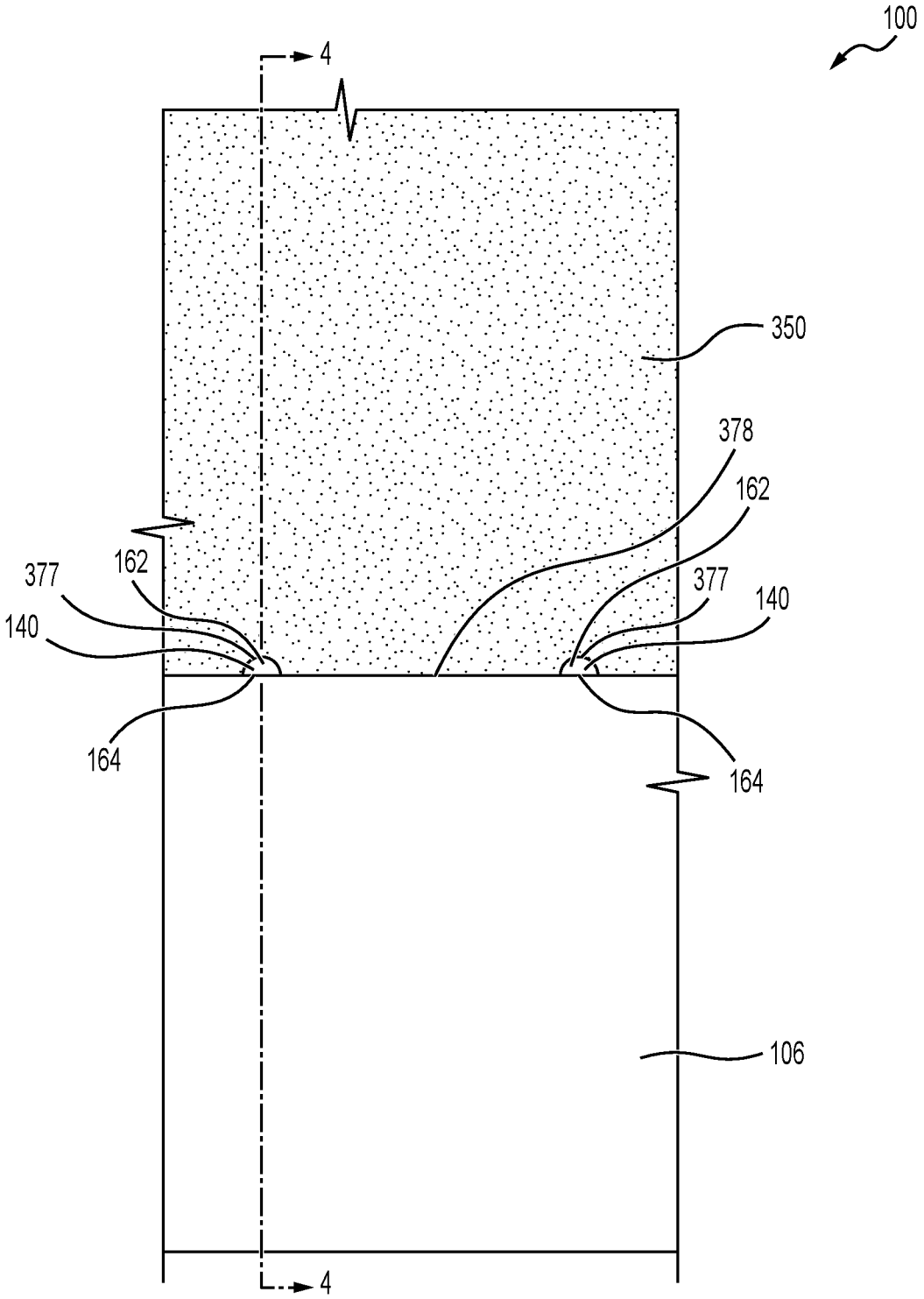
FIG. 3 is an elevation view of a portion of an exterior wall system assembly encompassing aspects of the present disclosure and which includes the exterior wall system component subassembly shown in FIG. 2.

FIG. 3 illustrates a portion of the exterior wall system assembly 100 with the outer surface layers removed to reveal an insulation layer 350 and the wedge 106, shown in FIG. 2, aligned within the wall system assembly 100 below the insulation layer 350. The wedge 106 is disposed directly below the insulation layer 350. The insulation layer 350 has a plurality of weep holes 140 formed therein. Each weep hole 140 is open to the front face of the exterior wall system assembly 100 and in fluid communication with a channel outlet 164 and a channel 162 disposed on the wedge top side 121 of the wedge 106. Each weep hole 140 is defined by an arcuate channel 377 formed in the bottom side 378 of the insulation layer 350.

Figure 4:
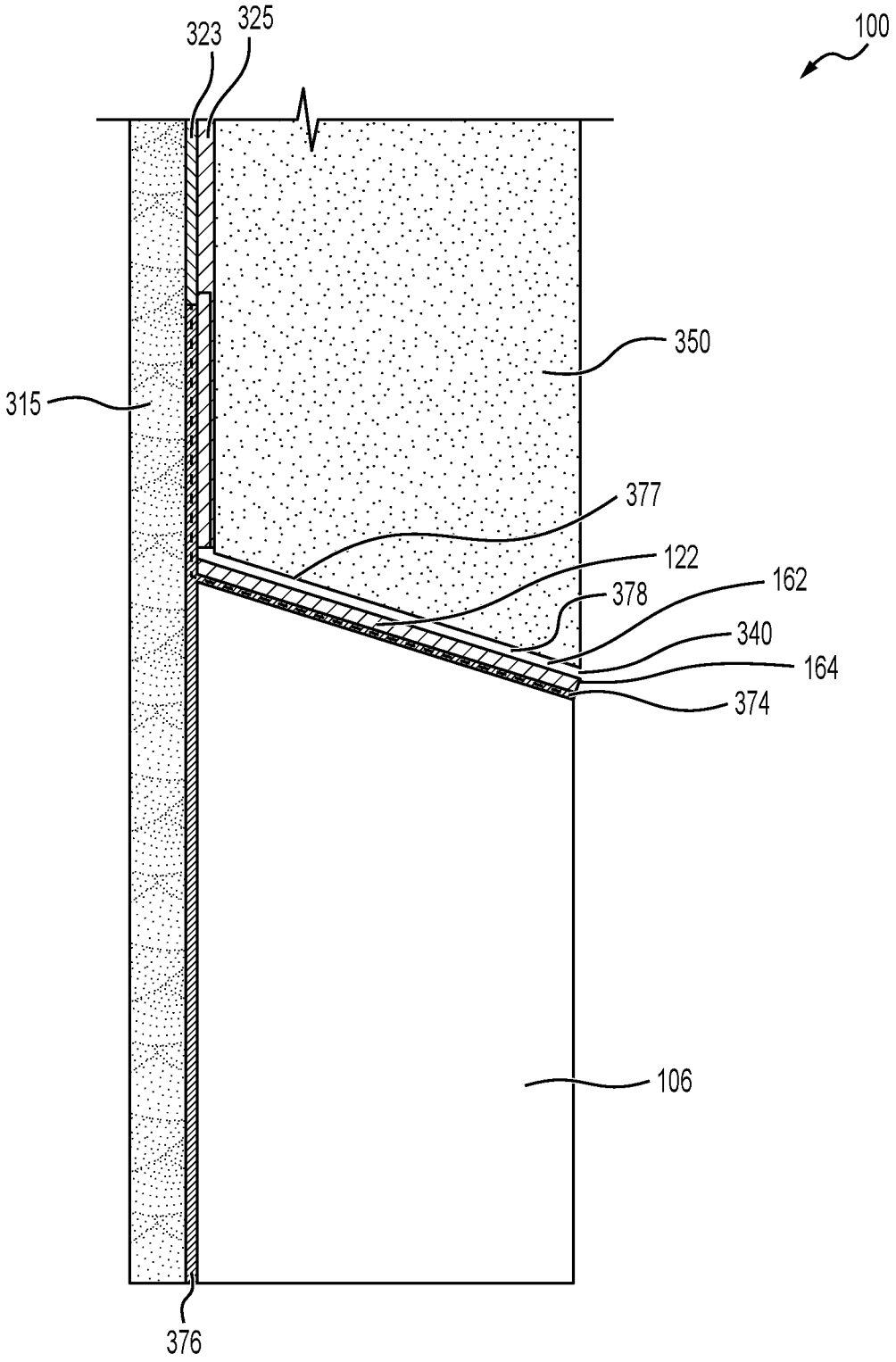
FIG. 4 is a cross-sectional view of a portion of the exterior wall system assembly shown in FIG. 3 taken along line 4-4.

FIG. 4 illustrates a cross-section of a portion of the exterior wall system assembly 100 shown in FIG. 3. The components of the exterior wall system assembly 100 are directly or indirectly mounted to a substrate 315. The wedge 106 is connected to the substrate 315 by an adhesive and base coat layer 376. A portion of a mesh layer 374 is disposed on the wedge top side 121 and another portion of the mesh layer 374 extends vertically above along the substrate 315. The mesh layer 374 extends from the wedge top front edge 158 to the wedge top rear edge 156 and upward therefrom along a portion of the substrate 315. The mesh layer 374 can be adhered to the 106 and/or the substrate 315 by the adhesive and base coat layer 376. The waterproof membrane 122 is disposed on the wedge top side 121 with the mesh layer 374 disposed between the wedge top side 121 and the waterproof membrane 122. The waterproof membrane 122 extends upward from the wedge 106 and optionally can cover a portion of the substrate 315. The waterproof membrane 122 can cover the entirety of the wedge top side 121 extending from the wedge top front edge 158 to the wedge top rear edge 156. The waterproof membrane 122 can be adhered to the wedge 106 and/or substrate 315 by the adhesive and base coat layer 376. Alternatively, the mesh layer 374 can be adhered to the wedge 106 and/or substrate 315 by a liquid polymer coating. In another aspect, the waterproof membrane 122 can be a self-adhering membrane tape adhered to the wedge top side 121 and/or the substrate 315.

The insulation layer 350 is aligned above the wedge 106 in the exterior wall system assembly 100. A water-resistant layer 323 is applied to the substrate 315, and vertical ribbons of an adhesive layer 325 are disposed on the water-resistant layer 323. The insulation layer 350 is mounted to the substrate 315 by adherence provided by the vertical ribbons of the adhesive layer 325. The bottom side 378 of the insulation layer 350 is cut at an angle so that the front bottom edge of the insulation layer 350 is lower than the rear bottom edge of thereof. The angle of the bottom side 378 of the adhesive layer is generally equal to the angle of the wedge top side 121. An arcuate channel 377 is formed in the bottom side 378 and extends from the rear bottom edge to the front bottom edge of the insulation layer 350. The arcuate channel 377 is aligned with the channel outlet 164 of the channel 162 with which the arcuate channel 377 cooperates. The weep hole 140 is the front end of the arcuate channel 377. The arcuate channel 377 provides a portion of a ceiling for the channel 162 for water migrating through a channel 162 to the front face of the exterior wall system assembly 100. Water can drain down the vertical section of the wall assembly between the ribbons of adhesive layer 325 to the channels 162 and then can drain down through the channels 162 to the weep holes 140 and out of the exterior wall system assembly 100 to the outer face thereof.

FIGS. 5-31 illustrate exterior wall system assemblies 300, 400, 900, 1400, 1500, exterior wall system component subassemblies 360, 460, 560, 660, 760, 860, 960, exterior wall panel system 1100, and components thereof, each of which encompasses aspects of the present disclosure. Each of the exterior wall system assemblies 300, 400, 900, 1400, 1500, exterior wall system component subassemblies 360, 460, 560, 660, 760, 860, 960, and exterior wall panels 1102 and 2102 comprises a combination of drainage features and fireblocking features. Each of the drainage features and fireblocking features set forth therein can be used in combination with each other and/or by separately in an exterior wall system assembly, an exterior wall system component subassembly, exterior wall panel system and/or an exterior wall panel.

Figure 5:
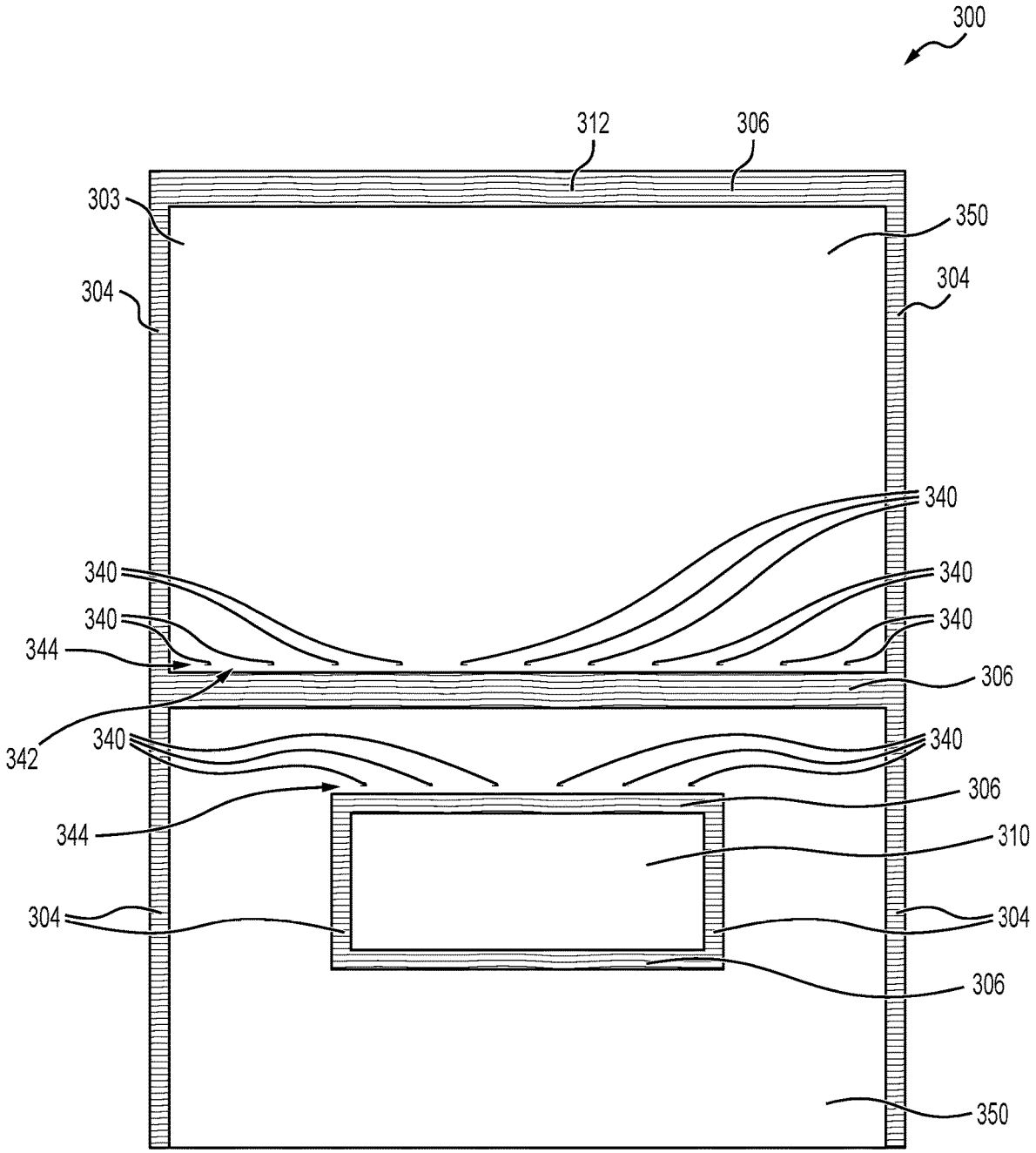
FIG. 5 is an elevation view of a portion of another exterior wall system assembly encompassing aspects of the present disclosure.
Figure 6:
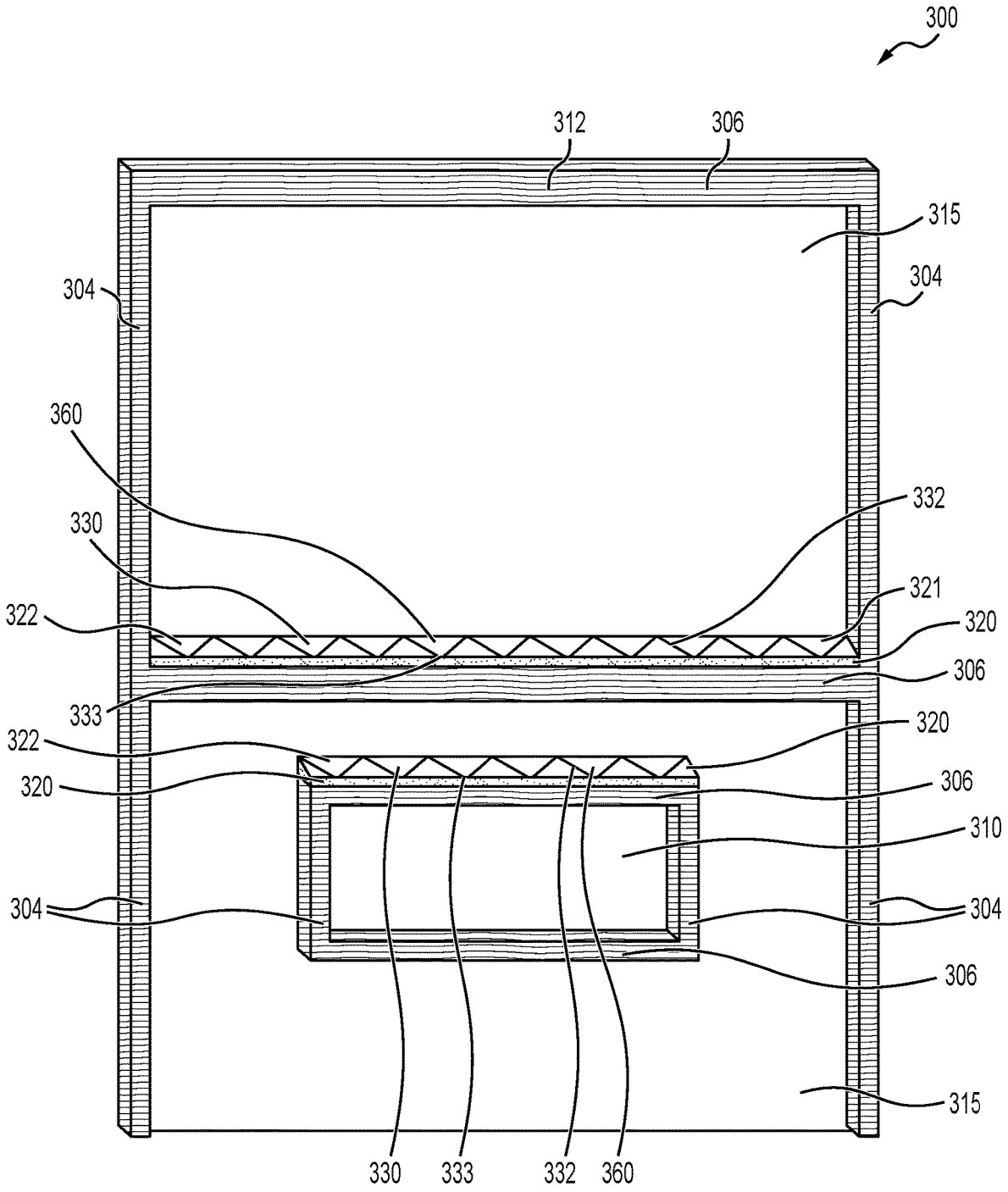
FIG. 6 is a perspective view of the exterior wall system assembly shown in FIG. 5 with the insulation boards removed leaving a fireblocking framework and a plurality of drainage wedges mounted on a substrate with a water-resistant layer disposed therebetween.

FIGS. 5 and 6 illustrate a portion of an exterior wall system assembly 300 encompassing aspects of the present disclosure. FIG. 5 illustrates a portion of a wall of a multi-story building with a window opening 310 disposed in a bottom story thereof and the outer layers of the exterior wall system assembly 300 removed to reveal the insulator layer 350 and fireblocking frame work 312. The exterior wall system assembly 300 comprises a plurality of concealed spaces each of which is bounded by the columns and rows of a fireblocking framework 312. The concealed spaces of the exterior wall system assembly 300 are disposed in a bounded area 303 that is bounded by at least one fireblocking base form 306 and at least one fireblocking vertical form 304. In one aspect, a bounded area 303 can be bounded by two fireblocking rows of fireblocking base forms 306 and two fireblocking columns of fireblocking vertical forms 304 that intersect the two fireblocking rows. The fireblocking framework 312 comprises a plurality of fireblocking columns that extend upward along the height of the multi-story building and a plurality of fireblocking rows of fireblocking base forms 306 extending along the width of the multi-story building and aligned along the floor slab or base of each story. Each of the plurality of fireblocking rows of fireblocking base forms 306 intersect the plurality of fireblocking columns. Each fireblocking column comprises one or more fireblocking vertical forms 304 aligned end-to-end within the exterior wall system assembly 300.

The exterior wall system assembly 300 also comprises one or more weep hole rows 344, each of which comprises a plurality of weep holes 340. The weep hole rows 344 are aligned proximal to the fireblocking base forms 306. More particularly, each weep hole 340 is aligned proximal to the top front edge 258 of a fireblocking base form 306. Each fireblocking base form 306 can abut at least one fireblocking vertical form 304 on the left side 251 and/or the right side 253 of the fireblocking base form 306. Likewise, each fireblocking vertical form 304 can abut at least one fireblocking base form 306 on the left side and/or the right side of the fireblocking vertical form 304.

The exterior wall system assembly 300 also includes insulation layers 350 disposed above and below the fireblocking base form 306. The insulation layers 350 can be formed of any appropriate material, such as expanded polystyrene (EPS), extruded polystyrene (XPS), graphite polystyrene (GPS), rock wool, and/or mineral wool or another material having insulative properties and other desired performance characteristics. The insulation layer 350 is mounted to a sheathing layer 315 by an adhesive and basecoat layer 376. The adhesive and base coat layer 376 can be provided in a plurality of vertical strips on an air and water-resistant layer covering the sheathing layer 315. One or more concealed spaces can be formed by the cooperation of the adhesive and base coat layer 376, the air and water-resistant layer and the insulation layer 350. These concealed spaces potentially could serve as a route through which fire could propagate vertically and/or horizontally through the exterior wall system assembly 300.

FIG. 6 illustrates the exterior wall system assembly 300 shown in FIG. 5 with the insulation layer 350 of removed from the substrate 315, leaving the fireblocking framework 312 and two exterior wall system component subassemblies 360, each of which includes a wedge 320 disposed above a fireblocking base form 306 and mounted to the substrate 315. Each wedge 320 has a wedge top side 321 that is sloped downward from the top rear edge to the top front edge thereof. On each wedge top side 321 is disposed a plurality of drainage channels 330 formed by a plurality of ribbons 332 disposed on a waterproof membrane 322. A plurality of drainage channel outlets 333 are disposed on top front edge of each wedge 320. Each drainage channel outlet of the plurality of drainage channel outlets 333 is in fluid communication with a drainage channel of the plurality of drainage channels 330 and a weep hole 340. The sheathing layer 315 can be formed of a glass mat-faced gypsum core, wood-based sheathing, and/or cementitious sheathing.

The fire-resistant material of each fireblocking vertical form 304 contacts the fire-resistant material of each adjacently aligned fireblocking base form 306 and each adjacently aligned fireblocking vertical form 304 contacting the respective fireblocking vertical form 304, thereby forming the fireblocking framework 312 that forms a continuous multi-layer fire-resistant barrier between and throughout each story of a multi-story building.

In one aspect, each fireblocking base form 306 can be aligned a distance in a range of about 2.438 m to about 6.096 m from the nearest adjacent row of fireblocking base forms 306 above and/or below. In another aspect, each row of fireblocking base forms 306 can be aligned a distance in a range of about 3 m to about 6 m from the nearest adjacent row of fireblocking base form 306 above and/or below. In a further aspect, each row of fireblocking base forms 306 can be aligned a distance of less than or equal to about 6 m from the nearest adjacent row of fireblocking base forms 306 above or below. In yet another aspect, each fireblocking vertical form 304 can be aligned a distance in a range of about 2.438 m to about 6.096 m from the nearest adjacent fireblocking vertical form 304 to the left and/or right. In another aspect, each fireblocking vertical form 304 can be aligned a distance in a range of about 3 m to about 6 m from the nearest adjacent fireblocking columns 306 to the left and/or right. In a further aspect, each fireblocking vertical form 304 can be aligned a distance of less than or equal to about 6 m from the nearest adjacent fireblocking vertical form 304 to the left and/or right. In still a further aspect, the exterior wall system assembly 300 can comprise one or more concealed spaces each with an area bounded by one or more fireblocking vertical forms 304 and one or more fireblocking base forms 306 of less than about 9.3 $m^2$. In another aspect, the exterior wall system assembly 300 can comprise one or more concealed spaces each which is disposed within an area 303 bounded by one or more fireblocking vertical forms 304 and one or more fireblocking base forms 306 in a range of about 4 $m^2$ to about 9 $m^2$.

Figure 7A:
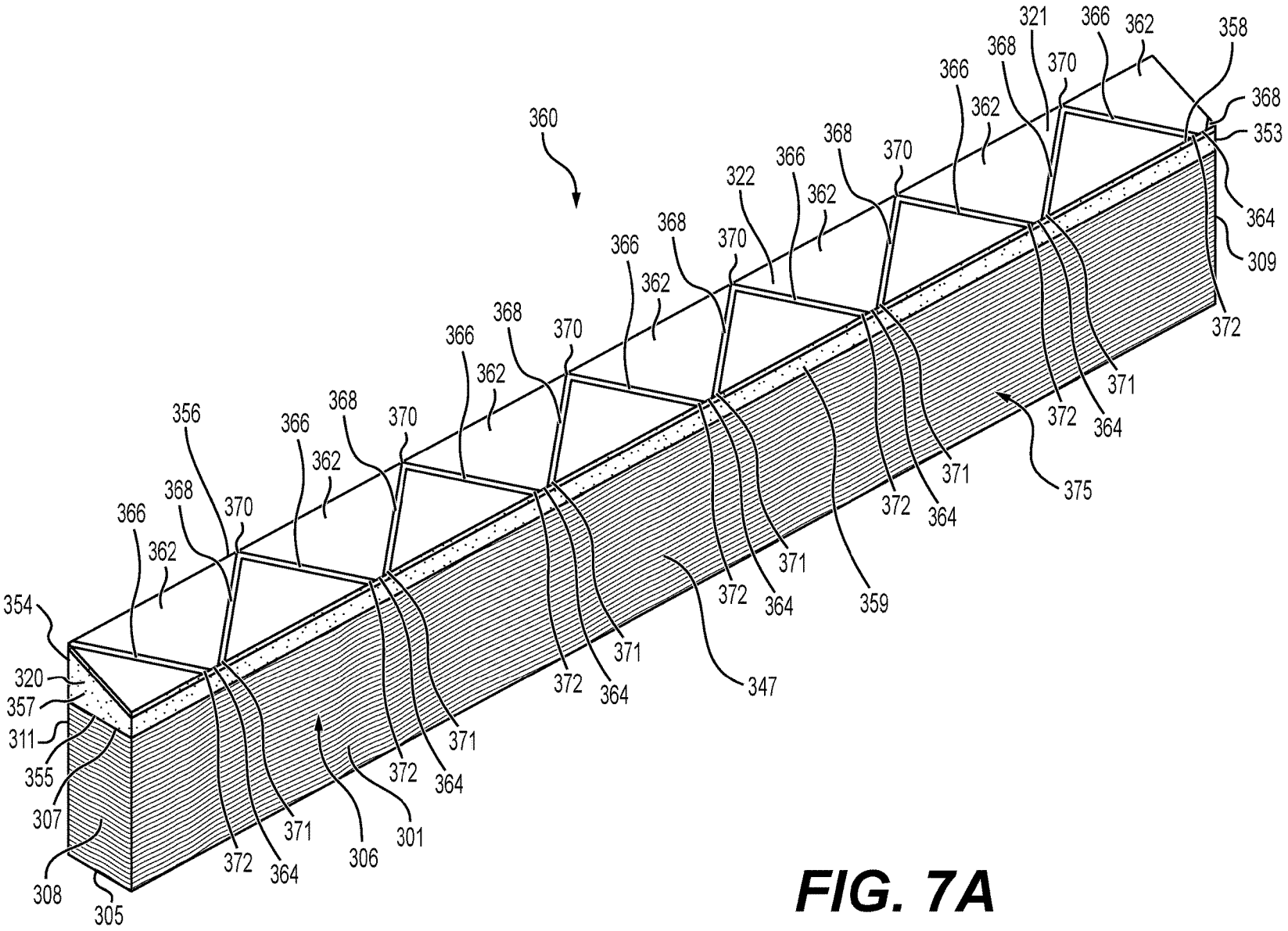
FIG. 7A is a perspective view of another exterior wall system component subassembly encompassing aspects of the present disclosure.

FIG. 7A illustrates an exterior wall system component subassembly 360 that encompasses aspects of the present disclosure. The exterior wall system component subassembly 360 comprises a fireblocking base form 306, a wedge 320 disposed on a base form top side of the fireblocking base form 306, and a plurality of channels 362 disposed on the wedge top side 321 configured to allow water that collects within a wall assembly to migrate down the wedge top side 321 through the channels 362 to the outlets 364 thereof.

The fireblocking base form 306 comprises a fire-resistant material 375, such as, for example, mineral wool that is provided in a plurality of lamellar layers to form a lamella 347. The lamellar layers of the lamella 347 are aligned generally perpendicular to a front face of the exterior wall system assembly 300. On the top side of the fireblocking base form 306 is disposed the wedge 320. The wedge 320 comprises a wedge front side 359 and a wedge rear side 354 spaced apart from and opposing the wedge front side 359. The wedge rear side 354 can be aligned generally parallel to the wedge front side 359. The wedge front side 359 exhibits a wedge front side height, and the wedge rear side 354 exhibits a wedge rear side height. The wedge rear side height is greater than the wedge front side height. A wedge bottom side 355 extends between the wedge front side 359 and the wedge rear side 354. The wedge bottom side 355 can be aligned perpendicular to the wedge front side 359 and/or the wedge rear side 354. The wedge bottom side 355 can be disposed on the top side of the fireblocking base form 306. The wedge 320 also includes a wedge top side 321 that is aligned non-parallel and/or oblique to the wedge bottom side 355 and is sloped and/or inclined downward from a wedge top rear edge 356 to a wedge top front edge 358. A wedge first side 357 extends between the wedge rear side 354 to the wedge front side 359, and a wedge second side 353 is opposed to the wedge first side 357 and extends between the wedge rear side 354 to the wedge front side 359.

A waterproof membrane 322 is disposed on the wedge top side 321. The waterproof membrane 322 covers the wedge top side 321 and extends between the wedge top rear edge 356 to the wedge top front edge 358 and between the wedge first side 357 to the wedge second side 353. A plurality of channels is aligned on the wedge top side 321. Each channel 362 of the plurality of channels is bounded by the waterproof membrane 322, which forms the floor of each channel 362, a first water-resistant ribbon 366, and a second water-resistant ribbon 368. Each of the first water-resistant ribbon 366 and the second water-resistant ribbon 368 of each channel 362 forms a sidewall of the channel 362. Each first ribbon 366 of each channel 362 extends from a first water-resistant ribbon end 372 disposed at the wedge top front edge 358 to a first water-resistant ribbon apex 370 disposed at the wedge top rear edge 356. Each second ribbon 368 of each channel 362 extends from a second water-resistant ribbon end 371 disposed at the wedge top front edge 358 to a second water-resistant ribbon apex 370 disposed at the wedge top rear edge 356. Each first ribbon end 372 of each channel 362 is spaced apart from each second ribbon end 371 of the channel 362, thereby forming a channel outlet 364 therebetween. Each first ribbon 366 of each channel 362 is disposed at an angle to the second water-resistant ribbon 368 of the respective channel 362. The angle of inclination between the first water-resistant ribbon 266 and the second water-resistant ribbon 368 can be oblique, acute, or a right angle. Accordingly, each first water-resistant ribbon apex 370 of each channel 362 is spaced apart from each second water-resistant ribbon apex 370 of the channel 362. The first and second apexes 370 of each channel 362 are spaced farther apart than the first and second ribbon ends 372 and 371 of the channel 362. Each channel 362 has an apex width proximal to the wedge top rear edge 356 and an outlet width proximal to the wedge top front edge 358. The apex width of each channel 362 is greater than the outlet width of the channel 362. Thus, the side walls of each channel 362 are angled toward the channel outlet 364. Water migrating down the sloped surface of the wedge top side 321 is directed by the side walls of the channels 362 to the channel outlets 364.

The fireblocking base form 306 is rectangular in configuration with a base form front side 301, a base form rear side 311 opposing the base form front side 301, a base form top side 307 extending between the base form front side 301 and the base form rear side 311, and a base form bottom side 305 opposing the base form top side 307 and extending between the base form front side 301 and the base form rear side 311. The base form rear side 311 can be aligned generally parallel to the base form front side 301, and the base form bottom side 305 can be aligned generally parallel to the base form top side 307. The fireblocking base form 306 also includes a fireblocking base form first side 308 extending between the fireblocking base form front side 301 and the fireblocking base form rear side 311 and the fireblocking base form top side 307 and the fireblocking base form bottom side 305. The fireblocking base form 306 also includes a fireblocking base form second side 309 extending between the fireblocking base form front side 301 and the fireblocking base form rear side 311 and the fireblocking base form top side 307 and the fireblocking base form bottom side 305.

The fireblocking base form 306 comprises a fire-resistant material 375, such as, for example, mineral wool, rock wool, foamed concrete, cementitious material, or glass matting. Examples of fire-resistant material include THERMAFIBER® Mineral Wool CI-C SC18 Mineral Wool Insulation from Thermafiber, Inc. of Toledo, Ohio, USA, and the monolithic density version of FRONTROCK™ Stone Wool Insulation from ROCKWOOL® of Milton, Ontario, Canada. The fireblocking base form 306 comprises a lamella 347 of the fire-resistant material 375. The lamella 347 comprises a plurality of lamellar layers stacked upon each other to form the overall lamella 347. The lamellar layers are aligned generally perpendicular or transverse to the front side and generally parallel to the bottom side of the fireblocking base form 306. In one aspect, the fireblocking base form 306 can comprise the fire-resistant material 375. In another aspect, the fireblocking base form 306 can consist essentially of the fire-resistant material 375. In yet another aspect, the fireblocking base form 306 can consist of the fire-resistant material 375. In one aspect, the fireblocking base form 306 can comprise a lamella 347 of fire-resistant material 375. In another aspect, the fireblocking base form 306 can consist essentially of a lamella 347 of fire-resistant material 375. In a further aspect, the fireblocking base form 306 can consist of a lamella 347 of fire-resistant material 375.

Figure 7B:
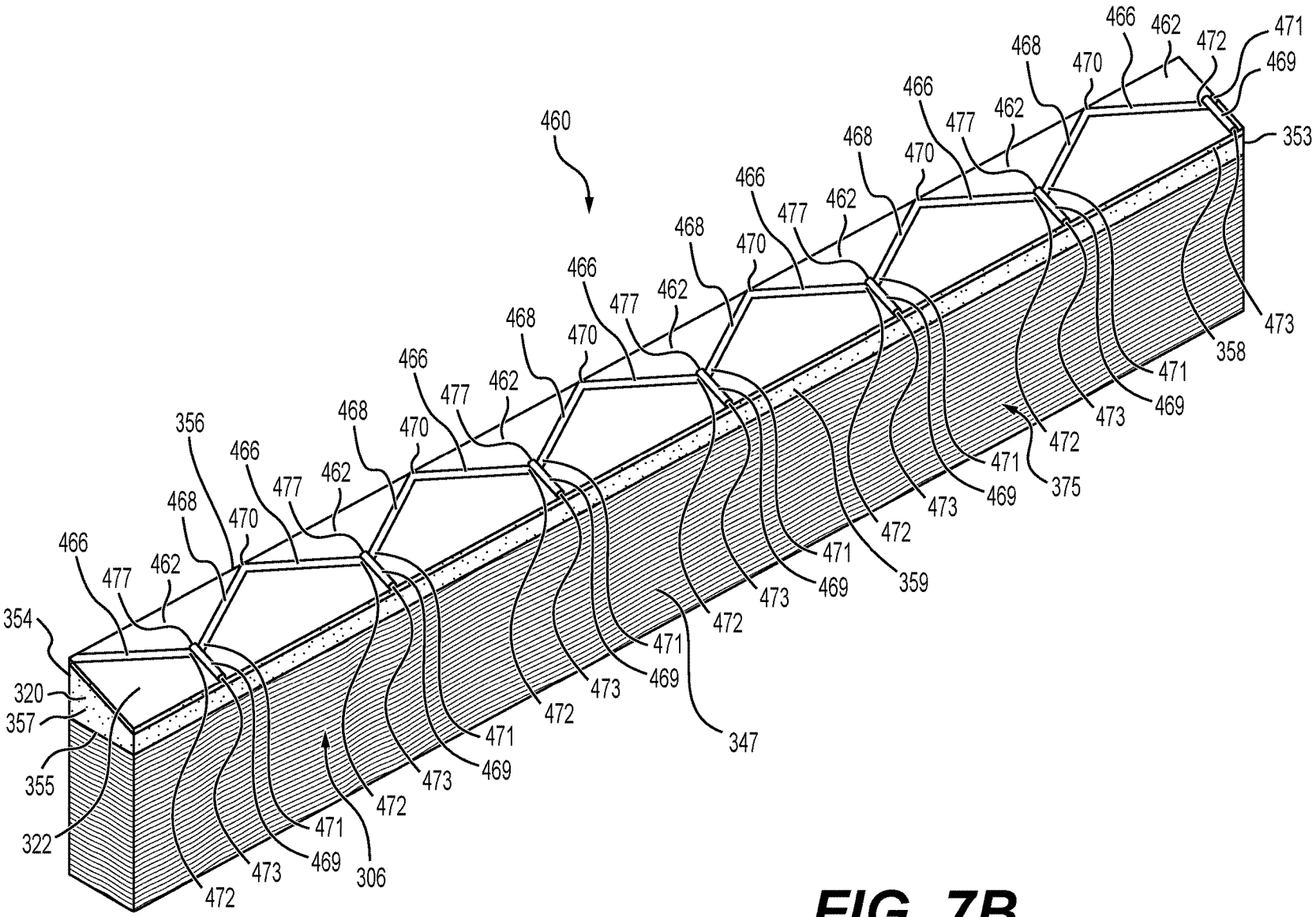
FIG. 7B is a perspective view of yet another exterior wall system component subassembly encompassing aspects of the present disclosure.

FIG. 7B illustrates another exterior wall system component subassembly 460 that encompasses aspects of the present disclosure. The exterior wall system component subassembly 460 comprises features similar to those of exterior wall system component subassembly 360 and additionally comprises a plurality of weep tubes 469. Among the features of the exterior wall system component subassembly 460 is a fire blocking base form 306. The fireblocking base form 306 comprises a fire-resistant material 375, such as, for example, mineral wool that is provided in a plurality of lamellar layers to form a lamella 347. The lamellar layers of the lamella 347 are aligned generally perpendicular to a front face of an exterior wall system assembly. On the top side of the fireblocking base form 306 is disposed a wedge 320. The wedge 320 comprises a wedge front side 359 and a wedge rear side 354 spaced apart from and opposing the wedge front side 359. The wedge rear side 354 can be aligned generally parallel to the wedge front side 359. The wedge front side 359 exhibits a wedge front side height, and the wedge rear side 354 exhibits a wedge rear side height. The wedge rear side height is greater than the wedge front side height. A wedge bottom side 355 extends between the wedge front side 459 and the wedge rear side 354. The wedge bottom side 355 can be aligned perpendicular to the wedge front side 359 and/or the wedge rear side 354. The wedge bottom side 355 can be disposed on the top side of the fireblocking base form 306. The wedge 320 also includes a wedge top side 321 that is aligned oblique to the wedge bottom side 355 and is sloped downward from a wedge top rear edge 356 to a wedge top front edge 358. A wedge first side 357 extends between the wedge rear side 354 to the wedge front side 359, and a wedge second side 353 is opposed to the wedge first side 357 and extends between the wedge rear side 354 to the wedge front side 359.

A waterproof membrane 322 is disposed on the wedge top side 321. The waterproof membrane 322 covers the wedge top side 321 and extends between the wedge top rear edge 356 to the wedge top front edge 358 and between the wedge first side 357 to the wedge second side 353. A plurality of channels 462 is aligned on the wedge top side 321. Each channel 462 of the plurality of channels is bounded by the waterproof membrane 322, which forms the floor of each channel 462, a first water-resistant ribbon 466, and a second water-resistant ribbon 468. Each of the first water-resistant ribbon 466 and the second water-resistant ribbon 468 of each channel 462 forms a sidewall of the channel 462. Each first ribbon 466 of each channel 462 extends from a first water-resistant ribbon end 472 disposed intermediate between the wedge top front edge 458 and the wedge top rear edge 456 to a water-resistant ribbon apex 470 disposed at the wedge top rear edge 356. Each second ribbon 468 of each channel 462 extends from a second water-resistant ribbon end 471 disposed intermediate between the wedge top front edge 458 and the wedge top rear edge 356 and a water-resistant ribbon apex 470 disposed at the wedge top rear edge 356. Each first ribbon end 472 of each channel 462 is spaced apart from each second ribbon end 471 of the channel 462, thereby forming a channel outlet therebetween.

Each channel outlet is disposed at and in fluid communication with a top end 477 of a weep tube 469. The exterior wall system component subassembly 460 comprises a plurality of weep tubes 469. At least of a portion of each weep tube 469 is disposed on the wedge top side 321. As shown in FIG. 7B, each weep tube 469 is aligned with the top end 477 of the weep tube 469 disposed at a channel outlet and a bottom end 473 of each weep tube 469 disposed at the wedge top front edge 358. Both of the first water-resistant ribbon end 472 and the second water-resistant ribbon end 471 of each channel 462 contacts the weep tube 469 aligned therewith, thereby forming a barrier that directs water down the channel 462 to the top end 477 of the weep tube 469. Water can thereby enter the hollow weep tube 469 through the open top end 477 and travel down the weep tube 469 and out thereof through the open bottom end 473 of the weep tube 469.

Each first ribbon 466 of each channel 462 is disposed at an angle to the second water-resistant ribbon 468 of the respective channel 462. The angle formed by the first water-resistant ribbon 466 and the second water-resistant ribbon 468 can be acute, obtuse or a right angle. The apexes 470 of each channel 462 are spaced farther apart than the first and second ribbon ends 472 and 471 of the channel 462. Each channel 462 has an apex width proximal to the wedge top rear edge 356 and an outlet width proximal to the weep tube 469. The apex width of each channel 462 is greater than the outlet width of the channel 462. Thus, the side walls of each channel 462 are angled toward the channel outlet 464. Water migrating down the sloped surface of the wedge top side 321 is directed by the side walls of the channels 462 to the channel outlets 364 and the top end 477 of the weep tube 469.

Figure 8:
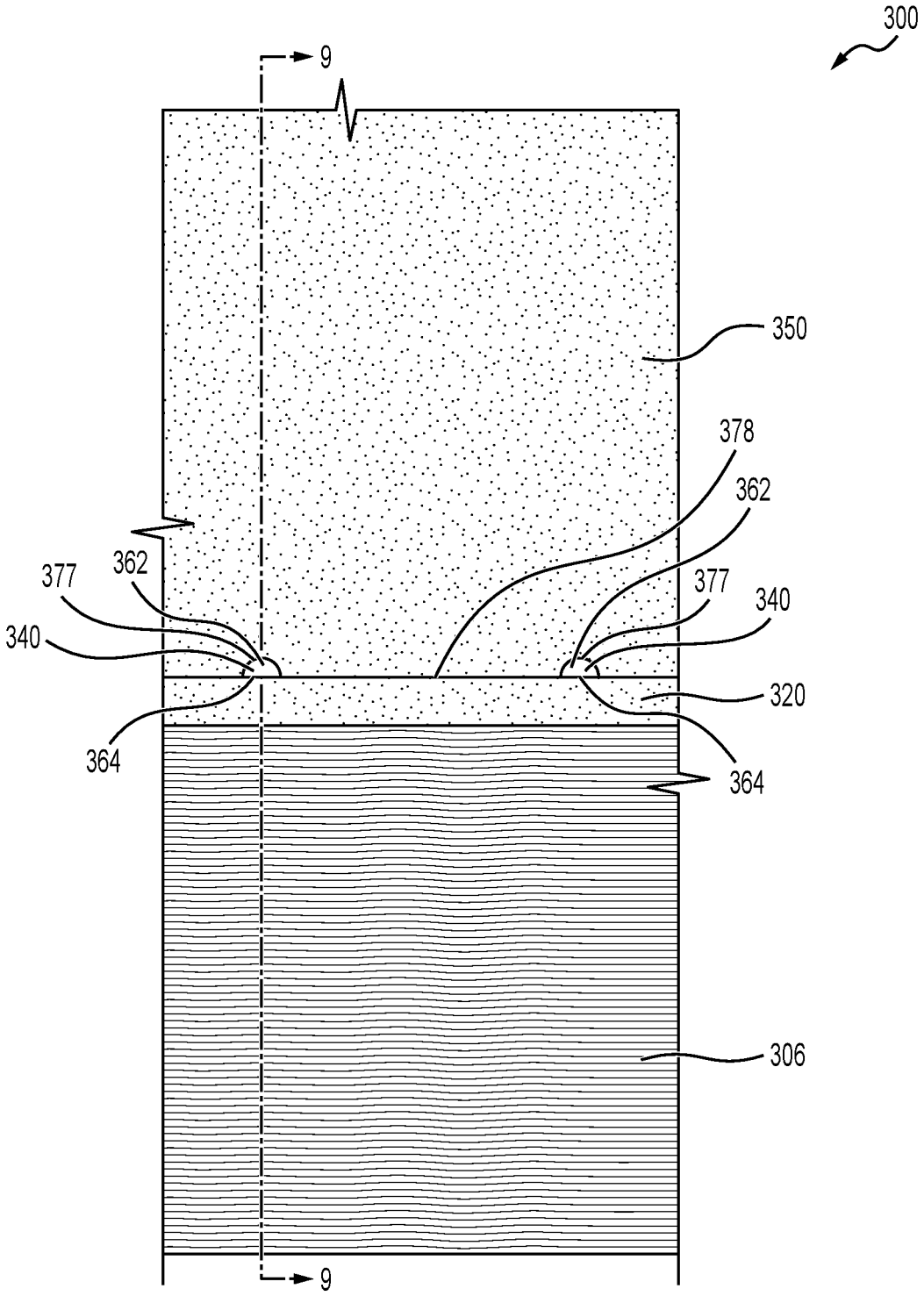
FIG. 8 is a front elevation view of a portion of an exterior wall system assembly and which includes the exterior wall system component subassembly shown in FIG. 7A.

FIG. 8 illustrates a portion of the exterior wall system assembly 300 that comprises the exterior wall system component subassembly 360. The wedge 320 is disposed above the fireblocking base form 306. The insulation layer 350 disposed above the wedge 320 has a plurality of weep holes 340 formed therein. Each weep hole 340 is open to the front face of the exterior wall system assembly 300 and in fluid communication with a channel outlet 364 and a channel 362. Each weep hole 340 is defined by an arcuate channel formed in the bottom side 378 of the insulation layer 350.

Figure 9:
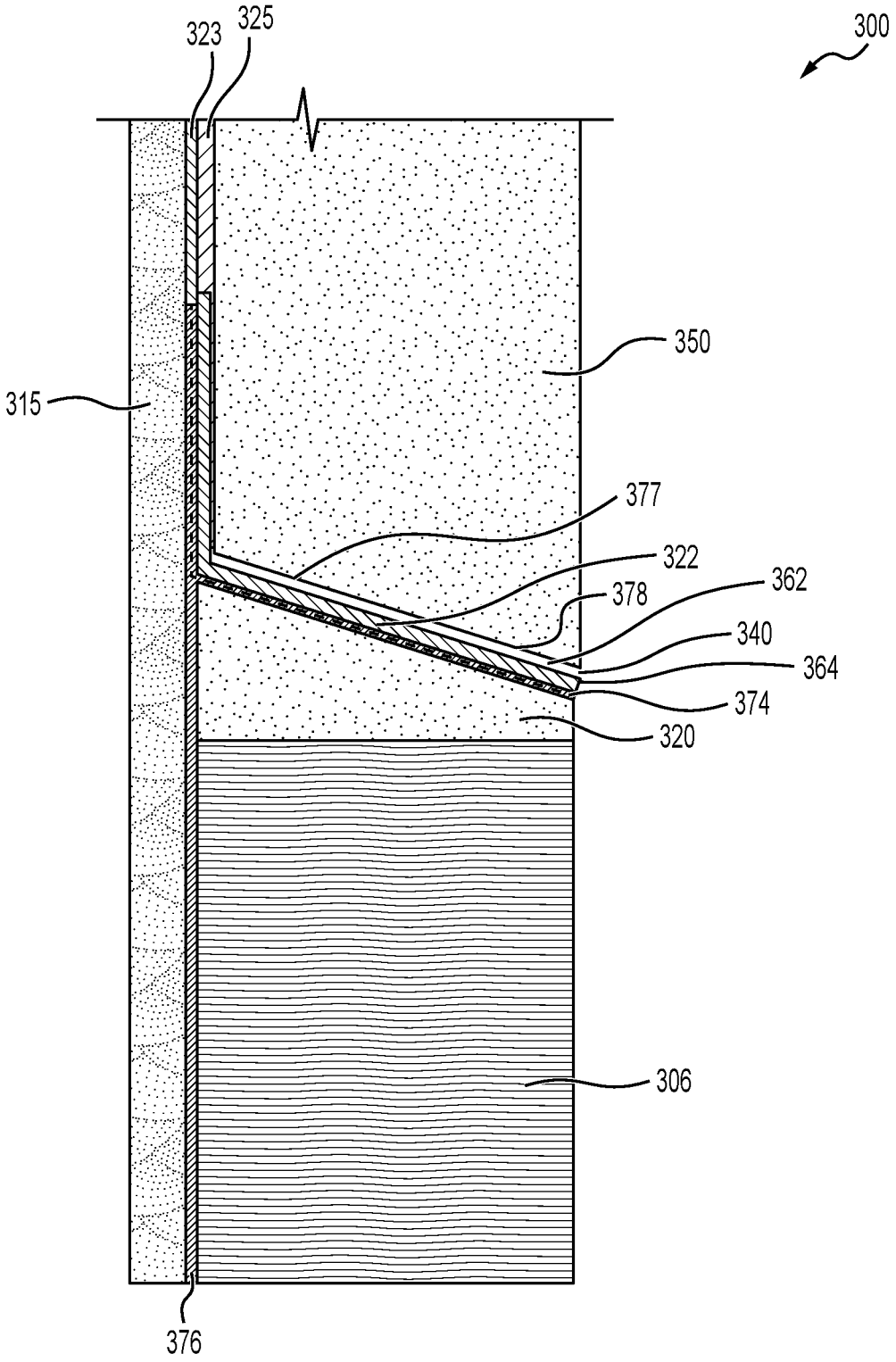
FIG. 9 is a cross-sectional view of a portion of the exterior wall system assembly shown in FIG. 8 taken along line 9-9.

FIG. 9 illustrates a cross-section of a portion of the exterior wall system assembly 300. The other components of the exterior wall system assembly 300 are directly or indirectly mounted to a substrate 315. The fireblocking base form 306 is connected to the substrate 315 by an adhesive and base coat layer 376. The wedge 320 is aligned on the top side of the fireblocking base form 306 and connected to the substrate 315 by the adhesive and base coat layer 376. A portion of a mesh layer 374 is disposed on the wedge top side 321 and another portion of the mesh layer 374 extends vertically above along the substrate 315. The mesh layer 374 extends from the wedge top front edge 358 to the wedge top rear edge 356 and upward therefrom along a portion of the substrate 315. The mesh layer 374 can be adhered to the wedge 320 and/or the substrate 315 by the adhesive and base coat layer 376. The waterproof membrane 322 is disposed on the wedge top side 321 with the mesh layer 374 disposed between the wedge top side 321 and the waterproof membrane 322. The waterproof membrane 322 extends upward from the wedge 320 and covers a portion of the substrate 315. The waterproof membrane 322 can cover the entirety of the wedge top side 321 extending from the wedge top front edge 358 to the wedge top rear edge 356. The waterproof membrane 322 can be adhered to the wedge 320 and/or substrate 315 by the adhesive and base coat layer 376. Alternatively, the mesh layer 374 can be adhered to the wedge 320 and/or substrate 315 by a liquid polymer coating. In another aspect, the waterproof membrane 322 can be a self-adhering membrane tape adhered to the wedge 320 and/or the substrate 315.

The insulation layer 350 is aligned above the wedge 320 in the exterior wall system assembly 300. A water-resistant layer 323 is applied to the substrate 315, and vertical ribbons of an adhesive layer 325 are disposed on the water-resistant layer 323. The insulation layer 350 is mounted to the substrate 315 by adherence provided by the vertical ribbons of the adhesive layer 325. The bottom side 378 is cut at an angle so that the front bottom edge of the insulation layer 350 is lower than the rear bottom edge of thereof. The angle of the bottom side 378 of the adhesive layer is generally equal to the angle of the wedge top side 321. An arcuate channel 377 is formed in the bottom side 378 and extends from the rear bottom edge to the front bottom edge of the insulation layer 350. The arcuate channel 377 is aligned with the channel 362 and the the channel outlet 364. The weep hole 340 is the front end of the arcuate channel 377. The arcuate channel 377 provides a portion of a ceiling for the channel 362 for water migrating through a channel 362 to the front face of the exterior wall system assembly 300.

Figure 10A:
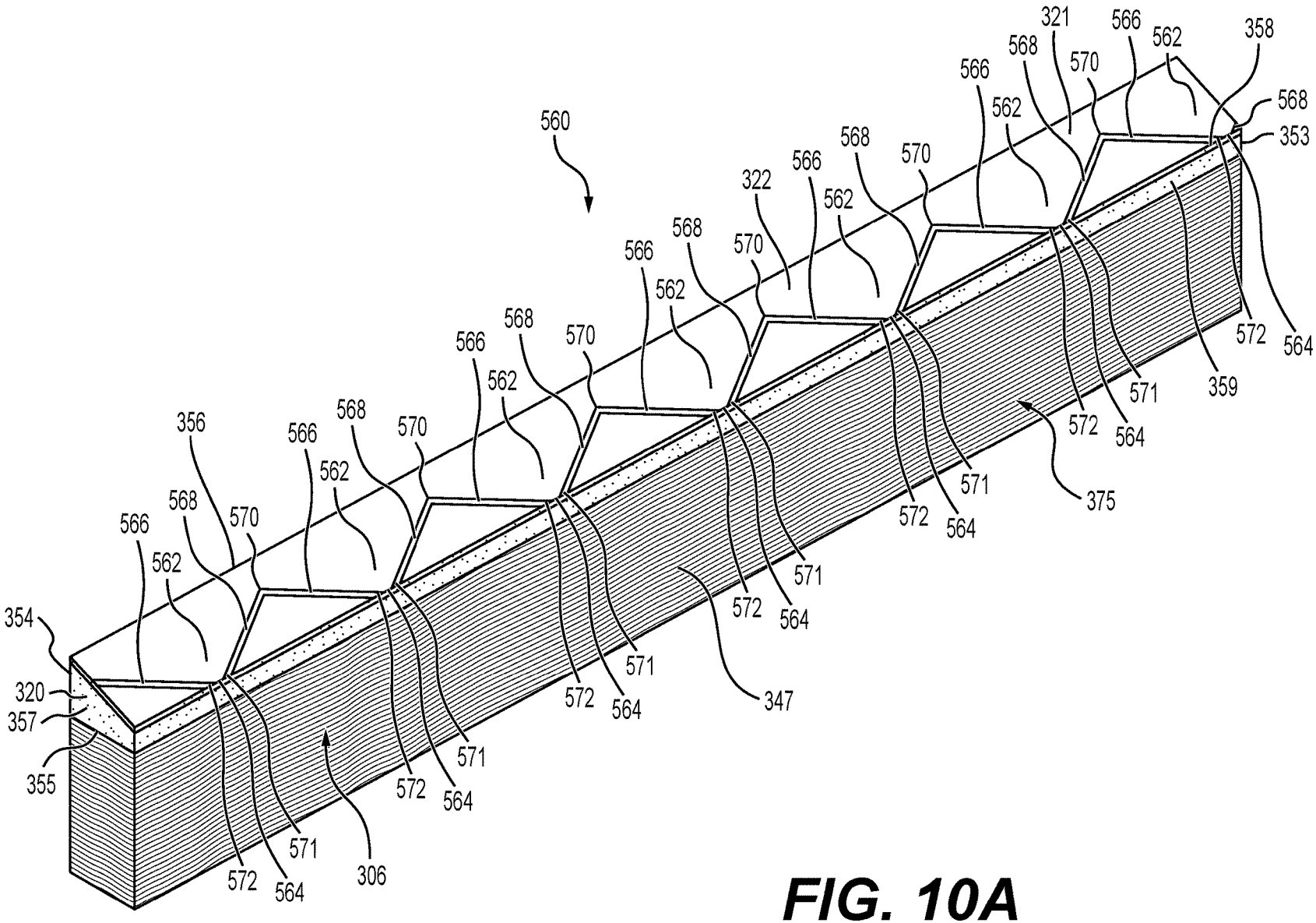
FIG. 10A is a perspective view of another exterior wall system component subassembly encompassing aspects of the present disclosure.

FIG. 10A illustrates an exterior wall system component subassembly 560 that encompasses aspects of the present disclosure. Rather than a water-resistant ribbon apex 570 being disposed at a wedge top rear edge 356, the water-resistant ribbon apexes 570 are disposed intermediate between the wedge top rear edge 356 and the wedge top front edge 358. The exterior wall system component subassembly 560 comprises a fireblocking base form 306 comprising a fire-resistant material 375 provided in a plurality of lamellar layers to form a lamella 347. On the top side of the fireblocking base form 306 is disposed a wedge 320. The wedge 320 exhibits the same length and width of the fireblocking base form 306 and is disposed thereon so that the side thereof are flush with the sides of the fireblocking base form 306. The wedge 320 comprises a wedge front side 359 and a wedge rear side 354 spaced apart from and opposing the wedge front side 359. The wedge rear side 354 can be aligned generally parallel to the wedge front side 359. The wedge front side 359 exhibits a wedge front side height, and the wedge rear side 354 exhibits a wedge rear side height. The wedge rear side height is greater than the wedge front side height. A wedge bottom side 355 extends between the wedge front side 359 and the wedge rear side 354. The wedge bottom side 355 can be aligned perpendicular to the wedge front side 359 and/or the wedge rear side 354. The wedge bottom side 355 can be disposed on the top side of the fireblocking base form 306. The wedge 320 also includes a wedge top side 321 that is aligned oblique to the wedge bottom side 355 and is sloped downward from a wedge top rear edge 356 to a wedge top front edge 358. A wedge first side 357 extends between the wedge rear side 354 to the wedge front side 359, and a wedge second side 353 is opposed to the wedge first side 357 and extends between the wedge rear side 354 to the wedge front side 359.

A waterproof membrane 322 is disposed on the wedge top side 321. The waterproof membrane 322 covers the wedge top side 321 and extends between the wedge top rear edge 356 to the wedge top front edge 358 and between the wedge first side 357 to the wedge second side 353. A plurality of channels 562 is aligned on the wedge top side 321. Each channel 562 of the plurality of channels is bounded by the waterproof membrane 322, which forms the floor of each channel 562, a first water-resistant ribbon 566, and a second water-resistant ribbon 568. Each of the first water-resistant ribbon 566 and the second water-resistant ribbon 568 of each channel 562 forms a sidewall of the channel 562. Each first ribbon 566 of each channel 562 extends from a first water-resistant ribbon end 572 disposed at the wedge top front edge 358 to a first water-resistant ribbon apex 570 disposed intermediate between the wedge top rear edge 356 and the wedge top front edge 358. Each second ribbon 568 of each channel 562 extends from a second water-resistant ribbon end 571 disposed at the wedge top front edge 358 to a second water-resistant ribbon apex 570 disposed intermediate between the wedge top rear edge 356 and the wedge top front edge 358. Each first ribbon end 572 of each channel 562 is spaced apart from each second ribbon end 571 of the channel 562, thereby forming a channel outlet 564 therebetween. Each first ribbon 566 of each channel 562 is disposed at an angle to the second water-resistant ribbon 568 of the respective channel 562. The angle of alignment of the first water-resistant ribbon 566 and the second water-resistant ribbon 568 can be acute, obtuse, or a right angle. Accordingly, each first water-resistant ribbon apex 570 of each channel 562 is spaced apart from each second water-resistant ribbon apex 570 of the channel 562. The first and second apexes 570 of each channel 562 are spaced farther apart than the first and second ribbon ends 572 of the channel 562. Each channel 562 has an apex width proximal to the wedge top rear edge 356 and an outlet width proximal to the wedge top front edge 358. The apex width of each channel 562 is greater than the outlet width of the channel 562. Thus, the side walls of each channel 562 are angled toward the channel outlet 564. Water migrating down the sloped surface of the wedge top side 321 is directed by the side walls of the channels 562 to the channel outlets 564.

Figure 10B:
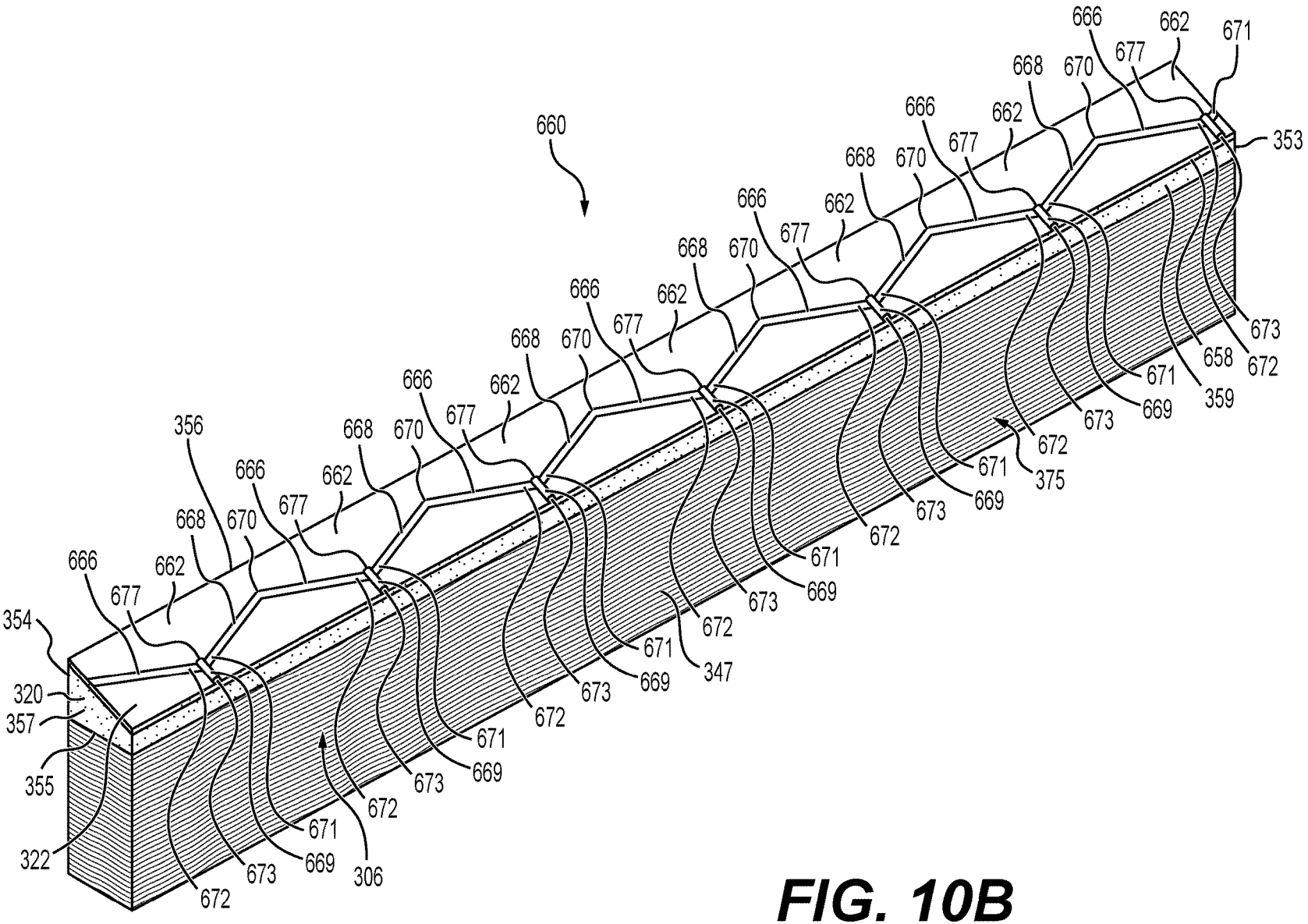
FIG. 10B is a perspective view of still another exterior wall system component subassembly encompassing aspects of the present disclosure.

FIG. 10B illustrates another exterior wall system component subassembly 660 that encompasses aspects of the present disclosure. The exterior wall system component subassembly 660 comprises a plurality of weep tubes 669 each of which is in fluid communication with a channel 662 disposed on the wedge top side 321 of wedge 320. Each channel 662 comprises one or more ribbon apexes 670 that are disposed intermediate between the wedge top rear edge 356 and the wedge top front edge 368. At least of a portion of each weep tube 469 is disposed on the wedge top side 321. As shown in FIG. 10B, each weep tube 669 is aligned with the top end 677 of the weep tube 669 disposed at a channel outlet 664 and a bottom end 673 of each weep tube 669 disposed at the wedge top front edge 358. Both of the first water-resistant ribbon end 672 and the second water-resistant ribbon end 671 of each channel 662 contacts the weep tube 669 aligned therewith, thereby forming a barrier that directs water down the channel 662 to the open top end 677 of the weep tube 669. Water can thereby enter the hollow weep tube 669 through the open top end 677 and travel down the weep tube 669 and out thereof through the open bottom end 673 of the weep tube 669.

The wall system component subassembly 660 comprises a fireblocking base form 306 comprising a fire-resistant material 375 provided in a plurality of lamellar layers to form a lamella 347. On the top side of the fireblocking base form 306 is disposed the wedge 320. The wedge 320 can be disposed directly on the fireblocking base form 306 or have one or more other layers disposed therebetween. The wedge 320 comprises a wedge front side 359 and a wedge rear side 354 spaced apart from and opposing the wedge front side 359. The wedge rear side 354 can be aligned generally parallel to the wedge front side 359. The wedge front side 359 exhibits a wedge front side height, and the wedge rear side 354 exhibits a wedge rear side height. The wedge rear side height is greater than the wedge front side height. A wedge bottom side 355 extends between the wedge front side 359 and the wedge rear side 354. The wedge bottom side 355 can be aligned perpendicular to the wedge front side 359 and/or the wedge rear side 354. The wedge bottom side 355 can be disposed on the top side of the fireblocking base form 306. The wedge 320 also includes a wedge top side 321 that is aligned oblique to the wedge bottom side 355 and is sloped downward from a wedge top rear edge 356 to a wedge top front edge 358. A wedge first side 357 extends between the wedge rear side 354 to the wedge front side 359, and a wedge second side 353 is opposed to the wedge first side 357 and extends between the wedge rear side 354 to the wedge front side 359.

A waterproof membrane 322 is disposed on the wedge top side 321. The waterproof membrane 322 covers the wedge top side 321 and extends between the wedge top rear edge 356 to the wedge top front edge 358 and between the wedge first side 357 to the wedge second side 353. A plurality of channels 662 is aligned on the wedge top side 321. Each channel 662 of the plurality of channels is bounded by the waterproof membrane 322, which forms the floor of each channel 662, a first water-resistant ribbon 666, and a second water-resistant ribbon 668. Each of the first water-resistant ribbon 666 and the second water-resistant ribbon 668 of each channel 662 forms a sidewall of the channel 662. Each first ribbon 666 of each channel 662 extends from a first water-resistant ribbon end 672 disposed intermediate between the wedge top front edge 358 and the wedge top rear edge 356 to a first water-resistant ribbon apex 670 also disposed intermediate between the wedge top rear edge 356 and the wedge top front edge 358. Each second ribbon 668 of each channel 662 extends from a second water-resistant ribbon end 671 disposed intermediate between the wedge top front edge 358 and the wedge top rear edge 356 to a second water-resistant ribbon apex 670 also disposed intermediate between the wedge top rear edge 356 and the wedge top front edge 358. Each first ribbon end 672 of each channel 662 is spaced apart from each second ribbon end 671 of the channel 662, thereby forming a channel outlet 664 therebetween. Each first ribbon 666 of each channel 662 is disposed at an angle to the second water-resistant ribbon 668 of the respective channel 662. The angle of orientation of the first and second ribbons 666 and 668 can be acute, obtuse or a right angle. Accordingly, each first water-resistant ribbon apex 670 of each channel 662 is spaced apart from each second water-resistant ribbon apex 670 of the channel 662. The first and second apexes 670 of each channel 662 are spaced farther apart than the first and second ribbon ends 671 of the channel 662. Each channel 662 has an apex width proximal to the wedge top rear edge 356 and an outlet width proximal to the wedge top front edge 358. The apex width of each channel 662 is greater than the outlet width of the channel 662. Thus, the side walls of each channel 662 are angled toward the channel outlet 664. Water migrating down the sloped surface of the wedge top side 321 is directed by the side walls of the channels 662 to the channel outlets 564 and into the respective weep tube 669.

At least of a portion of each weep tube 669 is disposed on the wedge top side 321. As shown in FIG. 10B, each weep tube 669 is aligned with the top end 677 of the weep tube 669 disposed at a channel outlet 664 and a bottom end 673 of each weep tube 669 disposed at the wedge top front edge 358. Both of the first water-resistant ribbon end 672 and the second water-resistant ribbon end 671 of each channel 662 contacts the weep tube 669 aligned therewith, thereby forming a barrier that directs water down the channel 662 to the top end 677 of the weep tube 669. Water can thereby enter the hollow weep tube 669 through the open top end 677 and travel down the weep tube 669 and out thereof through the open bottom end 673 of the weep tube 669.

Figure 11A:
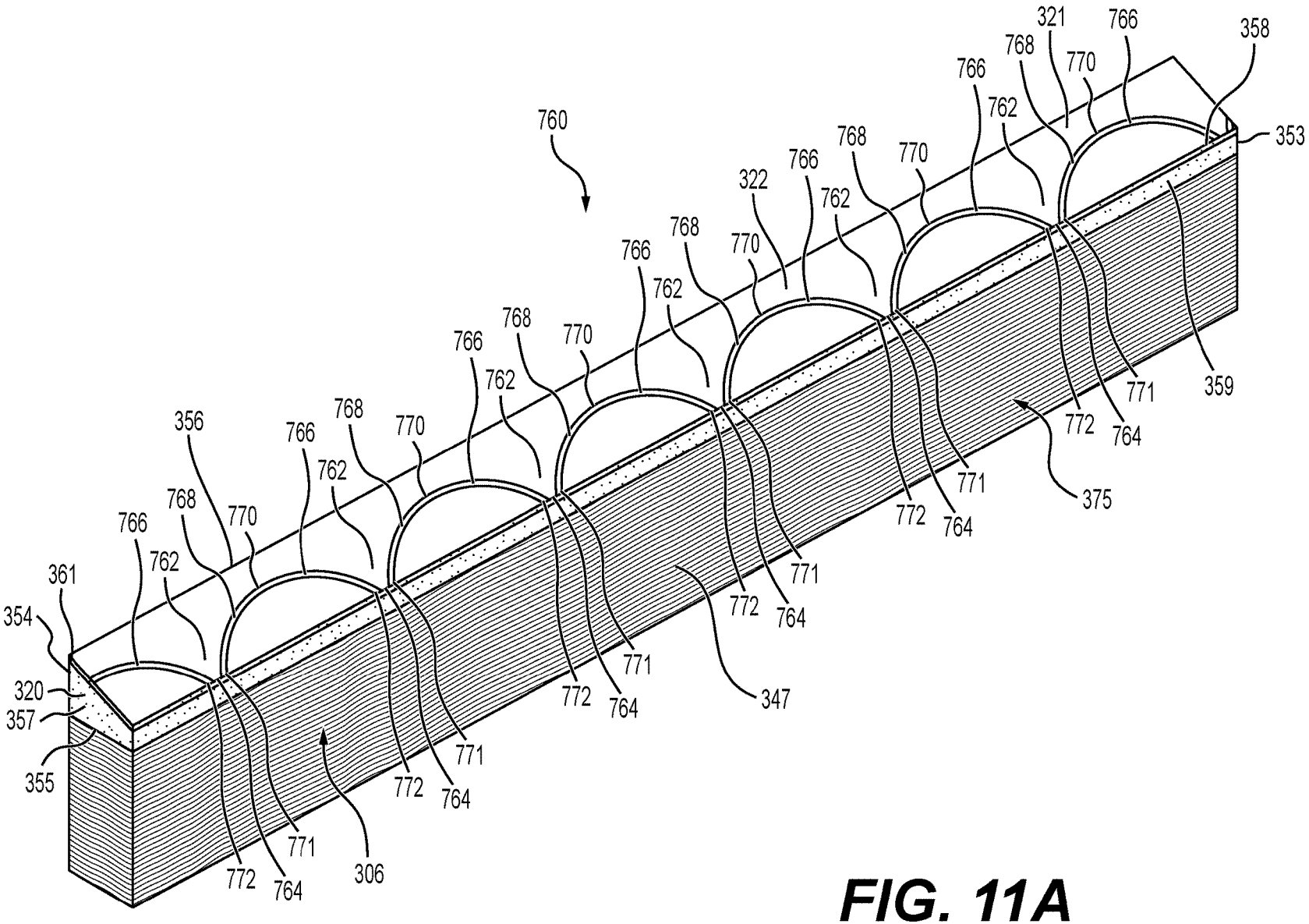
FIG. 11A is a perspective view of another exterior wall system component subassembly encompassing aspects of the present disclosure.

FIG. 11A illustrates yet another an exterior wall system component subassembly 760 that encompasses aspects of the present disclosure. Rather than a water-resistant ribbon apex 770 being disposed at a wedge top rear edge 356, the water-resistant ribbon apexes 770 are disposed intermediate between the wedge top rear edge 356 and the wedge top front edge 358. Additionally, rather than the first water-resistant ribbons 766 and the second water-resistant ribbons 768 of the channels 762 being generally straight, the first water-resistant ribbons 766 and the second water-resistant ribbons 768 are arcuate. The exterior wall system component subassembly 760 comprises a fireblocking base form 306. On the top side of the fireblocking base form 306 is disposed a wedge 320. The wedge 320 comprises a wedge front side 359 and a wedge rear side 354 spaced apart from and opposing the wedge front side 359. The wedge rear side 354 can be aligned generally parallel to the wedge front side 359. The wedge front side 359 exhibits a wedge front side height, and the wedge rear side 354 exhibits a wedge rear side height. The wedge rear side height is greater than the wedge front side height. A wedge bottom side 355 extends between the wedge front side 359 and the wedge rear side 354. The wedge bottom side 355 can be aligned perpendicular to the wedge front side 359 and/or the wedge rear side 354. The wedge bottom side 355 can be disposed on the top side of the fireblocking base form 306. The wedge 320 also includes a wedge top side 321 that is aligned oblique to the wedge bottom side 355 and is sloped downward from a wedge top rear edge 356 to a wedge top front edge 358. A wedge first side 357 extends between the wedge rear side 354 to the wedge front side 359, and a wedge second side 353 is opposed to the wedge first side 357 and extends between the wedge rear side 354 to the wedge front side 359.

A waterproof membrane 322 is disposed on the wedge top side 321. The waterproof membrane 322 covers the wedge top side 321 and extends between the wedge top rear edge 356 to the wedge top front edge 358 and between the wedge first side 357 to the wedge second side 353. A plurality of channels is aligned on the wedge top side 321. Each channel 762 of the plurality of channels is bounded by the waterproof membrane 322, which forms the floor of each channel 762, a first water-resistant ribbon 766, and a second water-resistant ribbon 768. Each of the first water-resistant ribbon 766 and the second water-resistant ribbon 768 of each channel 762 forms a sidewall of the channel 762. Each first ribbon 766 of each channel 762 extends from a first water-resistant ribbon end 772 disposed at the wedge top front edge 358 to a first water-resistant ribbon apex 770 disposed intermediate between the wedge top rear edge 356 and the wedge top front edge 358. Each second ribbon 768 of each channel 762 extends from a second water-resistant ribbon end 771 disposed at the wedge top front edge 358 to a second water-resistant ribbon apex 770 disposed intermediate between the wedge top rear edge 356 and the wedge top front edge 358. Each first ribbon end 772 of each channel 762 is spaced apart from each second ribbon end 771 of the channel 762, thereby forming a channel outlet 764 therebetween. Each first ribbon 766 and each second ribbon end 768 of each channel 762 is arcuate. Each first water-resistant ribbon apex 770 of each channel 762 is spaced apart from each second water-resistant ribbon apex 770 of the channel 762. The first and second apexes 770 of each channel 762 are spaced farther apart than the first and second ribbon ends 772 of the channel 762. Each channel 762 has an apex width proximal to the wedge top rear edge 356 and an outlet width proximal to the wedge top front edge 358. The apex width of each channel 762 is greater than the outlet width of the channel 762. Thus, the side walls of each channel 762 are concave and approach the opposing side wall and curved toward the channel outlet 764. Water migrating down the sloped surface of the wedge top side 321 is directed by the side walls of the channels 762 to the channel outlets 764.

Figure 11B:
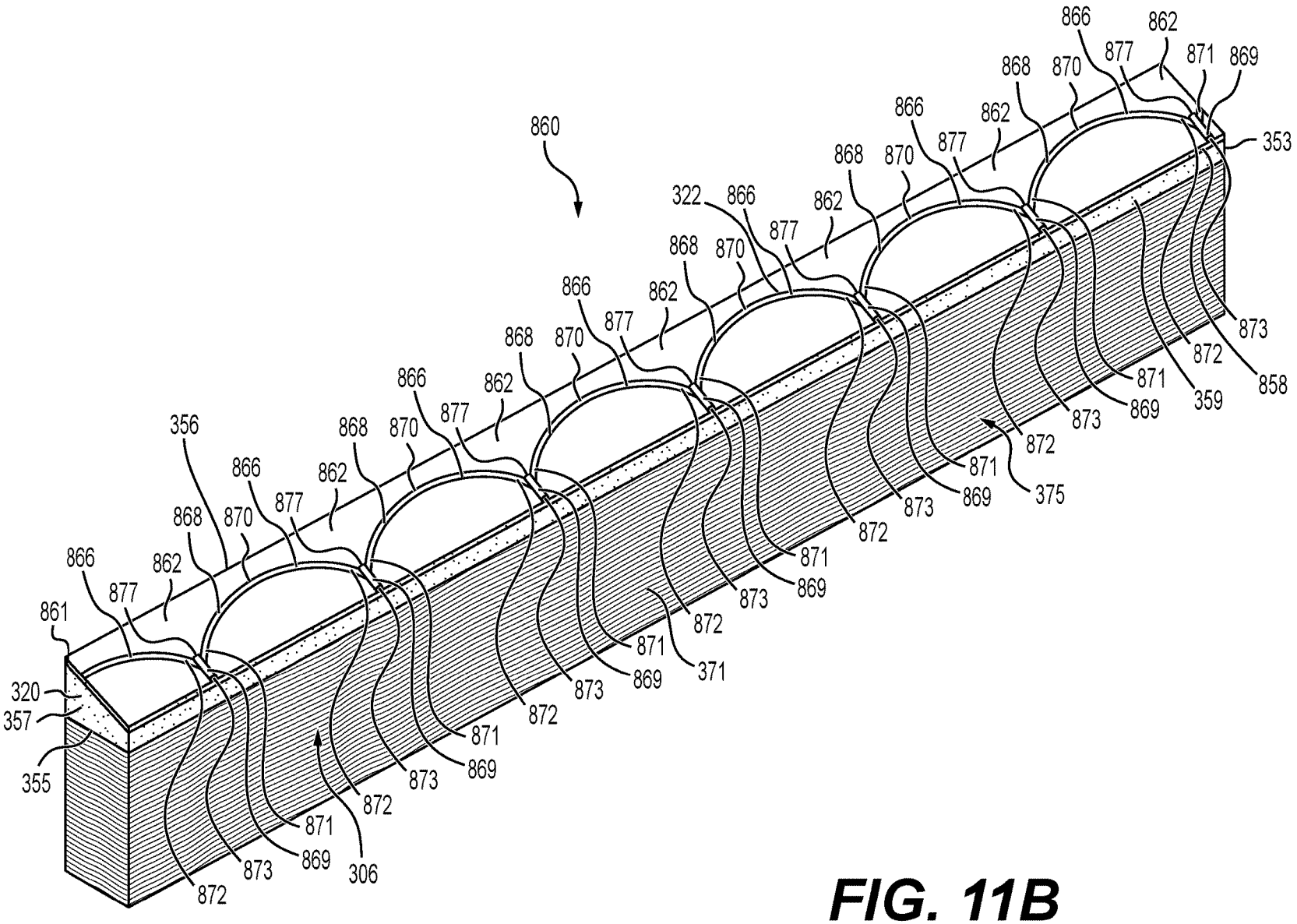
FIG. 11B is a perspective view of yet another exterior wall system component subassembly encompassing aspects of the present disclosure.

FIG. 11B illustrates yet another an exterior wall system component subassembly 860 that encompasses aspects of the present disclosure and includes a plurality of weep tubes 869 each of which is in fluid communication with a channel 862 that comprises a pair of concave side walls that terminate at the open top end 877 of the weep tube 369. The water-resistant ribbon apexes 870 are disposed intermediate between the wedge top rear edge 356 and the wedge top front edge 368. The first water-resistant ribbons 866 and the second water-resistant ribbons 868 are arcuate. The exterior wall system component subassembly 860 comprises a fireblocking base form 306. On the top side of the fireblocking base form 306 is disposed, directly or indirectly, a wedge 320. The wedge 320 comprises a wedge front side 359 and a wedge rear side 354 spaced apart from and opposing the wedge front side 359. The wedge rear side 354 can be aligned generally parallel to the wedge front side 359. The wedge front side 359 exhibits a wedge front side height, and the wedge rear side 354 exhibits a wedge rear side height. The wedge rear side height is greater than the wedge front side height. A wedge bottom side 355 extends between the wedge front side 359 and the wedge rear side 354. The wedge bottom side 355 can be aligned perpendicular to the wedge front side 359 and/or the wedge rear side 354. The wedge bottom side 355 can be disposed on the top side of the fireblocking base form 306. The wedge 320 also includes a wedge top side 321 that is aligned oblique to the wedge bottom side 355 and is sloped downward from a wedge top rear edge 356 to a wedge top front edge 358. A wedge first side 357 extends between the wedge rear side 354 to the wedge front side 359, and a wedge second side 353 is opposed to the wedge first side 357 and extends between the wedge rear side 354 to the wedge front side 359.

A waterproof membrane 322 is disposed on the wedge top side 321. The waterproof membrane 322 covers the wedge top side 321 and extends between the wedge top rear edge 356 to the wedge top front edge 358 and between the wedge first side 357 to the wedge second side 353. A plurality of channels 862 is aligned on the wedge top side 321. Each channel 862 of the plurality of channels is bounded by the waterproof membrane 322, which forms the floor of each channel 862, a first water-resistant ribbon 866, and a second water-resistant ribbon 868. Each of the first water-resistant ribbon 866 and the second water-resistant ribbon 868 of each channel 862 forms a sidewall of the channel 862. Each first ribbon 866 of each channel 862 extends from a first water-resistant ribbon end 872 disposed intermediate between the wedge top front edge 358 and the wedge top rear edge 356 to a first water-resistant ribbon apex 870 also disposed intermediate between the wedge top rear edge 356 and the wedge top front edge 358. Each second ribbon 868 of each channel 862 extends from a second water-resistant ribbon end 871 disposed intermediate between the wedge top rear edge 356 and the wedge top front edge 358 to a second water-resistant ribbon apex 870 disposed intermediate between the wedge top rear edge 356 and the wedge top front edge 358. Each first ribbon end 872 of each channel 862 is spaced apart from each second ribbon end 871 of the channel 862, thereby forming a channel outlet therebetween at the open top end 877 of a weep tube 869. Each first ribbon 866 of each channel 762 is arcuate and opposes the second water-resistant ribbon 868 of the respective channel 862. Accordingly, each first water-resistant ribbon apex 870 of each channel 862 is spaced apart from each second water-resistant ribbon apex 870 of the channel 862. The first and second apexes 870 of each channel 862 are spaced farther apart than the first and second ribbon ends 871 of the channel 862. Each channel 862 has an apex width proximal to the wedge top rear edge 356 and an outlet width proximal to the wedge top front edge 358. The apex width of each channel 862 is greater than the outlet width of the channel 862. Thus, the side walls of each channel 862 are concave and approach the opposing side wall and curved toward the channel outlet 864. Water migrating down the sloped surface of the wedge top side 321 is directed by the side walls of the channels 862 to the channel outlets at the open top ends 877 and into the respective weep tubes 869. The water can travel through the hollow weep tube 869 to the open bottom end 873 and out of the wall assembly.

Figure 12:
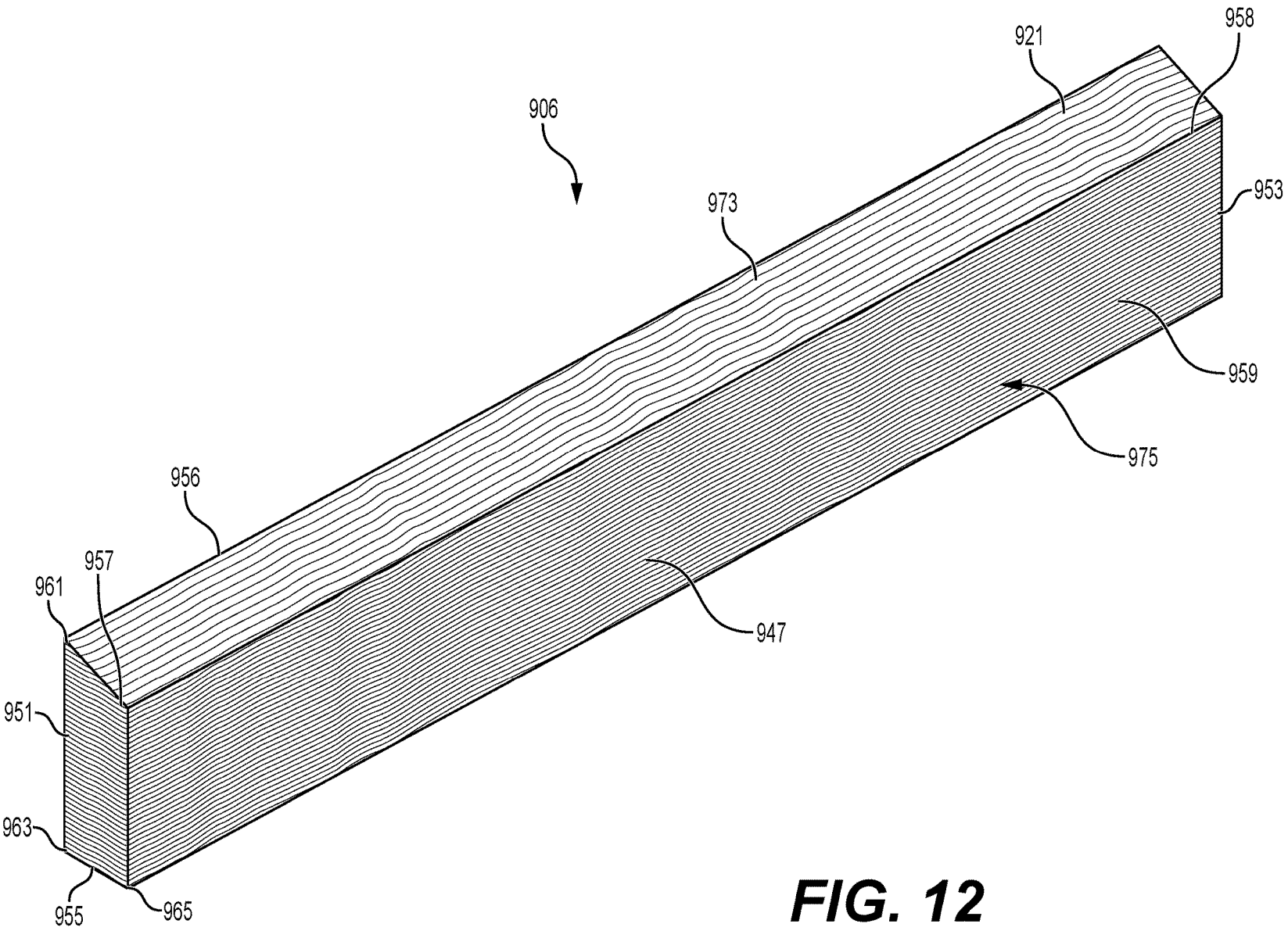
FIG. 12 is a perspective view of a fireblocking base form encompassing aspects of the present disclosure.
Figure 13:
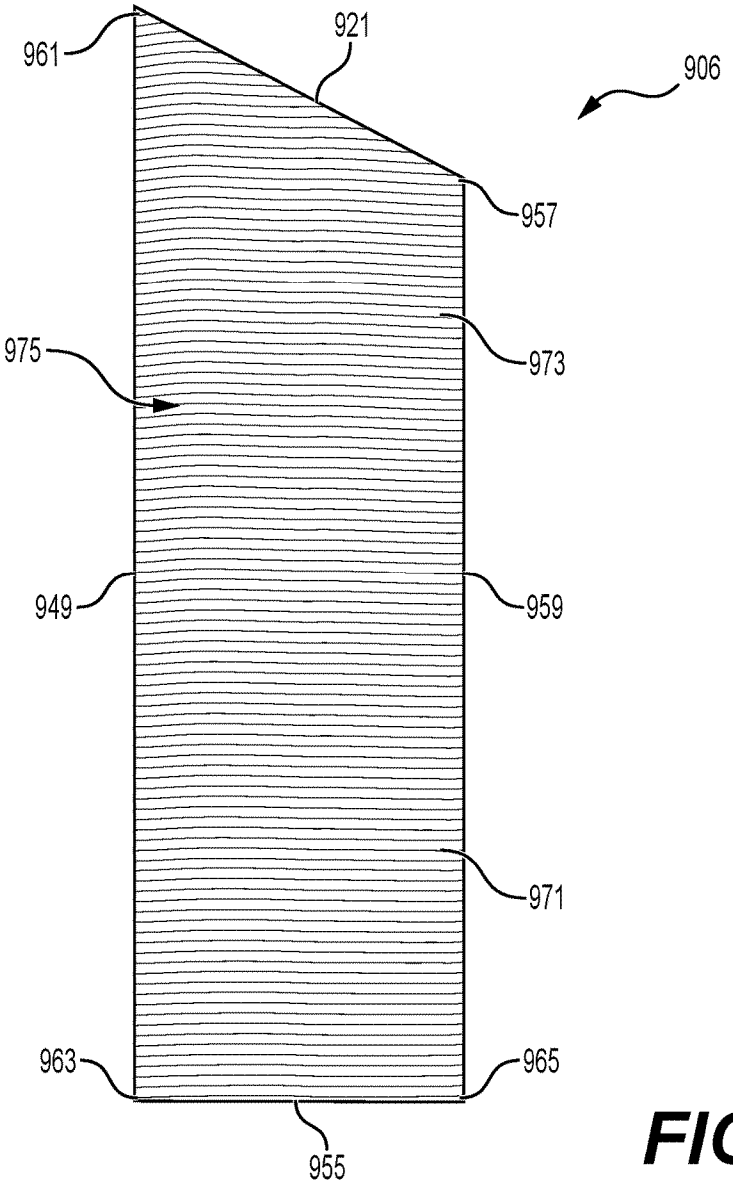
FIG. 13 is a side elevation view of the fireblocking base form shown in FIG. 12.

FIGS. 12 and 13 illustrate a fireblocking base form 906 that encompasses aspects of the present disclosure. The fireblocking base form 906 comprises a front side 959 and a rear side 949 spaced apart from and opposing the front side 959. The rear side 949 can be aligned generally parallel to the front side 959. The front side 959 exhibits a front side height, and the rear side 949 exhibits a rear side height. The rear side height is greater than the front side height. A bottom side 955 extends between the front side 959 and the rear side 949. The bottom side 955 can be aligned perpendicular to the front side 959 and/or the rear side 949. The fireblocking base form 906 also comprises a top side 921 extending between the front side 959 and the rear side 949. The top side 921 is aligned non-parallel to the bottom side 955 and is sloped downward from the rear side 949 to the front side 959. A left side 951 extends between the top side 921, the bottom side 955, the front side 959 and the rear side 949. A right side 953 is disposed opposing the left side 951 and extends between the top side 921, the bottom side 955, the front side 959 and the rear side 949. The left side 951 may be aligned parallel to the right side 953. Any one or more of the top side 921, the bottom side 955, the front side 959, the rear side 949, the left side 951, and the right side 953 may be a generally flat surface.

The rear side 949 and the top side 921 cooperate to form a top rear edge 956. The front side 959 and the top side 921 cooperate to form a top front edge 958. The rear side 949 and the top side 921 intersect at the top rear edge 956 and cooperate to form a rear top angle 961. The front side 959 and the top side 921 intersect at the top front edge 958 and cooperate to form a front top angle 957. The rear top angle 961 is acute and less than 90°. The front top angle 957 is obtuse and greater than 90°. The front side 959 of the fireblocking base form 906 can exhibit a height sufficiently tall enough to meet applicable regulations and/or ordinances on fireblocking minimum heights while also providing the inclined top side 921 that allows for water to move downward there along. Alternatively, the fireblocking base form 906 can be composed of a rectangular fireblocking base form, such as 306, shown in FIG. 11B, and a wedge configured similar to wedge 320, shown in FIG. 11B, with the wedge 320 comprising a fire-resistant material 975.

The fireblocking base form 906 comprises a fire-resistant material 975, such as, for example, mineral wool, rock wool, foamed concrete, cementitious material, or glass matting. Examples of fire-resistant material include THERMAFI- BER® Mineral Wool CI-C SC18 Mineral Wool Insulation from Thermafiber, Inc. of Toledo, Ohio, USA, and the monolithic density version of FRONTROCK™ Stone Wool Insulation from ROCKWOOL® of Milton, Ontario, Canada. The fireblocking base form 906 comprises a lamella 947 of the fire-resistant material 975. The lamella 947 comprises a plurality of lamellar layers 973 stacked upon each other to form the overall lamella 947. The lamellar layers 973 are aligned generally perpendicular or transverse to the front side 959 and generally parallel to the bottom side 955 of the fireblocking base form 906. In one aspect, the fireblocking base form 906 can comprise the fire-resistant material 975. In another aspect, the fireblocking base form 906 can consist essentially of the fire-resistant material 975. In yet another aspect, the fireblocking base form 906 can consist of the fire-resistant material 975. In one aspect, the fireblocking base form 906 can comprise a lamella 947 of fire-resistant material 975. In another aspect, the fireblocking base form 906 can consist essentially of a lamella 947 of fire-resistant material 975. In a further aspect, the fireblocking base form 906 can consist of a lamella 947 of fire-resistant material 975.

Figure 14:
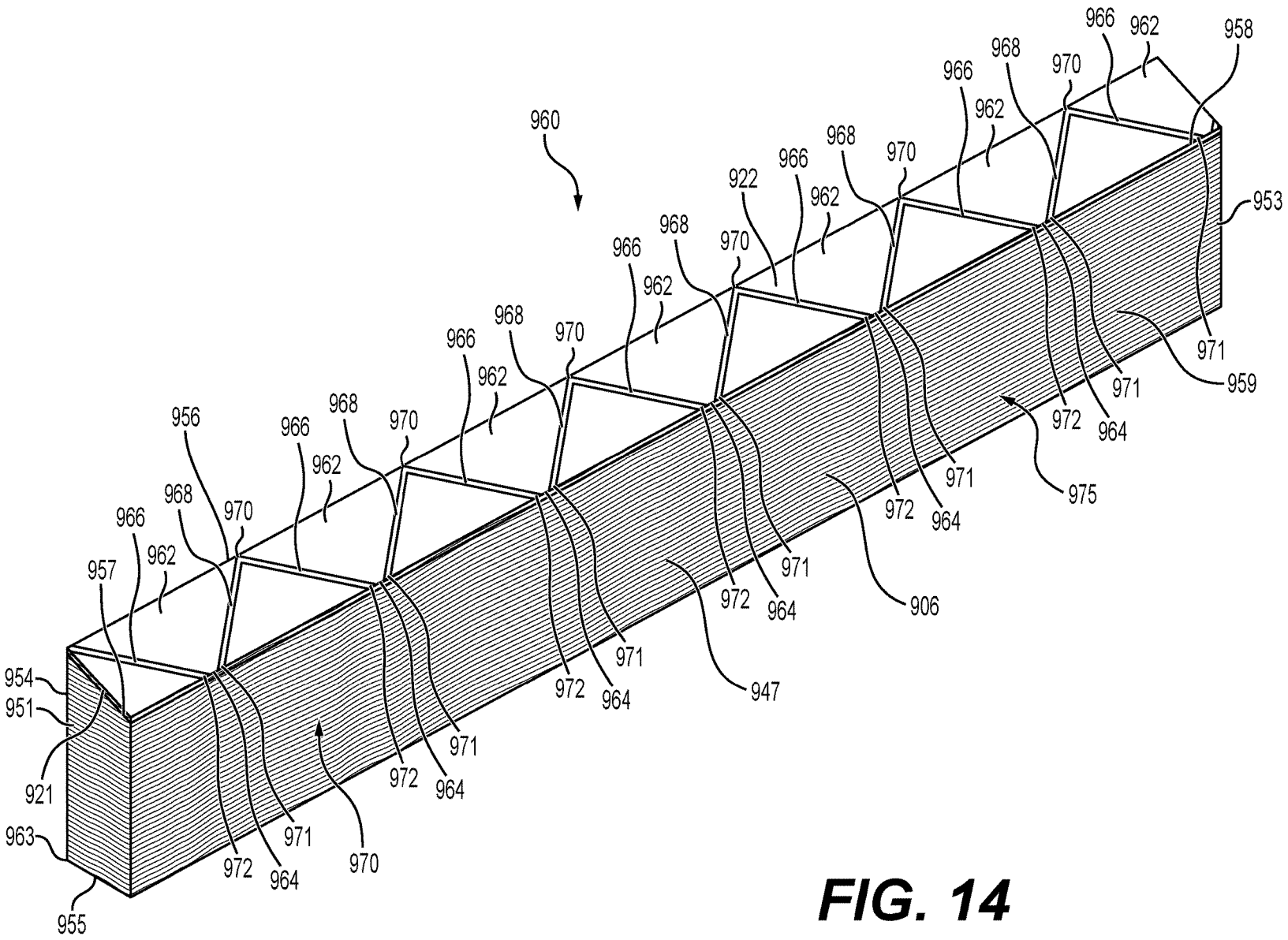
FIG. 14 is a perspective view of still another exterior wall system component subassembly encompassing aspects of the present disclosure.

FIG. 14 illustrates another wall system component subassembly 960 that encompasses aspects of the present disclosure. The exterior wall system component subassembly 960 comprises a fire blocking base form 906. The fireblocking base form 906 comprises a fire-resistant material 975, such as, for example, mineral wool that is provided in a plurality of lamellar layers to form a lamella 947. The lamellar layers of the lamella 947 are aligned generally perpendicular to a front face of an exterior wall system assembly 900. The fireblocking base form 906 is in the shape of a wedge. The fireblocking base form comprises a front side 959 and a rear side 954 spaced apart from and opposing the front side 959. The rear side 954 can be aligned generally parallel to the front side 959. The front side 959 exhibits a wedge front side height, and the rear side 954 exhibits a wedge rear side height. The wedge rear side height is greater than the wedge front side height. A bottom side 955 extends between the front side 959 and the rear side 954. The bottom side 955 can be aligned perpendicular to the front side 959 and/or the rear side 954. The fireblocking base form 906 also includes a top side 921 that is aligned oblique to the bottom side 955 and is sloped downward from a top rear edge 956 to a top front edge 958. A first side 957 extends between the rear side 954 to the front side 959, and a second side 953 is opposed to the first side 957 and extends between the rear side 954 to the wedge front side 959.

A waterproof membrane 922 is disposed on the top side 921. The waterproof membrane 922 covers the top side 921 and extends between the top rear edge 956 to the top front edge 958 and between the first side 957 to the second side 953. A plurality of channels 962 is aligned on the top side 921. Each channel 962 of the plurality of channels is bounded by the waterproof membrane 922, which forms the floor of each channel 962, a first water-resistant ribbon 966, and a second water-resistant ribbon 968. Each of the first water-resistant ribbon 966 and the second water-resistant ribbon 968 of each channel 962 forms a sidewall of the channel 962. Each first ribbon 966 of each channel 962 extends from a first water-resistant ribbon end 972 disposed at the wedge top front edge 958 to a first water-resistant ribbon apex 970 disposed at the wedge top rear edge 956. Each second ribbon 968 of each channel 962 extends from a second water-resistant ribbon end 971 disposed at the wedge top front edge 958 to a second water-resistant ribbon apex 970 disposed at the wedge top rear edge 956. Each first ribbon end 972 of each channel 962 is spaced apart from each second ribbon end 971 of the channel 962, thereby forming a channel outlet 964 therebetween. Each first ribbon 966 of each channel 962 is disposed at an angle and oblique to the second water-resistant ribbon 968 of the respective channel 962. Accordingly, each first water-resistant ribbon apex 970 of each channel 962 is spaced apart from each second water-resistant ribbon apex 970 of the channel 962. The first and second apexes 970 of each channel 962 are spaced farther apart than the first and second ribbon ends 972 of the channel 962. Each channel 962 has an apex width proximal to the wedge top rear edge 956 and an outlet width proximal to the wedge top front edge 958. The apex width of each channel 962 is greater than the outlet width of the channel 962. Thus, the side walls of each channel 962 are angled toward the channel outlet 964. Water migrating down the sloped surface of the wedge top side 921 is directed by the side walls of the channels 962 to the channel outlets 964.

Figure 15:
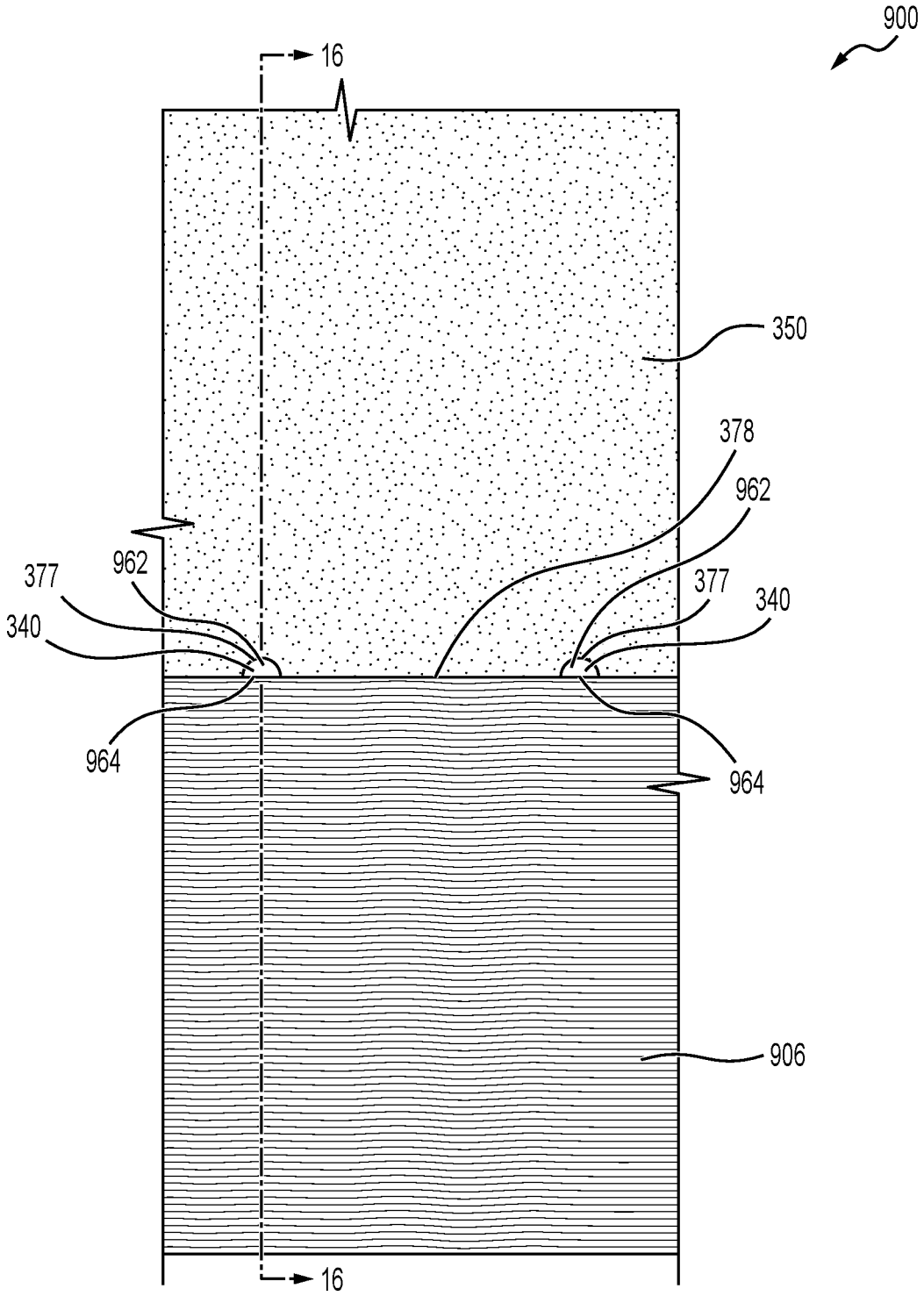
FIG. 15 is a front elevation view of a portion of another exterior wall system assembly and which includes the exterior wall system component subassembly shown in FIG. 14.

FIG. 15 illustrates a portion of an exterior wall system assembly 900. The fireblocking base form 906 is disposed directly below an insulation layer 350. The insulation layer 350 has a plurality of weep holes 340 formed therein. Each weep hole 340 is open to the front face of the exterior wall system assembly 900 and in fluid communication with a channel outlet 964 and a channel 962. Each weep hole 340 is defined by an arcuate channel 377 formed in the bottom side 378 of the insulation layer 350.

Figure 16:
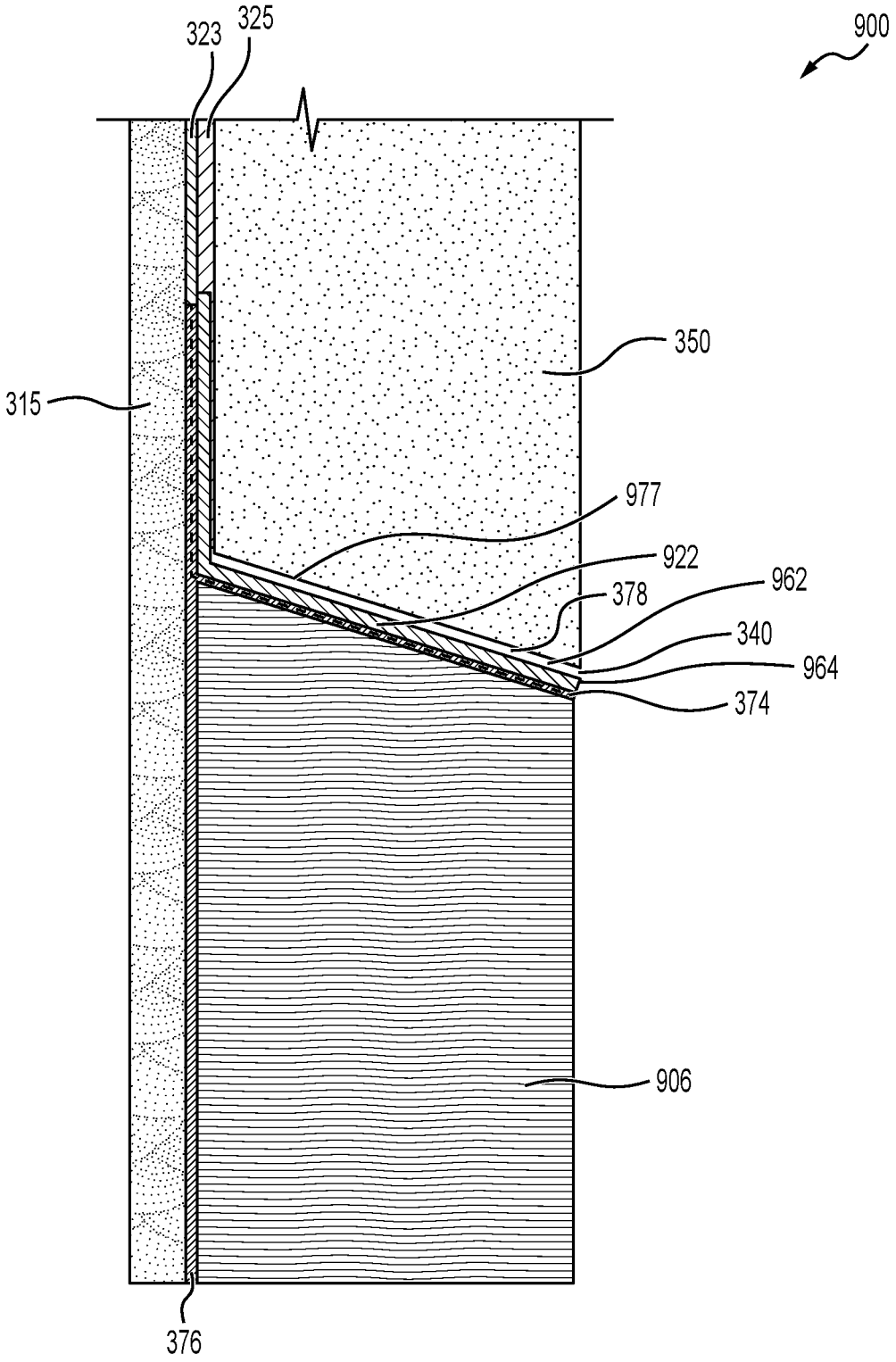
FIG. 16 is a cross-sectional view of a portion of the exterior wall system assembly shown in FIG. 15 taken along line 16-16.

FIG. 16 illustrates a cross-section of a portion of the exterior wall system assembly 900 shown in FIG. 15. The other components of the exterior wall system assembly 900 are directly or indirectly mounted to a substrate 315. The fireblocking base form 906 is connected to the substrate 315 by an adhesive and base coat layer 376. A portion of a mesh layer 374 is disposed on the wedge top side 321 and another portion of the mesh layer 374 extends vertically above along the substrate 315. The mesh layer 374 extends from the wedge top front edge 958 to the wedge top rear edge 956 and upward therefrom along a portion of the substrate 315. The mesh layer 374 can be adhered to the fireblocking base form 906 and/or the substrate 315 by the adhesive and base coat layer 376. The waterproof membrane 922 is disposed on the wedge top side 921 with the mesh layer 374 disposed between the wedge top side 921 and the waterproof membrane 922. The waterproof membrane 922 extends upward from the fireblocking base form 906 and covers a portion of the substrate 315. The waterproof membrane 922 can cover the entirety of the wedge top side 921 extending from the wedge top front edge 458 to the wedge top rear edge 956. The waterproof membrane 922 can be adhered to the fireblocking base form 906 and/or substrate 315 by the adhesive and base coat layer 376. Alternatively, the mesh layer 374 can be adhered to the wedge 920 and/or substrate 315 by a liquid polymer coating. In another aspect, the waterproof membrane 922 can be a self-adhering membrane tape adhered to the wedge top side 921 and/or the substrate 315.

The insulation layer 350 is aligned above the fireblocking base form 406 in the exterior wall system assembly 900. A water-resistant layer 323 is applied to the substrate 315, and vertical ribbons of an adhesive layer 325 are disposed on the water-resistant layer 323. The insulation layer 350 is mounted to the substrate 315 by adherence provided by the vertical ribbons of the adhesive layer 325. The bottom side 378 is cut at an angle so that the front bottom edge of the insulation layer 350 is lower than the rear bottom edge of thereof. The angle of the bottom side 378 of the adhesive layer is generally equal to the angle of the wedge top side 921. An arcuate channel 377 is formed in the bottom side 378 and extends from the rear bottom edge to the front bottom edge of the insulation layer 350. The arcuate channel 377 is aligned with the channel outlet 964 of the channel 962 with which the arcuate channel 377 cooperates. The weep hole 340 is the front end of the arcuate channel 377. The arcuate channel 377 provides a portion of a ceiling for the channel 962 for water migrating through a channel 962 to the front face of the exterior wall system assembly 900.

Figure 17:
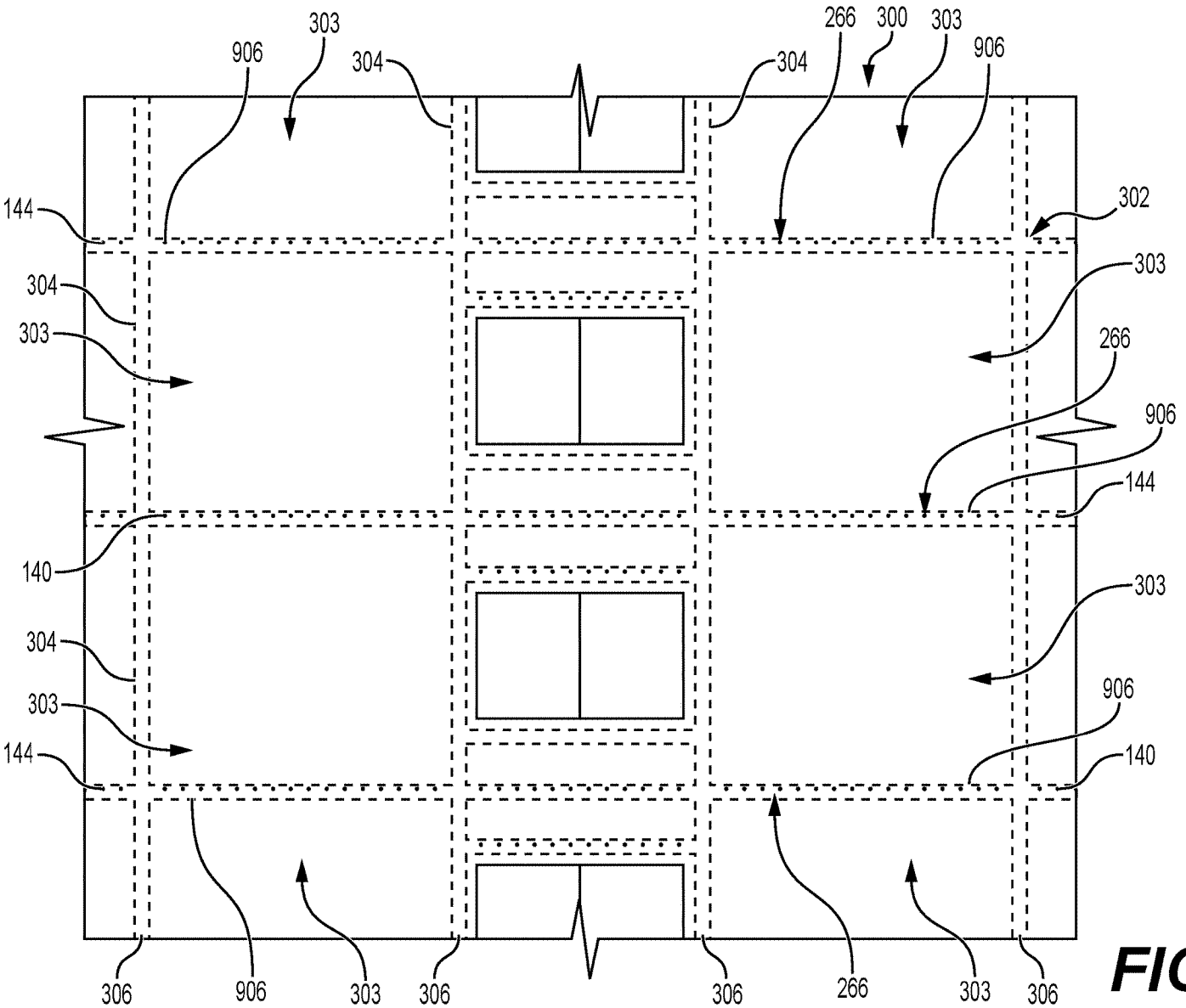
FIG. 17 is a front elevation view of another exterior wall system assembly encompassing aspects of the present disclosure.

FIG. 17 illustrates an exterior wall system assembly 300 encompassing aspects of the present disclosure. FIG. 3 illustrates a portion of a wall of a multi-story building with a column of windows disposed therein with one window per floor of the multi-story building. The exterior wall system assembly 300 comprises a plurality of concealed spaces each of which is bounded by the columns and rows of a fireblocking framework 302. The concealed spaces of the exterior wall system assembly 300 are disposed in a bounded area 303 that is bounded by at least one fireblocking base form 906 and at least one fireblocking vertical form 304. In one aspect, a bounded area 303 can be bounded by two fireblocking rows 266 of fireblocking base forms 906 and two fireblocking columns 306 of fireblocking vertical forms 304 that intersect the two fireblocking rows 266. The fireblocking framework 302 comprises a plurality of fireblocking columns 306 that extend upward along the height of the multi-story building and a plurality of fireblocking rows 266 of fireblocking base forms 906 extending along the width of the multi-story building and aligned along the floor slab or base of each story. Each of the plurality of fireblocking rows 266 of fireblocking base forms 906 intersect the plurality of fireblocking columns 306. Each fireblocking column 306 comprises one or more fireblocking vertical forms 304 aligned end-to-end within the exterior wall system assembly 300. Each fireblocking vertical form 304 comprises a lamella 271 of lamellar layers 273 aligned generally perpendicular or transverse to the outer face of the exterior wall system assembly 300. The exterior wall system assembly 300 also comprises one or more weep hole rows 144, each of which comprises a plurality of weep holes 140. The weep hole rows 144 are aligned proximal to the fireblocking base forms 906. More particularly, each weep hole 140 is aligned proximal to the top front edge 258 of a fireblocking base form 906. Each fireblocking base form 906 can abut at least one fireblocking vertical form 304 on the left side 251 and/or the right side 253 of the fireblocking base form 906. Likewise, each fireblocking vertical form 304 can abut at least one fireblocking base form 906 on the left side and/or the right side of the fireblocking vertical form 304. The fire-resistant material 275 of each fireblocking vertical form 304 contacts the fire-resistant material 275 of each adjacently aligned fireblocking base form 906 and each adjacently aligned fireblocking vertical form 304 contacting the respective fireblocking vertical form 304, thereby forming the fireblocking framework 302 that forms a continuous multi-layer fire-resistant barrier between and throughout each story of the multi-story building.

In one aspect, each fireblocking row 266 of fireblocking base forms 906 can be aligned a distance in a range of about 2.438 m to about 6.096 m from the nearest adjacent fireblocking row 266 of fireblocking base forms 906 above and/or below. In another aspect, each fireblocking row 266 of fireblocking base forms 906 can be aligned a distance in a range of about 3 m to about 6 m from the nearest adjacent fireblocking rows 266 of fireblocking base forms 906 above and/or below. In a further aspect, each fireblocking row 266 of fireblocking base forms 906 can be aligned a distance of less than or equal to about 6 m from the nearest adjacent fireblocking rows 266 of fireblocking base forms 906 above or below. In yet another aspect, each fireblocking column 306 can be aligned a distance in a range of about 2.438 m to about 6.096 m from the nearest adjacent fireblocking columns 306 to the left and/or right. In another aspect, each fireblocking column 306 can be aligned a distance in a range of about 3 m to about 6 m from the nearest adjacent fireblocking columns 306 to the left and/or right. In a further aspect, each fireblocking column 306 can be aligned a distance of less than or equal to about 6 m from the nearest adjacent fireblocking columns 306 to the left and/or right. In still a further aspect, the exterior wall system assembly 300 can comprise one or more concealed spaces each with an area bounded by one or more fireblocking columns 306 and one or more fireblocking base forms 906 of less than about 9.3 $m^2$. In another aspect, the exterior wall system assembly 300 can comprise one or more concealed spaces each which is disposed within an area 303 bounded by one or more fireblocking columns 306 and one or more fireblocking base forms 906 in a range of about 4 $m^2$ to about 9 $m^2$.

Figure 18:
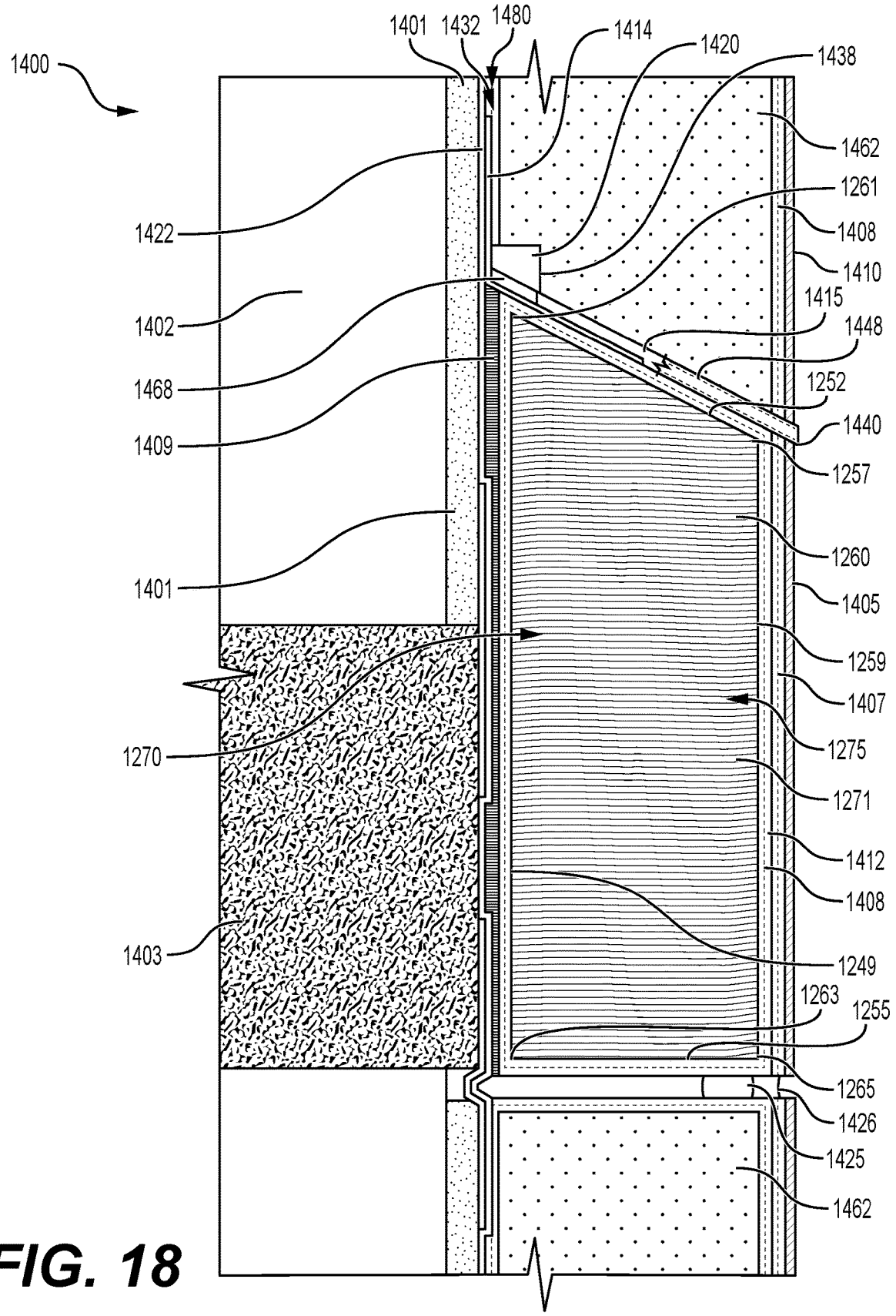
FIG. 18 is a cross-sectional view of a portion of the exterior wall system assembly shown in FIG. 17.
Figure 19:
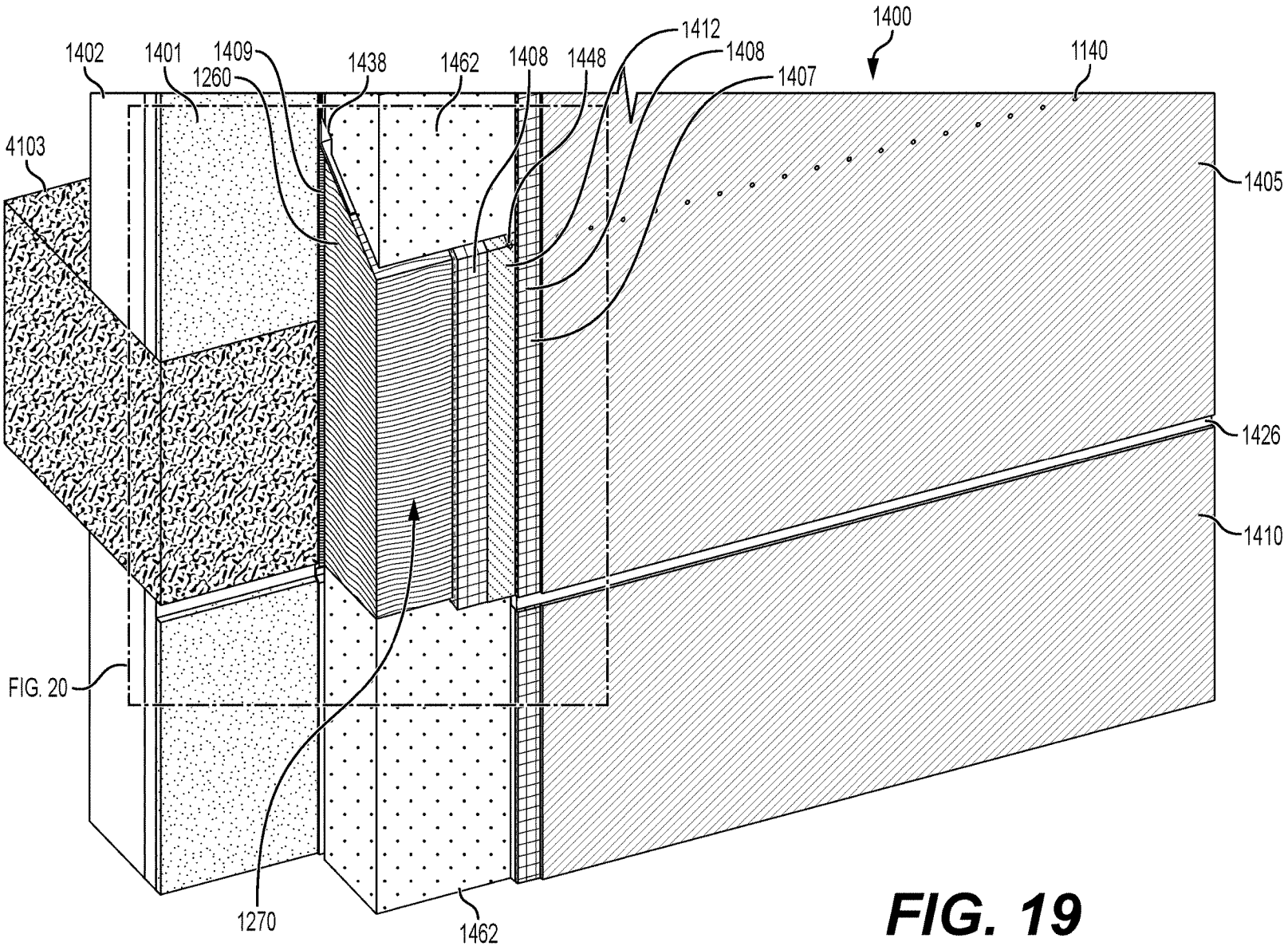
FIG. 19 is a perspective sectional view of the exterior wall system assembly shown in FIG. 18.
Figure 20:
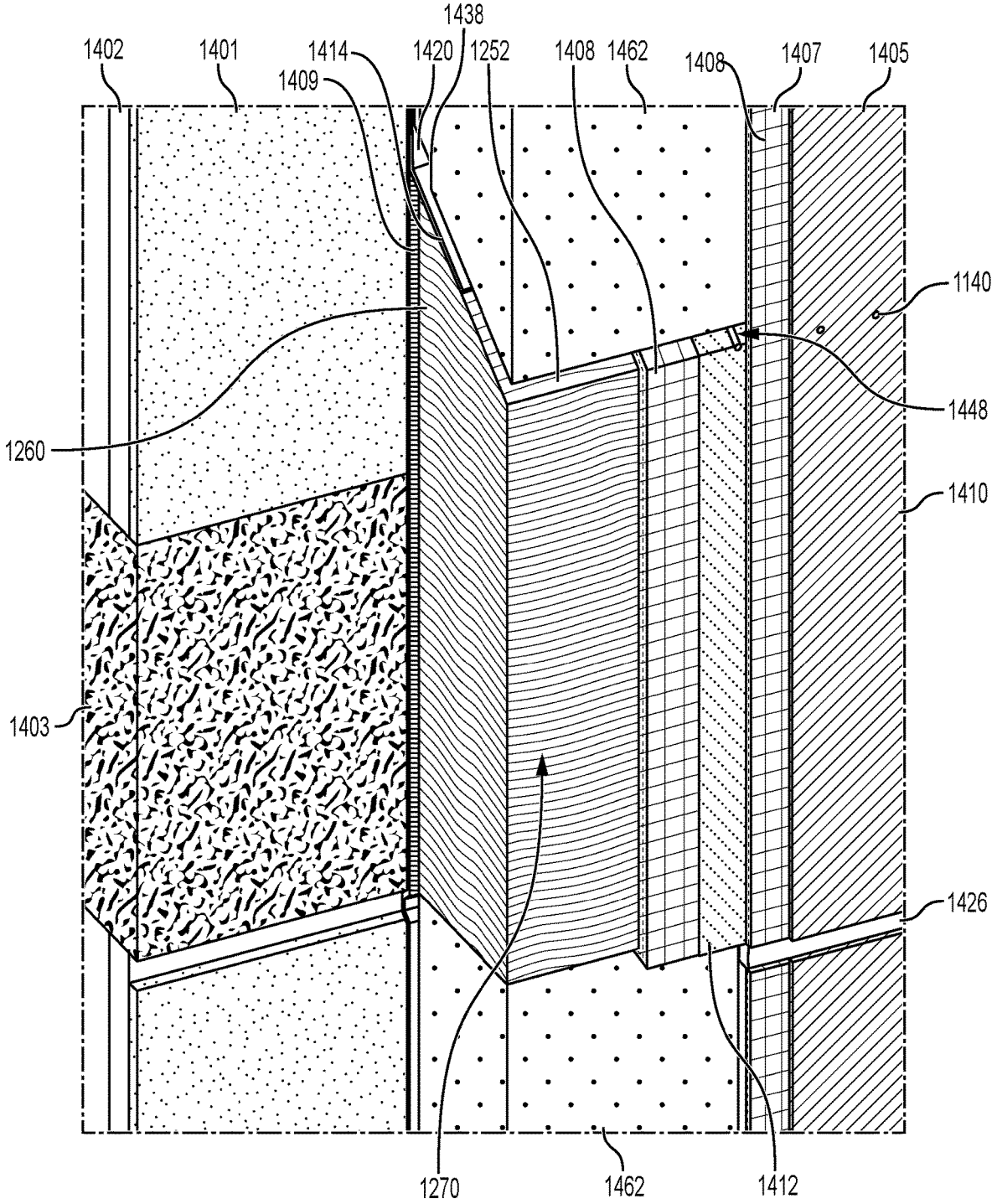
FIG. 20 is another perspective sectional view of a portion of the exterior wall system assembly shown in FIG. 18.

FIGS. 18-20 illustrate a portion of an exterior wall system assembly 1400 encompassing aspects of the present disclosure. The exterior wall system assembly 1400 includes a floor slab 1403 on which is mounted a wall support frame 1402. The remainder of the exterior wall system assembly 1400 is mounted to and supported by the combination of the floor slab 1403 and wall support frame 1402. To the wall support frame 1402 is mounted a sheathing layer 1401. The sheathing layer 1401 can be formed of a glass mat-faced gypsum core. The exterior wall system assembly 1400 also comprises a fireblocking base form 1260 mounted adjacent the floor slab 1403. The fireblocking base form 1260 has a body 1270 comprising a front side 1259 and a rear side 1249 spaced apart from, opposing and aligned generally parallel to the front side 1259. The front side 1259 exhibits a front side height, and the rear side 1249 exhibits a rear side height, with the rear side height being greater than the front side height. A bottom side 1255 extends between the front side 1259 and the rear side 1249 and is aligned generally perpendicular to the front side 1259 and/or the rear side 1249. The fireblocking base form 1260 also comprises a top side 1252 extending between the front side 1259 and the rear side 1249. The top side 1252 is aligned non-parallel to the bottom side 1255. The rear side 1249 and the top side 1252 intersect to form a rear top angle 1261. The front side 1259 and the top side 1252 intersect to form a front top angle 1257. The rear top angle 1261 is acute and the front top angle 1257 is obtuse. The rear side 1249 and the bottom side 1255 intersect to form a rear bottom angle 1263, and the front side 1259 and the bottom side 1255 intersect to form a front bottom angle 1265. Both the rear bottom angle 1263 and the front bottom angle 1265 are generally right angles. The fireblocking base form 1260 of the exterior wall system assembly 1400 comprises a fire-resistant material 1275, such as, for example, mineral wool that is provided in a plurality of lamellar layers to form a lamella 1271. The lamellar layers of the lamella 1271 are aligned generally perpendicular to an outer face 1410 of the exterior wall system assembly 1400.

The fireblocking base form 1260 is aligned adjacent to the floor slab 1403 of the building on which the exterior wall system assembly 1400 is mounted. The fireblocking base form 1260 can be aligned within the wall assembly such that the top side 1252 is disposed anterior to the top of the floor slab 1403. A water-resistant coating layer 1412 is disposed on the fireblocking base form 1260. The water-resistant coating layer 1412 covers the front side 1259, the top side 1252, the bottom side 1255, and the rear side 1249 of the fireblocking base form 1260 and acts as a waterproof membrane that can serve as either the floor or a subfloor, with a waterproof conformable membrane 1414 disposed thereon and acting as the floor, of a plurality of channels disposed on the tops side 1252. Each of the plurality of channels disposed on the top side 1252 are formed by a plurality of ribbons, such as second ribbon 1468, that form the sidewalls of each channel. Each channel of the plurality of channels is in fluid communication with the trough 1438 and concealed spaces 1480 vertically aligned within the wall assembly 1400. Each channel of the plurality of channels has an outlet disposed at the open top end of a weep tube 1448, a portion of which is disposed on the top side 1252 of the fireblocking base form 1260. Each weep tube 1448 is hollow and open at a bottom end 1440 thereof, which is in fluid communication with the outer face 1410 of the wall assembly 1400.

In one aspect, the water-resistant coating layer 1412 can cover the left side 1251 and/or the right side 1253 of the fireblocking base form 1260. In another aspect, the left side 1251 and/or the right side 1253 of the fireblocking base form 1260 are uncovered by a water-resistant coating layer 1412. A first mesh layer 1408 is disposed on the fireblocking base form 1260. The first mesh layer 1408 can be embedded in the water-resistant coating layer 1412 and cover the front side 1259, the top side 1252, the rear side 1249, and the bottom side 1255 of the fireblocking base form 1260. In one aspect, the first mesh layer 1408 can cover the left side 1251 and/or the right side 1253 of the fireblocking base form 1260. In another aspect, the left side 1251 and/or the right side 1253 of the fireblocking base form 1260 are uncovered by a first mesh layer 1408. The fireblocking base form 1260 can function as a barrier to the propagation of fire and hot gasses through the air cavities and/or other internal void spaces of the exterior wall system assembly 1400 from one story to another.

The exterior wall system assembly 1400 also includes insulation layers 1462 disposed above and below the fireblocking base form 1260. The insulation layers 1462 can be formed of any appropriate material, such as expanded polystyrene (EPS), extruded polystyrene (XPS), graphite polystyrene (GPS), rock wool, and/or mineral wool or another material having insulative properties and other desired performance characteristics. The insulation layer 1462 is mounted to the sheathing layer 1401 by an adhesive layer 1432. The adhesive layer 1432 can be provided in a plurality of vertical strips on the air and water-resistant barrier layer 1422. One or more concealed spaces 1480 can be formed by the cooperation of the adhesive layer 1432, the air and water-resistant barrier layer 1422 and the insulation layer 1462. These concealed spaces 1480 potentially could serve as a route through which fire could propagate vertically and/or horizontally through the exterior wall system assembly 1400. The insulation layer 1462 mounted above the fireblocking base form 1260 includes a beveled bottom side that is aligned generally parallel to the top side 1252 of the fireblocking base form 1260. The beveled bottom side of the upper insulation layer 1462 is spaced apart from the top side 1252 of the fireblocking base form 1260. The upper insulation layer 1462 also includes a trough 1438 disposed along the rear bottom portion of the upper insulation layer between the beveled bottom side and the rear face of the upper insulation layer 1462. The trough 1438 is aligned generally above the rear upper portion of the top side 1252 and the top rear edge 1256 of the fireblocking base form 1260. Both the beveled bottom side and the trough 1438 can extend the entire width of the upper insulation layer 1462. The trough 1438 can serve as a collection area for water or moisture that drains down the internal surfaces of the exterior wall system assembly 1400.

An air and water-resistant barrier layer 1422 is disposed on the sheathing layer 1401 and the floor slab 1403. The air and water-resistant barrier layer 1422 is disposed between the insulation layer 1462 and the sheathing layer 1401. Also, the air and water-resistant barrier layer 1422 is disposed between the fireblocking base form 1260 and both the sheathing layer 1401 and the floor slab 1403. The fireblocking base form 1260 is mounted to air and water-resistant barrier layer 1422 by a waterproof adhesive 1409. The fireblocking base form 1260 can be installed by applying a full bed of water-resistant adhesive 1409 to the back side 1249. The fireblocking base form 1260 can then be placed at the designated location on the wall surface using firm, uniform pressure by hand or with a straight edge across the entire surface of the fireblocking base form 1260 to force the water-resistant adhesive 1409 into intimate contact with the substrate, such that no void space is left between the back of the fireblocking base form 1260 and the substrate to which it has been applied.

A waterproof conformable membrane 1414 is disposed on the air and water-resistant barrier layer 1422 and angled down to cover at least a portion of the top side 1252 of the fireblocking base form 1260. The waterproof conformable membrane 1414 is separated from direct contact with the top side 1252 of the fireblocking base form 1260 by the water-resistant coating layer 1412 and the first mesh layer 1408. The waterproof conformable membrane 1414 can cooperate with the air and water-resistant layer 1422 and the waterproof coating layer 1412 to form a waterproof barrier through which water and moisture cannot penetrate and a pathway by which water and moisture that accumulates in the void space within the exterior wall system assembly 1400 can be directed from the interior of the exterior wall system assembly 1400 down and along the top side 1252 of the fireblocking base form 1260.

The exterior wall system assembly 1400 also comprises an outer finish layer 1405 mounted at the outer face 1410. The outer finish layer 1405 covers a majority of the outer face 1410 of the exterior wall system assembly 1400. The outer finish layer 1405 is disposed on a base coat layer 1407. A second mesh layer 1408 is embedded in the base coat layer 1407. The outer finish layer 1405, the base coat layer 1407 and the second mesh layer 1408 are mounted on both the insulation layers 1462 and the fireblocking base form 1260. A backer rod 1425 is disposed below the fireblocking base form 1260 and above a lower insulation layer 1462. A sealant layer 1426 is disposed between the backer rod 1425 and the outer face 1410 of the exterior wall system assembly 1410. The finish layer 1405 can be selected from stucco, opaque glass, fiber cement, resin cast brick veneer, resin cast stone veneer, resin cast tile veneer, terracotta, decorative laminate, thin masonry brick veneer, thin masonry stone veneer, or thin masonry tile veneer.

A plurality of weep tubes 1448 is aligned on the top side 1252 of the fireblocking base form 1260. A plurality of channels is also formed on the fireblocking base form 1260. The plurality of channels can be configured according to any configuration as shown in FIG. 7B, 10B or 11B. Each weep tube 1448 is hollow and open at both ends thereof. The top end of each weep tube 1448 is disposed in fluid communication with a channel outlet of a channel formed on the top side 1252 of the fireblocking base form. As shown in FIG. 18, the second water-resistant ribbon 1468 of the channel extends from the top rear edge of the fireblocking base form 1260 and ends adjacent the top end of the weep tube 1448. Each weep tube 1448 is aligned with a first end aligned proximal to the wall support frame 1402 and distal to the outer face 1410 of the exterior wall system assembly 1400, and a second end aligned proximal to the outer face 1410 and distal to the wall support frame 1402. The second end is open to the outer face 1410 and extends to and/or through a weep hole 1440 formed in the finish layer 1405. Each weep tube 1448 is configured to receive water that has collected on and drained down the air and water-resistant layer 1422 and the waterproof conformable membrane 1420 in the first end thereof through which the water drains downward to the second end of the weep tube 1448 and out of the exterior wall system assembly 1400 through the weep hole 1440 in the finish layer 1405. While the weep tubes 1448 are illustrated in the figures as being cylindrical with openings at either end thereof, the present disclosure also encompasses tubes that are semi-cylindrical open on the top side thereof along the length of the weep tube as well as open at either end thereof. Furthermore, the present disclosure also encompasses tubes that exhibit different cross-sectional shapes, such as rectangular. Additionally, the present disclosure encompasses channels that are formed through one or more layers of the wall assembly components. These channels can serve as conduits through which moisture and air can migrate, but that do not constitute separate structures, such as tubes.

Figure 21:
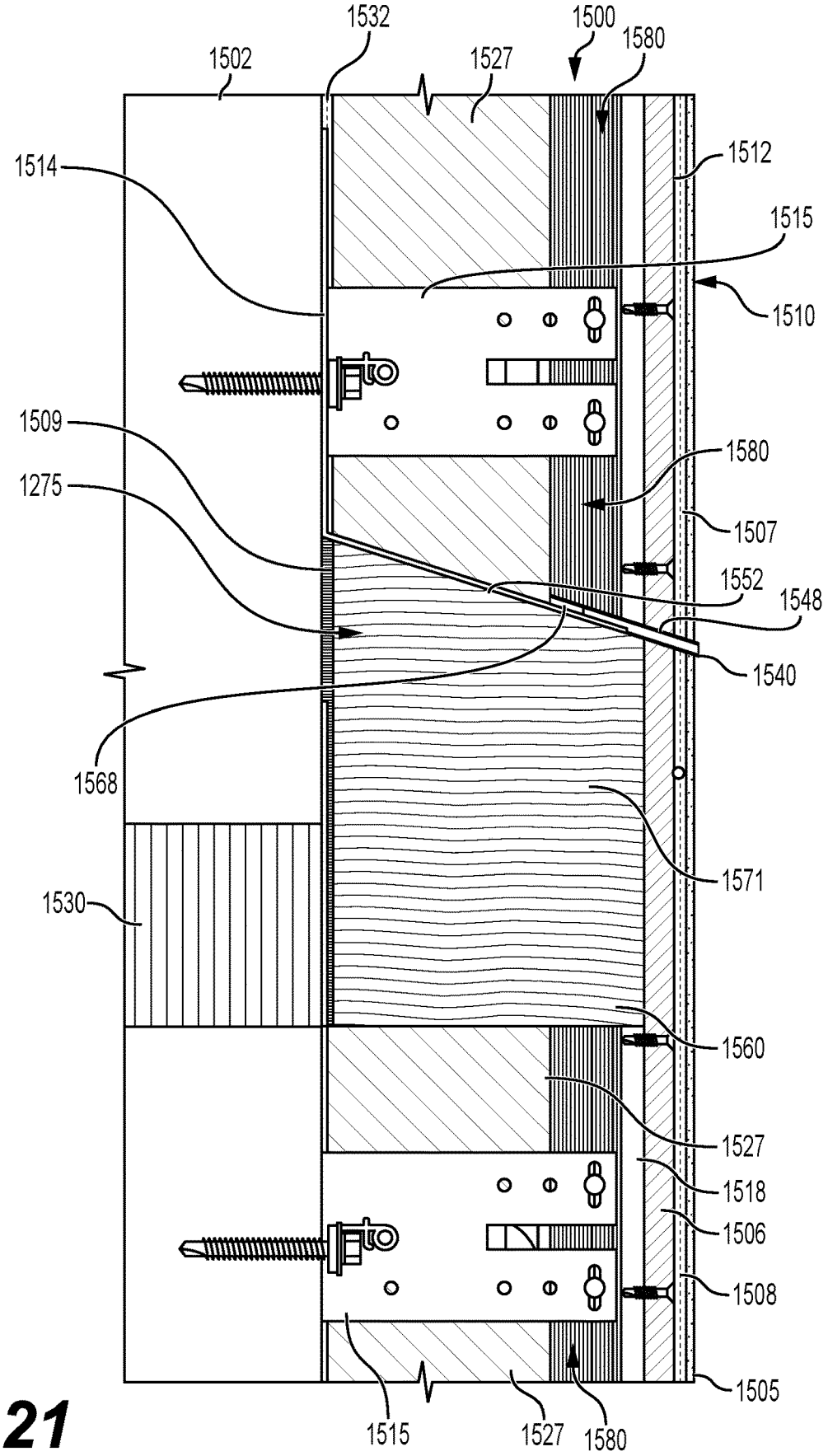
FIG. 21 is a cross-sectional view of a portion of another exterior wall system assembly encompassing aspects of the present disclosure.
Figure 22:
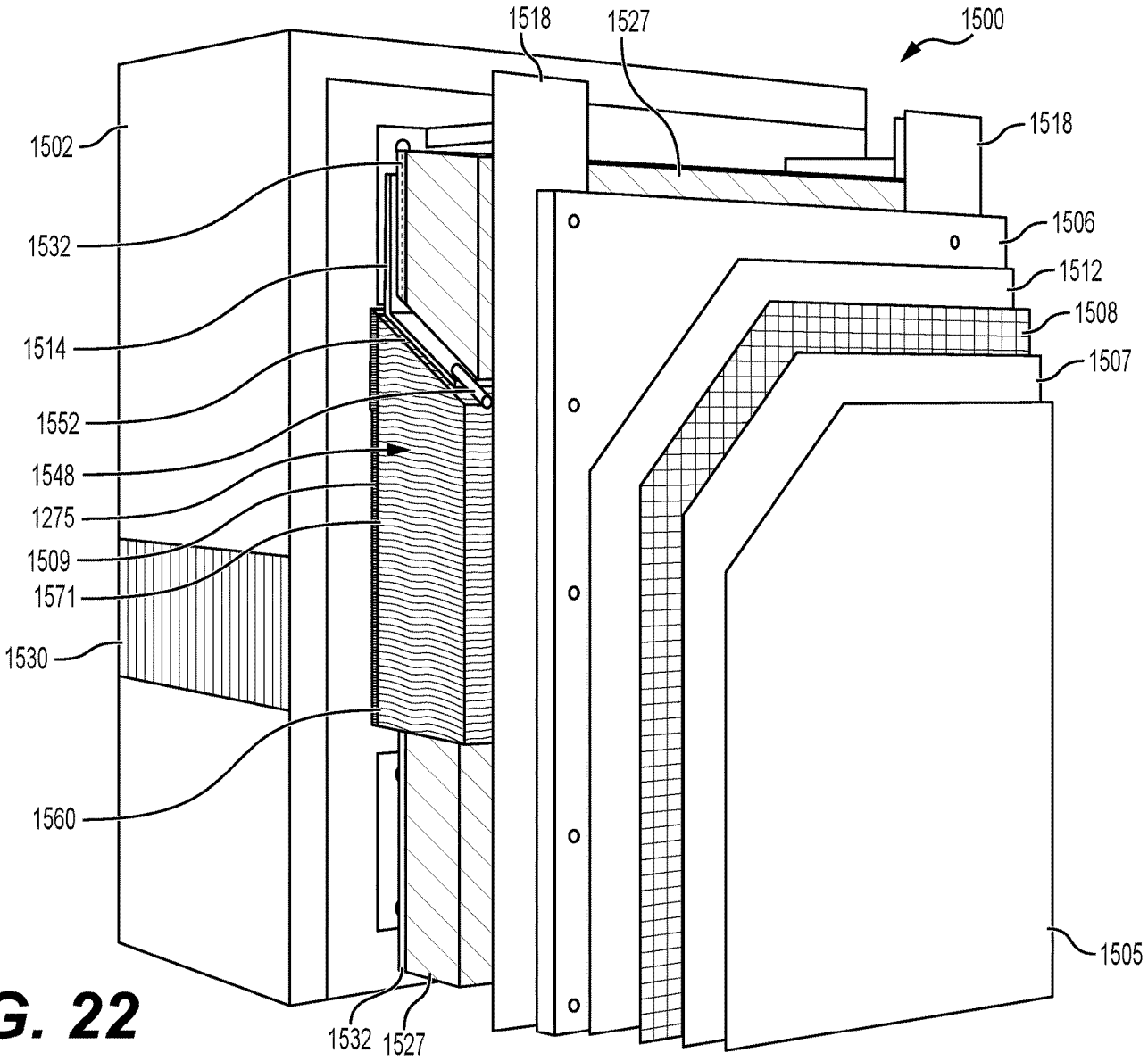
FIG. 22 is a perspective sectional partially-exploded view of a portion of the exterior wall system assembly shown in FIG. 21.

FIGS. 21 and 22 illustrate another exterior wall system assembly 1500 encompassing aspects of the present disclosure. The exterior wall system assembly 1500 includes a structural wall frame 1502, upon which is mounted other components of the exterior wall system assembly 1500. The exterior wall system assembly 1500 also includes a mineral wool safing 1530 adjacent the floor slab of a multi-story building. The mineral wool safing 1530 can be disposed between portions of the structural wall frame 1502 aligned at each story of the building. The exterior wall system assembly 1500 further includes a plurality of mounting brackets 1515 that are mounted to the structural wall frame 1502 by fasteners. The mounting brackets 1515 can serve as mounting fixtures for other components of the exterior wall system assembly 1500. The exterior wall system assembly 1500 also comprises a plurality of T-rails 518 that are attached to the mounting brackets 1515 and serve as anchor bases for other components of the exterior wall system assembly 1500.

Mounted to the structure wall frame 1520 is an insulation layer 1527. The insulation layer 1527 can comprise a mineral wool. Disposed between sections of the insulation layer 1527 is a fireblocking base form 1560. The fireblocking base form 1560 comprises an angled top side 1552 that is sloped downward from the rear side to the front side of the fireblocking base form 1560. An upper section of the insulation layer 1527 can have a beveled bottom side that is aligned generally parallel to the top side 1552 of the fireblocking base form 1560. In one aspect, the beveled bottom side of the upper insulation layer 1527 can contact the top side 1552 of the fireblocking base form 1560. The fireblocking base form 1560 comprises a lamella 1571 that includes lamellar layers of fire-resistant material 1275. The lamellar layers of the lamella 1571 are aligned generally perpendicular to the outer face 1510 of the exterior wall system assembly 1500. Portions of the T-rails 1518 project beyond the outer surfaces of the insulation layer 1527. The cross-bar of each T-rail 1518 is aligned generally parallel to the outer surface of the insulation layer 1527 and spaced apart therefrom, with the outer surface of the insulation layer 1527 aligned proximal to the structural wall frame 1502 and the cross-bar of each T-rail 1518 aligned distal to the structural wall frame 1502.

The exterior wall system assembly 1500 also comprises a carrier board 1506 mounted on the outer side of the crossbar of each T-rail 1518. A base coating layer 1512 is applied to the outer surface of the carrier board 1506 and a mesh layer 1508 is disposed on the base coating layer 1512. A primer coating layer 1507 can be disposed on the mesh layer 1508 and the base coating layer 1512. A finish layer 1505 is disposed on the primer coating layer 1507 and is disposed at the outer face 1510 of the exterior wall system assembly 1500.

The front side of the insulation layer 1527 is spaced apart from the crossbars of the T-rails 1518 and the rear side of the carrier board 1506, thereby forming concealed spaces 1580 within the exterior wall system assembly 1500. The depth of the fireblocking base form 1560 is greater than the depth of the insulation layer 1527. Accordingly, the fireblocking base form 1560 projects beyond the front side of the insulation layer 1527 to the back side of the cladding or face layer. The fireblocking base form 1560 can bound one or more concealed spaces 1580 within the exterior wall system assembly 1500.

A plurality of weep tubes 1548 are disposed on the top side 1552 of the fireblocking base form 1560. A plurality of channels is also formed on the fireblocking base form 1560.

The plurality of channels can be configured according to any one of the channel configurations shown in FIGS. 7B, 10B and 11B. Each weep tube 1548 is hollow and open at both ends thereof. A first end of each weep tube 1548 is in fluid communication with a channel outlet of a channel of the plurality of channels and is also open to an air cavity and/or internal void space 1580 within the exterior wall system assembly 1500. A ribbon 1568 of the channel is aligned with an end thereof adjacent the top end of the weep tube 1548. A second end of each weep tube 1548 is open to the outer face 1510 of the exterior wall system assembly 1500. Water and moisture that may collect within the air cavity and/or internal void space 1580 bounded by the fireblocking base form 1560 can drain down the top side 1552 of the fireblocking base form 1560 through the weep tubes 1548 and out of the exterior wall system assembly 1500.

As shown in FIGS. 23-28, an exterior wall panel system 1100 encompassing aspects of the present disclosure is shown. The exterior wall panel system 1100 includes a panel body 1102 having a front face 1110, a top edge 1120, a base 1130, a first side edge 1124, and a second side edge 1134. A plurality of weep holes 1140 is formed in the exterior layer 11112 and open to the front face 1110 of the panel body 1102. The plurality of weep holes 1140 is disposed along the lower portion of the front face 1110 of the panel body 1102 so as to allow water to drain from interior void spaces of the panel body 1102. The plurality of weep holes 1140 is disposed in a row 1144 extending across the front face 1110 of the panel body 1102. The plurality of weep holes 1140 can function as means for ventilation in the air cavities and concealed spaces of the exterior panel system 1100 as well as sites through which moisture can migrate from the interior of the exterior wall panel system 1100.

A lower portion of the panel body 1102 is shown in FIG. 10. As shown therein, the row 1144 of weep holes 1140 is formed in the exterior layer 1112. Each opening 1140 is aligned with a weep tube 1148 disposed in the panel body 1102. The weep tubes 1148 are aligned in parallel with each other. A plurality of channels 1150 is disposed within the interior of the panel body 1102. Each channel 1150 is in fluid communication with a weep tube 1148. More specifically, the outlet of each channel 1150 is disposed at the open top end of a weep tube 1148. Also shown in FIGS. 24, 25 and 26, the sidewalls of each channel 1150 is formed by a pair of ribbons that are aligned at an angle to each other extending from apexes either at or proximal to the top rear edge 1156 of a fireblocking base form 1160 disposed within the panel body 1102. The channels 1150 can be configured similar to one of the channel configurations shown in FIG. 7B, 10B or 11B. Each channel 1150 extends from the rear edge 1156 to the open top end of a weep tube 1148. Each weep tube 1148 extends to the top front edge 1158 of the fireblocking base form 1160. A trough 1138 within the panel body 1102 is also shown. The trough 1138 can extend across a portion of the width of the panel body 1102.

Figure 25:
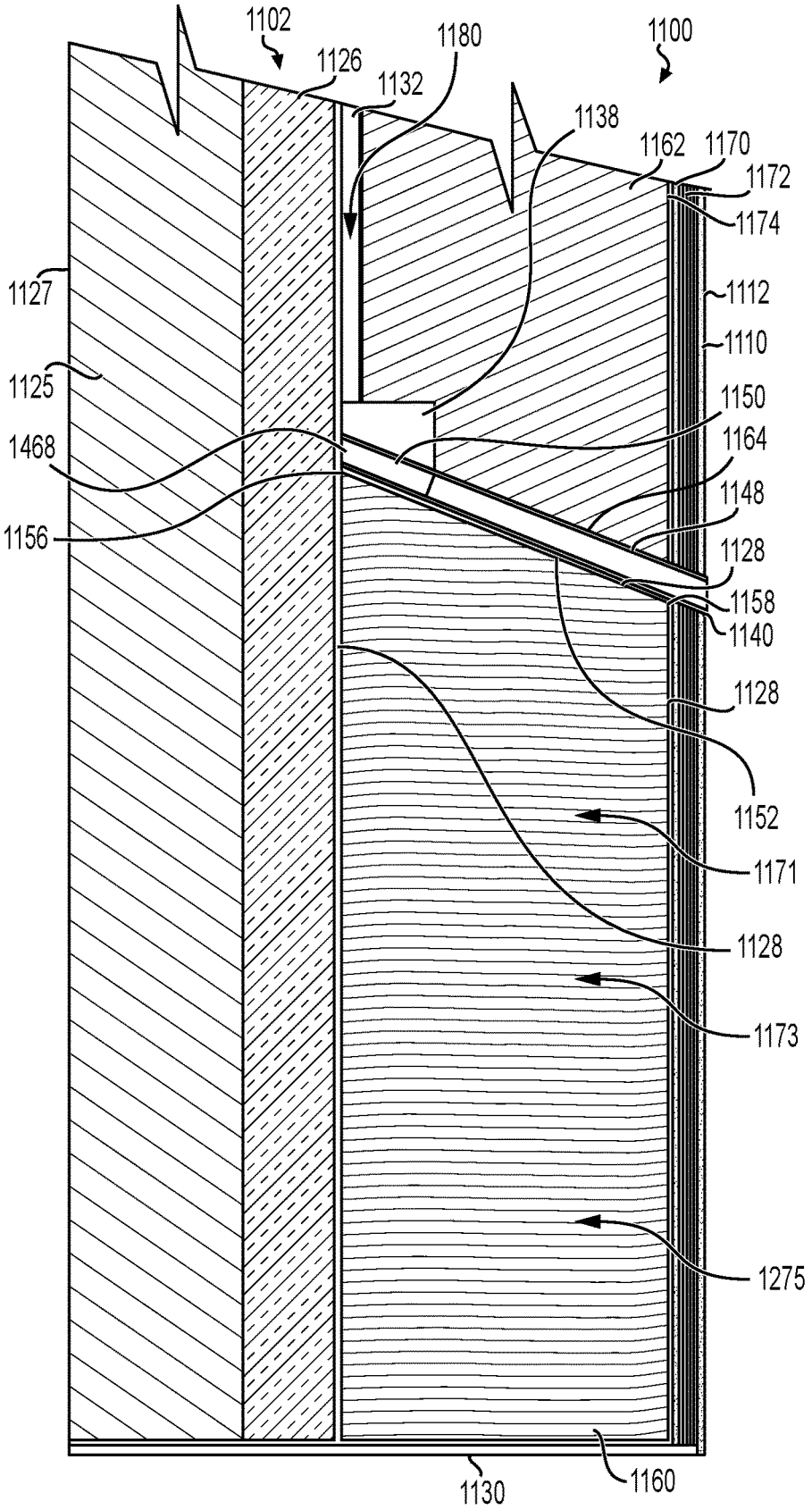
FIG. 25 is a left side cross-sectional view of a lower portion of the exterior wall panel system shown in FIG. 23.

As shown in FIG. 25, the exterior wall panel system 1100 includes a panel body 1102 made up of a plurality of dissimilar layers. Each layer of the panel body 1102 imparts different performance features to the exterior wall panel system 1100. The panel body 1102 includes a support frame 1125. The support frame 1125 can provide support for the other layers of the panel body 1102 and structure to the exterior wall panel system 1100. The panel body 1102 comprises a fireblocking frame 1175 that comprises a fireblocking base form 1160, a left fireblocking vertical form 1163, a right fireblocking vertical form 1165, and a fireblocking top form 1166. The fireblocking base form 1160, the left fireblocking vertical form 1163, the right fireblocking vertical form 1165, and the fireblocking top form 1166 cooperate to enclose or bound all the concealed spaces 180 formed within the interior of the panel body 1102. Alternatively, the panel body 1102 can comprise a fireblocking base form 1160 that extends the width of the panel body 1102 and have no fireblocking vertical forms.

Figure 27:
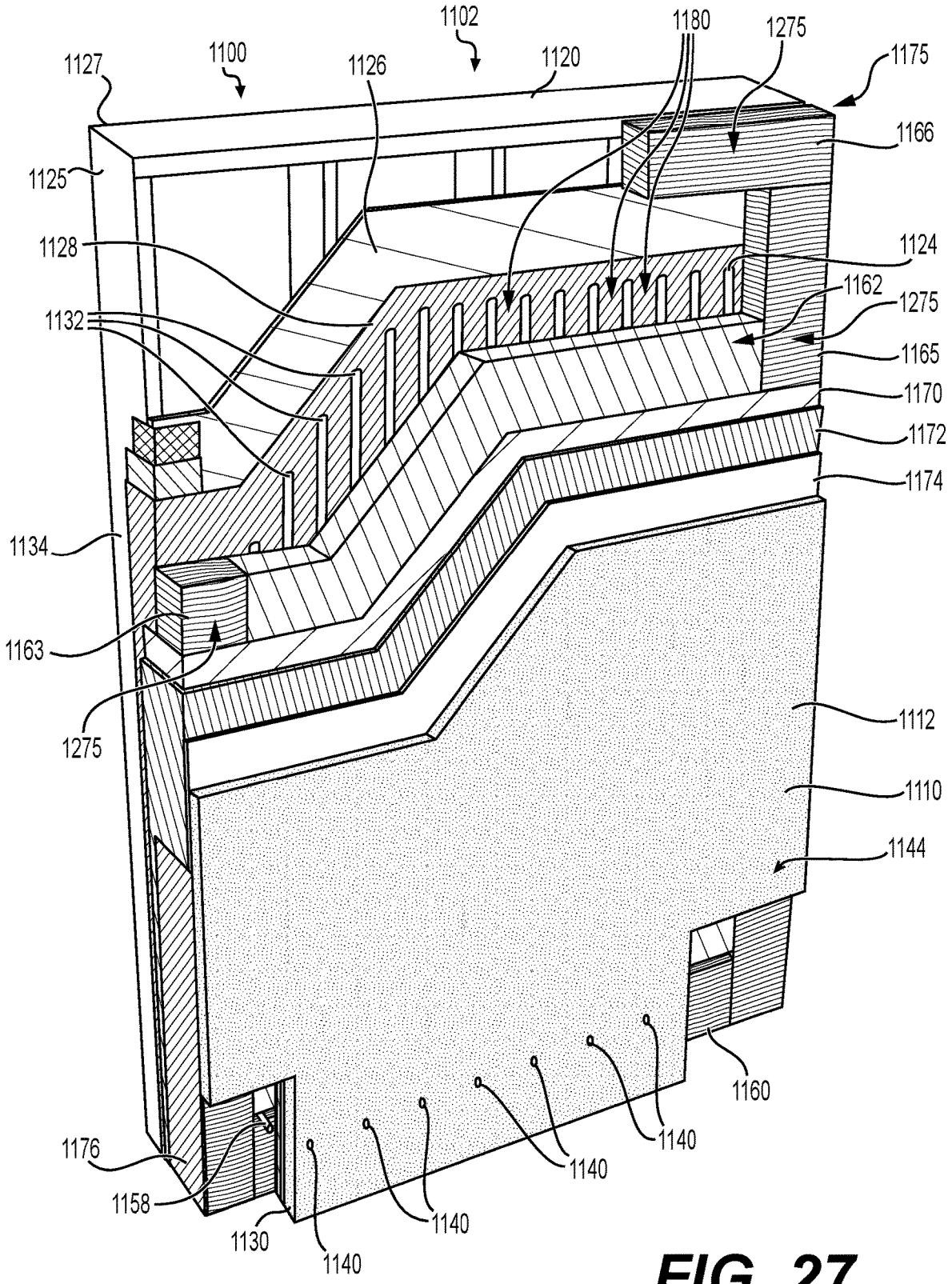
FIG. 27 is a perspective view of the exterior wall panel system of FIG. 23 with a portion cut away to show the layers of the panel body.

Attached to the support frame 1125 is a base layer 1126. The base layer 1126 can be formed of gypsum and glass matting. The base layer 1126 provides a substrate extending across the length and width of the panel to provide a surface to which the other panel layers can be affixed. A waterproof membrane 1128 is disposed on the base layer 1126. The waterproof membrane 1128 can be formed of a latex-based coating, such as STO GOLD COAT® membrane coating, manufactured by Sto Corp of Atlanta, Georgia, USA, or other coating providing water-resistant performance characteristics. The waterproof membrane 1128 can serve to prevent moisture and air penetration of the base layer 1126. In the panel body 1102, adhesive ribbon 1132 can be applied to the base layer or water-resistive barrier layer. The adhesive ribbon 1132 can be formed of any appropriately performing adhesive and serves as a means for attaching the insulation layer 1162 to the base layer 1126. As shown in FIG. 27, each adhesive layer 1132 can be aligned in a generally vertical arrangement.

Figure 26:
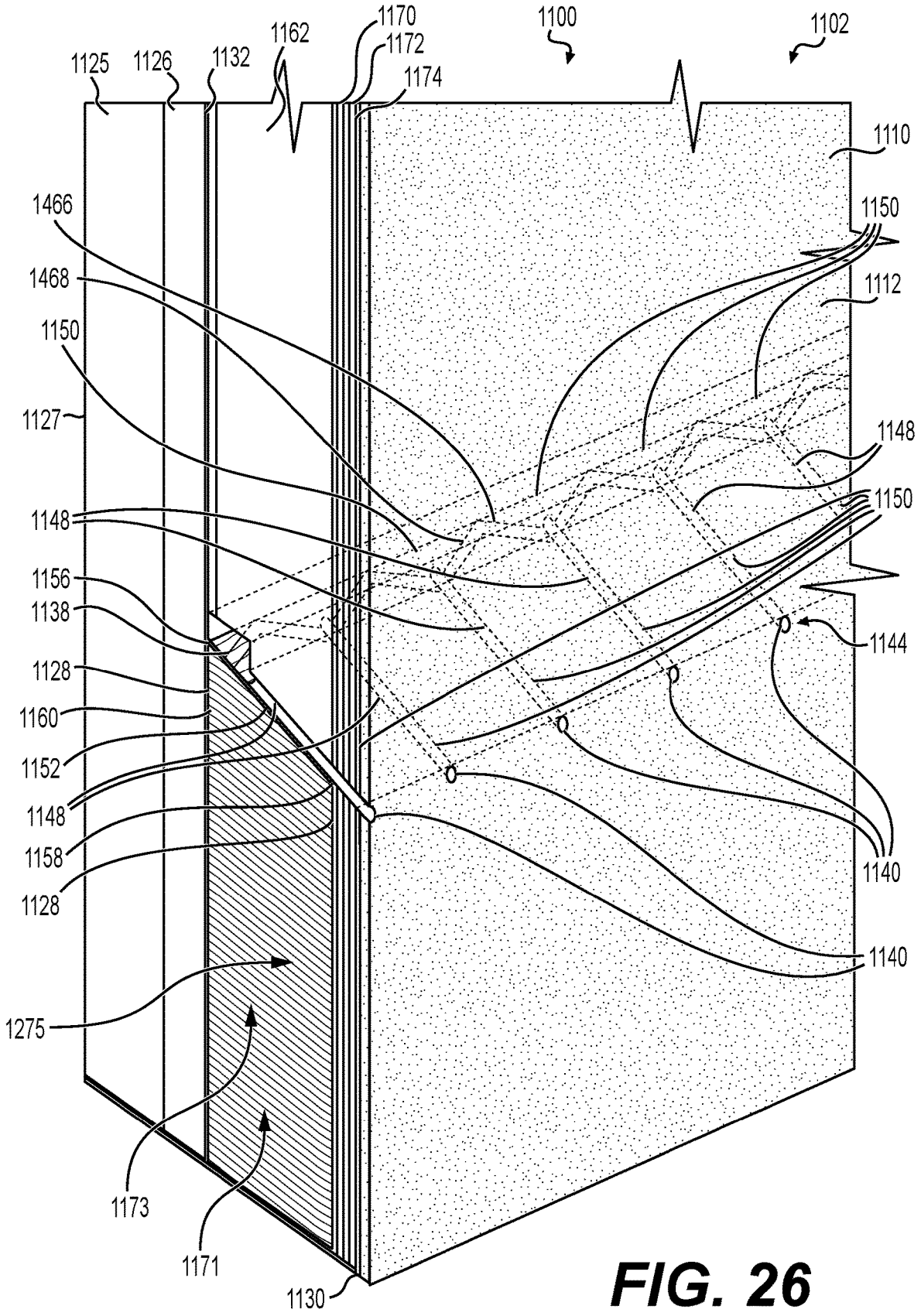
FIG. 26 is a perspective view of a lower portion of the exterior wall panel of FIG. 23 with a portion cut away and another portion shown in phantom line to show the inner structure of the panel system.

As shown in FIG. 27, the insulation layer 1162 extends across a central portion of the width of the panel body 1102. The insulation layer 1162 can be formed of any appropriate material, such as expanded polystyrene (EPS), having insulative properties and other desired performance characteristics. The insulation layer 1162 can comprise a continuous board that is sized and shaped to fit within the panel body 1102. As shown in FIGS. 25 and 26, the insulation layer 1162 can include a bevel bottom side 1164 extending across a lower portion of the board.

As shown in FIGS. 24-28, a fireblocking base form 1160 is disposed in the panel body 1102 between the base 1130, the insulation layer 1162, the left fireblocking vertical form 1163, and the right fireblocking vertical form 1165. The fireblocking base form 1160 includes a top front edge 1158 and a top rear edge 1156 that is elevated higher than the top front edge 1158. Extending between these edges is a top side 1152 on which is aligned at least a portion of each of the channels 1150. The top side 1152 can be configured to be generally parallel to and spaced apart from the beveled bottom side 1164 of the insulation layer 1162. The fireblocking base form 1160 extends across a lower center portion of the width of the panel body 1102. The fireblocking base form 1160 is formed of a fire-resistant material 1275, such as mineral wool, that is provided in a plurality of lamellar layers 1173, thereby forming a fire-resistant lamella 1171. The fireblocking base form 1160 can be of various sizes and configurations. For example, the height of the front of the fireblocking base form 1160 from the bottom to the top front edge 1158 can be about 21 cm, while the rear height from the bottom of the fireblocking base form 1160 to the top rear edge 1156 can be about 23 cm. Alternative heights of at least 21 cm or greater and ratios of front to rear heights of the fireblocking base form encompassed by the present disclosure are contemplated.

As shown in FIGS. 25 and 26, the fireblocking base form 1160 can be partially encased in a waterproof membrane 1128. The top side 1152 can have a waterproof membrane 1128 formed thereon to allow for water to be directed down the top side 1152 without penetrating the fireblocking base form 1160. The insulation layer 1162 also can have a waterproof membrane 1128 applied to one or more surfaces thereof, including a rear face and the bevel surface 1164 to allow water to flow along those surfaces without penetration into the insulation layer 1162. The top side 1152 of the fireblocking base form 1160 can be formed at various angles such as 27°, 45°, 60° or other appropriate angle to allow water to flow by gravity from an interior portion of the panel body 1102 to the front face 1110.

As shown in FIG. 27, each panel body 1102 of the exterior wall panel system 1100 can include edge wraps 1176 disposed on the edges of the panel body. The edge wraps can include one or more layers that provide the desired performance characteristics. For example, the edge wrap 1176 can include a joint reinforcement, a mesh substrate, and/or a water air barrier membrane. The edge wrap 1176 can extend across the entire edge of the panel body 1102 or a portion thereof. For example, the edge wrap 1176 can extend from behind the exterior layer 1112 along the second side edge 1134 to the support frame 1125 of the panel body 1102. Within a panel body 1102, a first edge wrap can be disposed on a first side edge of a panel and a second edge wrap can be disposed on a second side edge of the panel. Furthermore, the edge wrapping can extend over all or a portion of the top edge 1120 and/or the base 1130, to provide a barrier with desired performance features along all the edges of the panel body 1102.

Figure 24:
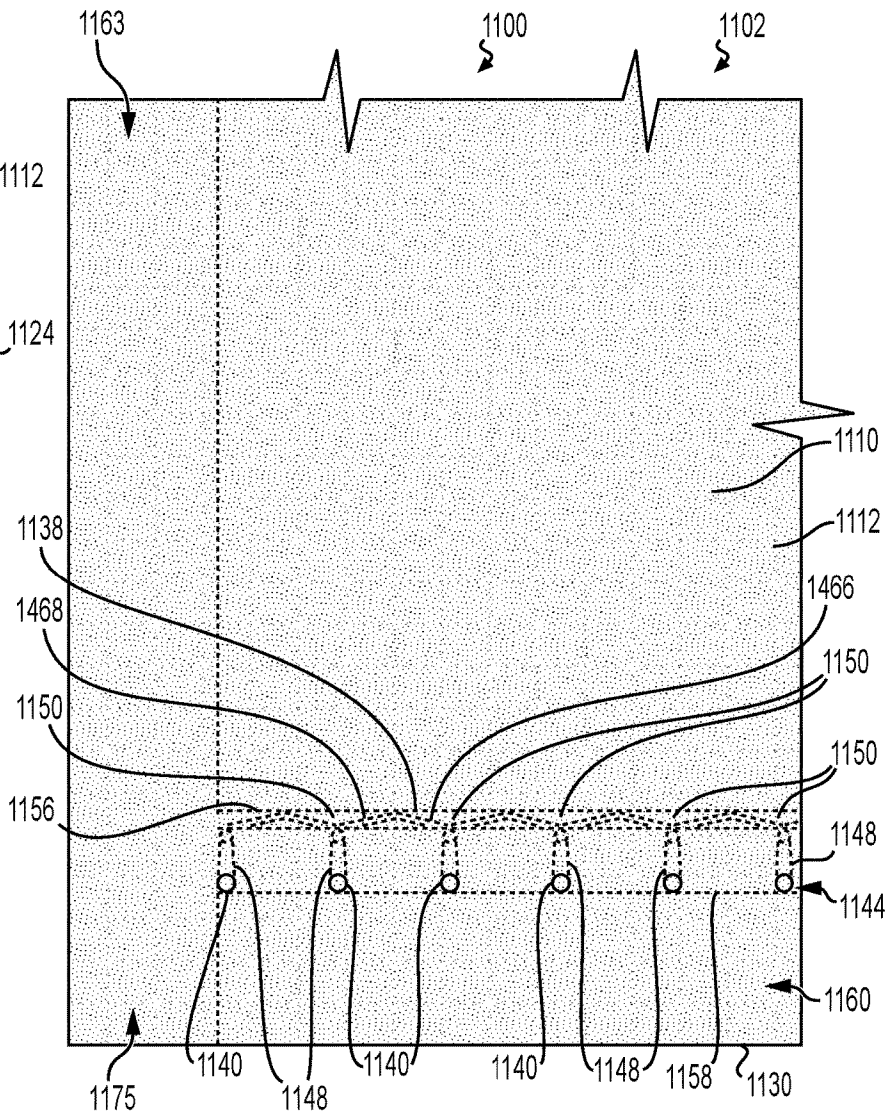
FIG. 24 is a front elevation view of a lower left portion of the exterior wall panel shown in FIG. 23 with certain internal components of the exterior wall panel shown in phantom line.
Figure 23:
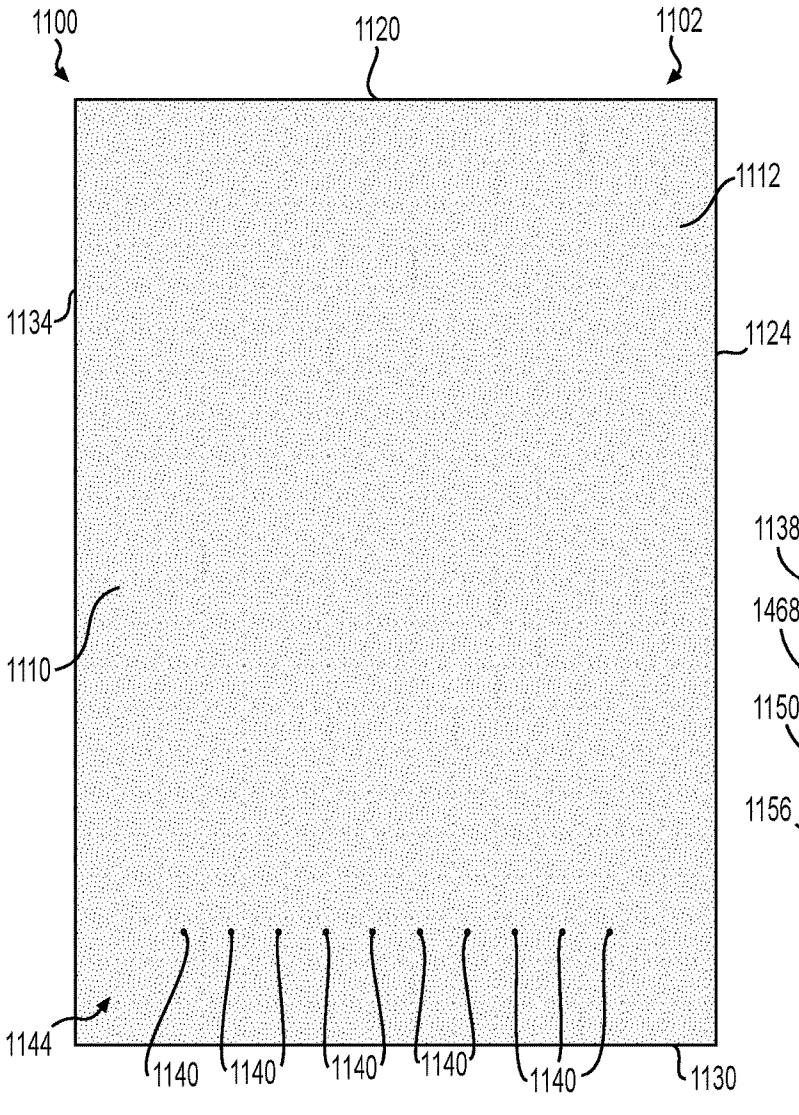
FIG. 23 is a front elevation view of an exterior wall panel encompassing aspects of the present disclosure.

As shown in FIGS. 24, 25, and 26, the panel body 1102 includes one or more channels 1150 formed therein. The channels 1150 extend from a rear portion of the insulation layer 1162 through the layers disposed between the insulation layer 1162 and the front face 1110 of the panel body, including a mesh layer 1170, a base coat layer 1172, a primer layer 1174, and an exterior layer 1112. Each channel 1150 is in fluid communication with the front face 1110 of the panel body 1102 via a weep tube 1148 so as to allow water and moisture to move from an interior portion of the panel body 1102 out of the panel body 1102 through the front face 1110. The channels 1150 can be of various sizes. The plurality of channels 1150 can be alternatively configured within the panel body 1102 accordingly to one of the channel configurations shown in FIG. 7A, 7B, 10A, 10B, 11A, 11B, or 14. Depending upon the configuration, each channel 1150 can be aligned in fluid communication with a weep tube 1140 or open to the outer face of the panel body 1102.

As shown in FIGS. 25 and 26, each channel 1150 can be in fluid communication with a trough 1138 formed within the panel body 1102. More particularly, the trough 1138 can be formed in a portion of the insulation layer 1162 and partially defined by the fireblocking base form 1160. The trough 1138 can have a water membrane 1128 disposed on the surfaces thereof to allow for water to flow there through without penetrating into the surrounding layers of the panel body 1102. The trough 1138 can extend across the width of the panel body 1102 and can be aligned generally horizontally along a lower portion of the insulation layer 1162. The trough 1138 is generally aligned at an elevated position relative to the weep holes 1140 formed in the exterior layer 1112 so as to allow for water to flow by gravity from an interior portion of the panel body to the front face 1110. The troughs encompassed by the present disclosure can have various configurations. For example, the height of the trough from the top rear edge 1156 of the fireblocking base form 1160 to the bottom edge of the insulation layer 1162 can be about 1.3 cm, while the depth of the trough 1138 from the rear face of the insulation layer 1162 to the front of the trough 1138 can also be about 1.3 cm.

The trough 1138 is in fluid communication with concealed spaces 1180 within the panel body 1102 disposed between the insulation layer 1162 and the base layer 1126. These concealed spaces 1180 can be approximately the depth of the adhesive ribbon and extend across the panel between each adhesive ribbon. In the panel body 1102 shown in FIG. 25, a waterproof membrane 1128 is disposed on both the base layer 1126 and the top side 1152 of the fireblocking base form 1160. The base layer 1126 and top side 1152 of the fireblocking base from 1160 within the panel body are generally covered by a waterproof membrane to reduce absorption of moisture into the various water permeable layers of the panel body 1102. Consequently, water penetrating the panel body 1102 to these concealed spaces 1180 has a pathway through which to travel from the concealed spaces 1180 to the trough 1138, then through the channels 1150 and weep tubes 1148 and out of the weep holes 1140 in the front face 1110 of the panel body 1102.

As can be seen in FIGS. 23, 24, 27 and 28, the channels 1150 and the weep holes 1140 with which they are in fluid communication are spaced along a center portion of the width of the panel body 1102. Within the spaces formed by the top side 1152 of the fireblocking base form 1160, the bevel surface 1164 of the insulation layer 1162, and the channels 1150, insulation material can be applied to fill these spaces. For example, spray foams having insulative properties, such as urethane-based foams, can be applied to fill these spaces and form a continuous insulative barrier interrupted only by the channels 1150.

As shown in FIGS. 25 and 26, a weep tube 1148 can be disposed in fluid communication with the channel 1150. The weep tube 1148 can be formed of any convenient rigid or semi-rigid material that is waterproof. The weep tube 1148 can provide a conduit through which water can flow from the interior of the panel body 1102 to the opening 1140 in the exterior layer 1112.

Figure 28:
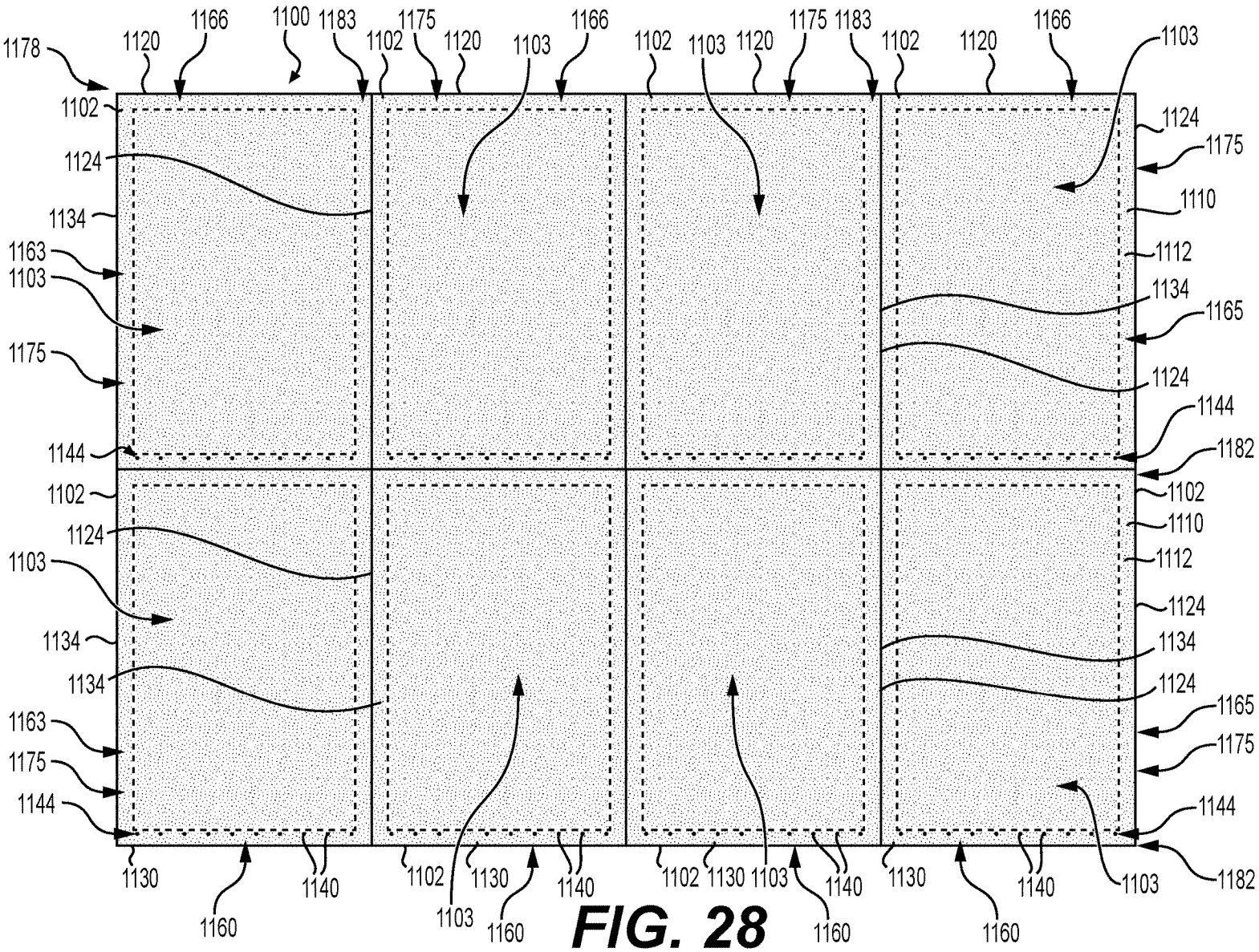
FIG. 28 is a front elevation view of an exterior wall panel system encompassing aspects of the present disclosure with certain internal components of the exterior wall panels of the exterior wall panel system shown in phantom line.

FIG. 28 shows the exterior wall panel system 1100 comprising a plurality of panel bodies 1102 installed on a structure. Each panel body 1102 is installed with the front face 1110 facing outward from the structure. The panel bodies 1102 are aligned so that the first side edge 1124 is aligned adjacent the second side edge 1134 of the adjacent panel. Likewise, the bases 1130 of the panel bodies 1102 can be aligned adjacent the top edges 1120 of other panel bodies installed directly below them. The panel bodies 1102 within each row of panels are aligned to form a row of weep holes 1140 extending across multiple panels. The panel bodies 1102 also cooperate to form a fireblocking framework 1178 comprising a plurality of fireblocking rows 1182 formed of the fireblocking base forms 1160 and/or the fireblocking top forms 1166 and a plurality of fireblocking columns 1183 formed of the left and/or right fireblocking vertical forms 1163 and 1165. Bounded areas 1103 that contain the concealed spaces of the panel bodies 1102 are bounded by the fireblocking rows 1182 and the fireblocking columns 1183. For panel bodies 1102 that have the fireblocking base form 1160, the left fireblocking vertical form 1163, the right fireblocking vertical form 1165, and the fireblocking top form 1166 extending to the respective edges of the panel bodies 1102 without any edge wrapping, the fireblocking rows 1182 and the fireblocking columns 1183 can comprise continuous spans of fire-resistant material 1275 in which the fire-resistant material 1275 of each left fireblocking vertical form 1163 contacts the fire-resistant material 1275 of the right fireblocking vertical form 1165 in the adjacent panel body 1102, and the fire-resistant material 1275 of each fireblocking base form 1160 contacts the fire-resistant material 1275 of the fireblocking top form 1166 of the adjacent panel body 1102 aligned directly below. In this manner, the exterior wall system 1100 can provide a continuous fireblocking framework 1178 in which the bounded areas 1102 containing concealed spaces 1180 are enclosed both vertically and horizontally in fireblocking barriers.

The panel bodies 1102 can be affixed in place on the structure and then an air/water-resistive barrier caulking can be applied to the seams formed between the panel bodies 1102. In this way, the exterior wall panel system 1100 including a plurality of panel bodies 1102 can be arranged to form a generally continuous exterior surface of a building or other structure. As so installed, the exterior wall panel system 1100 allows for water that penetrates the interior of the wall structure to be channeled out of the wall through the openings 140 formed in the exterior layers of each panel body 1102.

FIG. 25 shows the rear portion 1127 of the panel body 1102 of the exterior wall panel system 1100 of the present disclosure. The support frame 1125 is aligned generally along the rear portion 1127 of the panel body 1102. The support frame 1125 includes a top beam, two side beams, a base beam, and intermediate vertical beams to provide support and reinforcement for the panel body 1102. The side beams and the vertical beans extend from the base 1130 to the top edge 1120. The support frame 1125 can be made of metal, wood, or synthetic polymeric materials as needed. The alignment of the channels 1150 and the trough 1138 are shown in phantom line in FIG. 24.

The panels 1102 of the exterior wall panel system 1100 can comprise more than one fireblocking row 1182 of fireblocking base forms 1160, more than one row of weep holes 1140, and/or more than two fireblocking columns 1183 of fireblocking vertical forms 1163 within a single panel body. If the dimensions of a particular panel 1102 is greater than the maximum allowable distances between fireblocking rows 1182 and/or fireblocking columns 1183, then the panel 1102 can be constructed to include one or more additional fireblocking rows 1182 of fireblocking base forms 1160 and/or one or more additional fireblocking columns 1183 of fireblocking vertical forms 1163 that are aligned horizontally intermediate between the bottom most fireblocking base form 1163 of the fireblocking top form 166 and vertically between the left fireblocking vertical form 1163 and the right fireblocking vertical form 1163.

Figure 29:
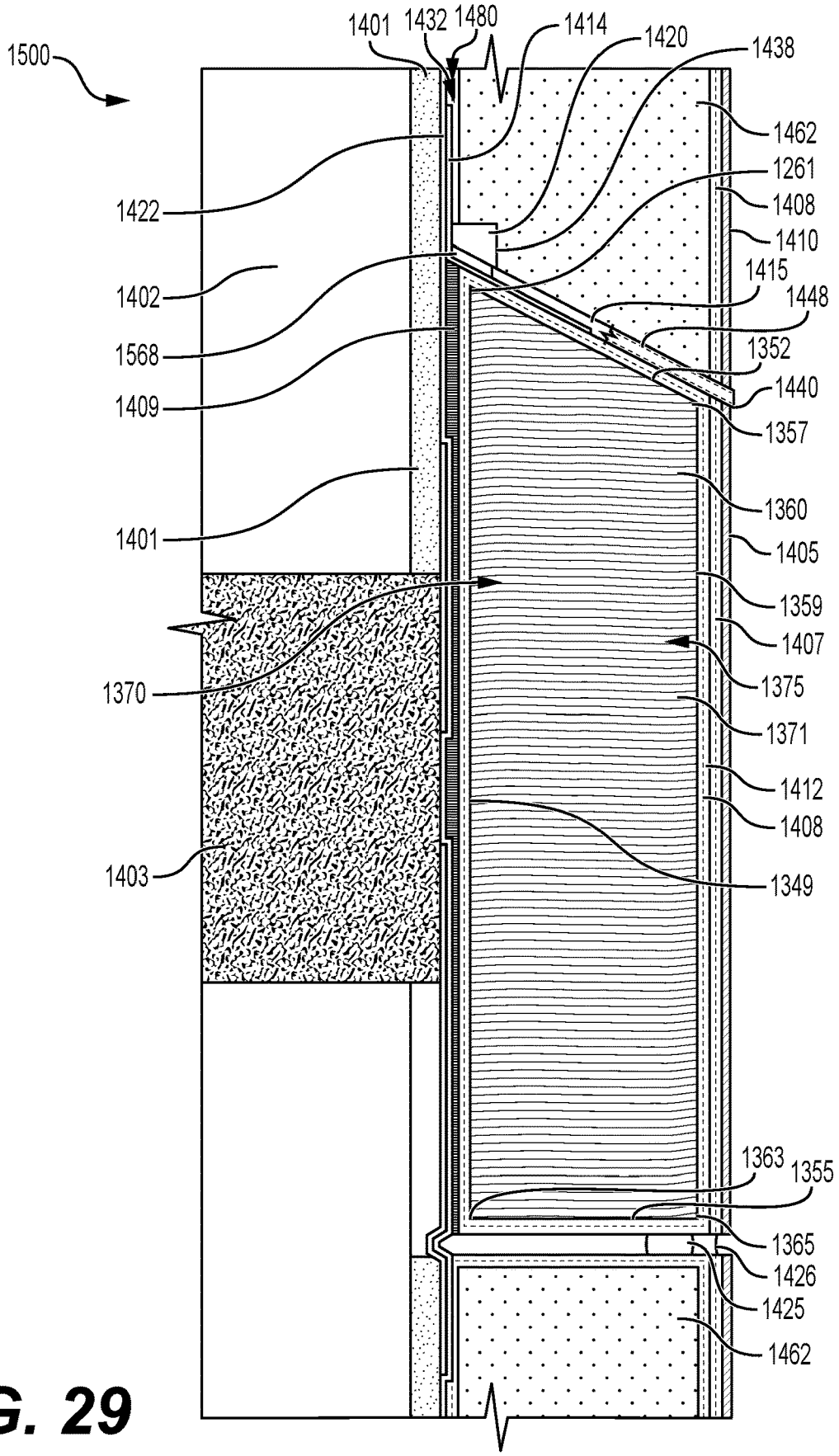
FIG. 29 is a cross-sectional view of a portion of the wall assembly shown in FIG. 18 with the fireblocking base form replaced with another version of a fireblocking base form that exhibits a greater height and that extends both above and below the upper and lower sides of the wall slab.

FIG. 29 illustrates a portion of an exterior wall system assembly 1500 that is similar to the exterior wall system assembly 1400, shown in FIGS. 18-20, but with the fire blocking base form 1260 replaced with taller fireblocking base form 1360 that exhibits a greater height than that of the fireblocking base form 1260. The fireblocking base form 1360 has a body 1370 comprising a front side 1359 and a rear side 1349 spaced apart from, opposing and aligned generally parallel to the front side 1359. The front side 1359 exhibits a front side height, and the rear side 1349 exhibits a rear side height, with the rear side height being greater than the front side height. A bottom side 1355 extends between the front side 1359 and the rear side 1349 and is aligned generally perpendicular to the front side 1359 and/or the rear side 1349. The fireblocking base form 1360 also comprises a top side 1352 extending between the front side 1359 and the rear side 1349. The top side 1352 is aligned non-parallel to the bottom side 1355. The rear side 1349 and the top side 1352 intersect to form a rear top angle 1361. The front side 1359 and the top side 1352 intersect to form a front top angle 1357. The rear top angle 1361 is acute and the front top angle 1357 is obtuse. The rear side 1349 and the bottom side 1355 intersect to form a rear bottom angle 1363, and the front side 1359 and the bottom side 1355 intersect to form a front bottom angle 1365. Both the rear bottom angle 1363 and the front bottom angle 1365 are generally right angles. The fireblocking base form 1360 of the exterior wall system assembly 1400 comprises a fire-resistant material 1375, such as, for example, mineral wool that is provided in a plurality of lamellar layers to form a lamella 1371. The lamellar layers of the lamella 11371 are aligned generally perpendicular to an outer face 1410 of the exterior wall system assembly 1400.

A plurality of weep tubes 1448 is aligned on the top side 1352 of the fireblocking base form 1360. A plurality of channels is also formed on the fireblocking base form 1360. The plurality of channels can be configured according to any configuration as shown in FIG. 7B, 10B or 11B. Each weep tube 1448 is hollow and open at both ends thereof. The top end of each weep tube 1448 is disposed in fluid communication with a channel outlet of a channel formed on the top side 1352 of the fireblocking base form 1360. The second water-resistant ribbon 1568 of the channel extends from the top rear edge of the fireblocking base form 1360 and ends adjacent the top end of the weep tube 1448. Each weep tube 1448 is aligned with a first end aligned proximal to the wall support frame 1402 and distal to the outer face 1410 of the exterior wall system assembly 1400, and a second end aligned proximal to the outer face 1410 and distal to the wall support frame 1402. The second end is open to the outer face 1410 and extends to and/or through a weep hole 1440 formed in the finish layer 1405. Each weep tube 1448 is configured to receive water that has collected on and drained down the air and water-resistant layer 1422 and the waterproof conformable membrane 1420 in the first end thereof through which the water drains downward to the second end of the weep tube 1448 and out of the exterior wall system assembly 1400 through the weep hole 1440 in the finish layer 1405.

The fireblocking base form 1360 is aligned adjacent to the floor slab 1403 of the building on which the exterior wall system assembly 1400 is mounted. The top side 1352 of the fireblocking base form 1360 is aligned anterior and superior to the top surface of the adjacent floor slab 1403, and the bottom side 1355 is aligned anterior and inferior to the bottom surface of the adjacent floor slab 1403. The fireblocking base form 1360 creates a horizontally aligned fireblocking layer that separates the concealed spaces within one story of the wall assembly 1400 from the concealed spaces of within the adjacent story of the wall assembly 1400 directly above or below. The fireblocking base form 1360 can be provided with a total height sufficient to meet the applicable building code requirements for a fireblocking layer.

Figure 30:
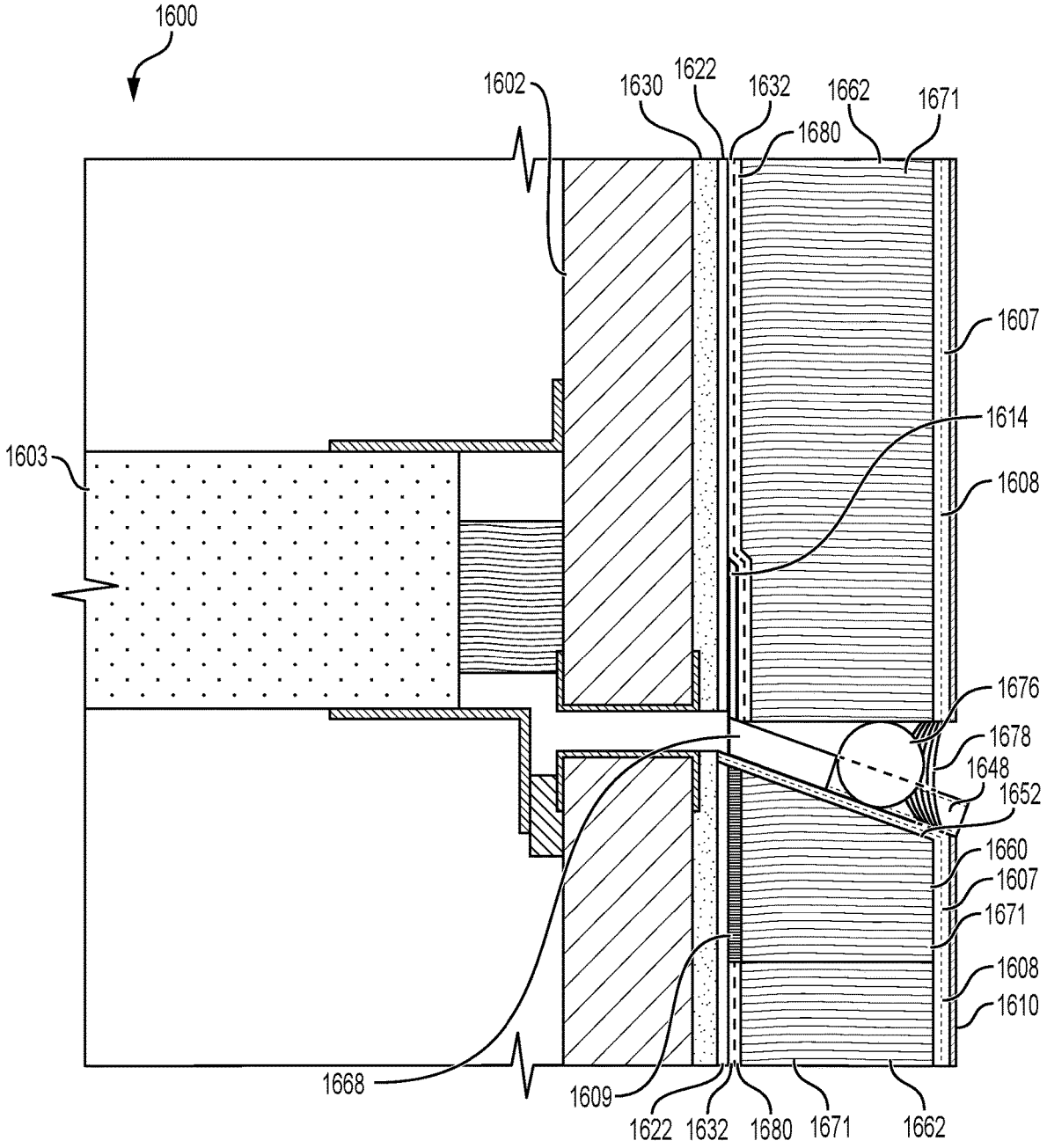
FIG. 30 is a cross-sectional view of a portion of yet another exterior wall system assembly encompassing aspects of the present disclosure.

FIG. 30 illustrates another exterior wall system assembly 1600 encompassing aspects of the present disclosure. The exterior wall system assembly 1600 is illustrated as a field-applied exterior wall system assembly in which the components thereof are individually mounted onto a building structure. The exterior wall system assembly 1600 comprises a continuous insulation system that provides a substantially continuous layer of insulation across a majority of the wall. The continuous layer of insulation is interrupted by periodic seams that are formed between adjacent subassemblies of the exterior wall system assembly 1600. The exterior wall system assembly 1600 comprises a floor slab 1603 on which is mounted a wall support frame 1602. The remainder of the exterior wall system assembly 1600 is mounted to and supported by the combination of the floor slab 1603 and wall support frame 1602. The wall support frame 1602 has a sheathing layer 1630 mounted thereto that can be formed of a glass mat-faced gypsum core or other suitable material that forms a rigid support structure. The exterior wall system assembly 1600 also comprises a fireblocking top form 1660 mounted inferior and anterior to the floor slab 1603. The fireblocking top form 1660 has a body comprising a front side and a rear side spaced apart from, opposing and aligned generally parallel to the front side. The front side exhibits a front side height, and the rear side exhibits a rear side height, with the rear side height being greater than the front side height. A bottom side extends between the front side and the rear side and is aligned generally perpendicular to the front side and/or the rear side. The fireblocking top form 1660 also comprises a top side 1652 extending between the front side and the rear side. The top side 1652 is aligned non-parallel to the bottom side. The rear side and the top side intersect to form a rear top angle. The front side and the top side intersect to form a front top angle. The rear top angle is acute and the front top angle is obtuse.

The fireblocking top form 1660 of the exterior wall system assembly 1600 comprises a fire-resistant material, such as, for example, mineral wool or rock wool that is provided in a plurality of lamellar layers to form a lamella 1671. The lamellar layers of the lamella 1671 are aligned generally perpendicular to an outer face 1610 of the exterior wall system assembly 1600.

A waterproof coating layer 1607 is disposed on the fireblocking top form 1660. The waterproof coating layer 1607 covers the front side and the top side of the fireblocking top form 1660. A mesh layer 1608 is disposed on the fireblocking top form 1660. The first mesh layer 1608 can be imbedded in the waterproof coating layer 1607 and cover the front side and the top side of the fireblocking top form 1660. The fireblocking top form 1660 can function as a barrier to the propagation of fire and hot gasses through the concealed spaces of the exterior wall system assembly 1600 from one story to another.

The exterior wall system assembly 1600 also comprises an insulation layer 1662 disposed directly below and above the fireblocking top form 1660. The portion of the insulation layer 1662 disposed directly below the fireblocking top form 1660 can be aligned adjacent to and in direct contact with the bottom side of the fireblocking top form 1660. The portion of the insulation layer 1662 disposed directly above the fireblocking top form 1660 is spaced apart from the fireblocking top form 1660. The fireblocking top form 1660 can cooperate with the insulation layer 1662 to form a continuous layer that exhibits both an insulative and fireblocking characteristics.

The insulation layer 1662 can be formed of the same fire-resistant material as the fireblocking top form 1660, such as rock wool or mineral wool. The fire-resistant material of the insulation layer 1662 can be provided in a plurality of lamellar layers that form a lamella 1671. Alternatively, the insulation layer 1662 can be formed of expanded polystyrene, extruded polystyrene, and/or graphite polystyrene. The insulation layer 1662 is mounted to the adjacent sheathing layer 1630 by an adhesive layer 1632. The adhesive layer 1632 can be provided in a plurality of vertical strips on the air and water-resistant barrier layer 1622. The plurality of vertical strips of adhesive layer 1632 can be applied to the rear side of the insulation layer 1662, and the insulation layer 11662 can then be placed in a horizontal running bond pattern on the sheathing layer 630 with joints of the insulation layer 1662 components tightly abutted. Firm, uniform pressure by hand or with a straight edge can be applied across the entire surface of the insulation layer 1662 thereby adhering it to the sheathing layer 1630. One or more concealed spaces 1680 can be formed by the cooperation of the strips of adhesive layer 1632, the air and water-resistant barrier layer 1622 and the insulation layer 1662. These concealed spaces 1680 potentially can serve as a route through which fire can propagate vertically and/or horizontally through the exterior wall system assembly 1600. The insulation layer 1662 mounted above the fireblocking top form 1660.

An air and water-resistant barrier layer 1622 is disposed on the sheathing layer 1630. The air and water-resistant barrier layer 1622 is disposed between the insulation layer 1662 and the sheathing layer 1630. The air and water-resistant barrier layer 1622 also is disposed between the fireblocking top form 1660 and the sheathing layer 1630. The fireblocking top form 1660 is mounted to air and water-resistant barrier layer 1622 by a full, continuous layer of waterproof adhesive 1609.

A waterproof conformable membrane 1614 is disposed on the air and water-resistant barrier layer 1622 and angled down to cover at least a portion of the top side 1652 of the fireblocking top form 1660. The waterproof conformable membrane 1614 extends downward across a horizontally aligned gap between the vertically aligned sections of the sheathing layer 1630. The waterproof conformable membrane 1614 is separated from direct contact with the top side 1652 of the fireblocking top form 1660 by a waterproof coating layer 1607 and a mesh layer 1608. The waterproof conformable membrane 1614 can cooperate with the air and water-resistant layer 1622 and the waterproof coating layer 1607 to form a waterproof barrier through which water and moisture cannot penetrate and a pathway by which water and moisture that accumulates in the void space within the exterior wall system assembly 1600 can be directed from the interior of the exterior wall system assembly 1600 down and along the top side 1652 of the fireblocking top form 1660.

A horizontally aligned gap extends between the sloped top side 1652 of the fireblocking top form 1660 and the bottom side of the insulation layer 1662 aligned directly above the fireblocking top form 1660. Moisture can drain into this gap from the concealed space 1680 aligned between the upper insulation layer 1662 and the air and water-resistant layer 1622 and the sheathing layer 1630. The waterproof conformable membrane 1614 can prevent moisture from moving inward into the gap formed between sections of the sheathing layer 1630 and can assist in directing water down onto the top side 1652 of the fireblocking top form 1660.

A plurality of channels and a plurality of weep tubes 1648 are aligned on the top side 1652 of the fireblocking top form 1660. The plurality of channels can be configured according to the configuration of any channel shown in FIG. 7B, 10B or 11B. Each weep tube 1648 is hollow and open at both ends thereof. Each channel is aligned aligned proximal to the sheathing layer 1630, and each channel has an outlet that is aligned distal to the outer face 1610 of the exterior wall system assembly 1600. The outlet of each channel is in fluid communication with the open top end of a weep tube 1648, which has bottom end that is aligned proximal to the outer face 1610 and distal to the sheathing layer 1630. The second end of the weep tube 1648 is open to the outer face 1610 and extends to and/or through and/or between the back rod 1676 and the one or more layers of sealant 1678 that are disposed in the gap formed between the upper insulation layer 1662 and the fireblocking top form 1660. Each of weep tube 1648 is configured to receive water that has collected on and drained down the air and water-resistant layer 1622 and the waterproof conformable membrane 1614 in the first end thereof through which the water drains downward to the second end of the weep tube 1648 and out of the exterior wall system assembly 1600 through the weep hole in the sealant 1678.

The exterior wall system assembly 1600 can comprises a plurality of concealed spaces each of which is bounded by the columns and rows of a fireblocking framework, not shown. The concealed spaces of the exterior wall system assembly 1600 are disposed in a bounded area that is bounded by at least one fireblocking top form 1660 and at least one fireblocking vertical form. In one aspect, a bounded area can be bounded by two fireblocking rows of fireblocking top forms 1660 and two fireblocking columns of fireblocking vertical forms that intersect the two fireblocking rows. The fireblocking framework can comprise a plurality of fireblocking columns that extend upward along the height of a multi-story building and a plurality of fireblocking rows of fireblocking top forms 1660 extending along the width of the multi-story building and aligned along the floor slab or base of each story. Each of the plurality of fireblocking rows of fireblocking top forms 1660 intersect the plurality of fireblocking columns. Each fireblocking column can comprise one or more fireblocking vertical forms aligned end-to-end within the exterior wall system assembly 1600. Each fireblocking vertical form can comprise a lamella 1671 of lamellar layers of fire-resistant material, such as rock wool or mineral wool, aligned generally perpendicular or transverse to the outer face of the exterior wall system assembly 1600. The fireblocking vertical forms can cooperate with the fireblocking top forms 1660 and the insulation layers 1662 to form a substantially continuous layer of insulation across a majority of the wall formed by the exterior wall system assembly 1600.

The exterior wall system assembly 1600 also can comprise one or more weep hole rows, each of which comprises a plurality of weep holes. The weep hole rows are aligned proximal to the fireblocking top forms 1660 and extend through the horizontally aligned rows of sealant 1678. Each fireblocking top form 1660 can abut at least one fireblocking vertical form on the left side and/or the right side of the fireblocking base form 1660. Likewise, each fireblocking vertical form can abut at least one fireblocking top form 1660 on the left side and/or the right side of the fireblocking vertical form. The fire-resistant material of each fireblocking vertical form contacts the fire-resistant material of each adjacently aligned fireblocking top form 1660 and each adjacently aligned fireblocking vertical form contacting the respective fireblocking vertical form, thereby forming the fireblocking framework that forms a continuous multi-layer fire-resistant barrier between and throughout each story of the multi-story building. Each fireblocking vertical form can be mounted to the sheathing layer 1630 by a full layer of water-resistant adhesive 1609, thereby creating a firebreak between each of the areas of concealed space.

Figure 31:
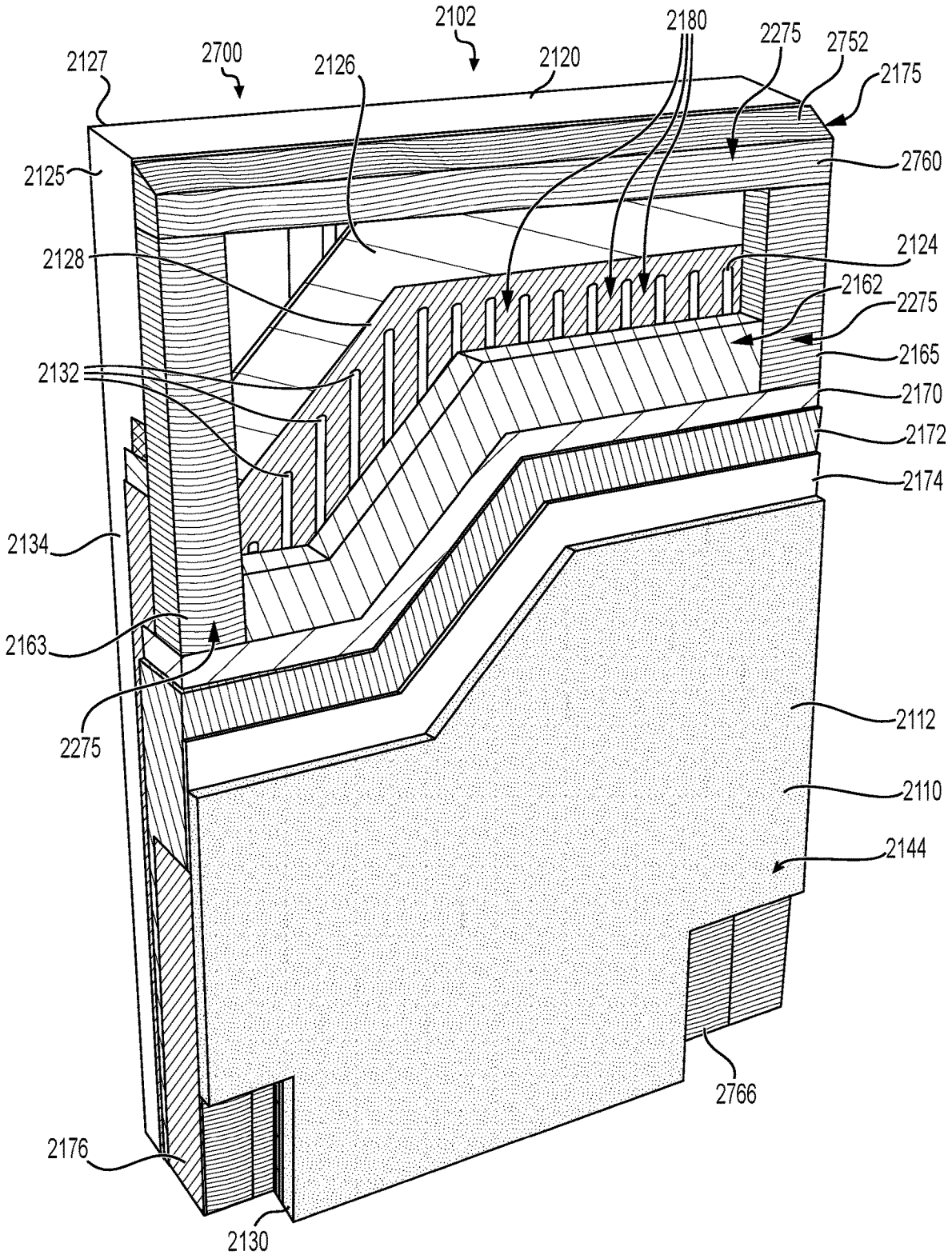
FIG. 31 is a perspective view of an exterior wall panel of another exterior wall panel system encompassing aspects of the present disclosure, with portions of the exterior wall panel cut away to show layers of the panel body.

FIG. 31 illustrates an exterior wall panel 1702 of an exterior wall panel system 1700 encompassing aspects of the present disclosure is shown. The exterior wall panel 1702 comprises a fireblocking top form 1760 that comprises a sloped top surface 1752 that is higher adjacent the support frame 1125 and lower adjacent the front face 1110 to allow moisture to drain from concealed spaces within the exterior wall panel system 1700 outward to the front face 1110 of the exterior wall panel 1702. The exterior wall panel 1702 can comprise a plurality of channels disposed on the sloped top surface 1752. The plurality of channels can be configured according to any configuration shown in FIG. 2, 7A, 7B, 10A, 10B, 11A or 11B. The exterior wall panel 1702 comprises a front face 1110, a top edge 1120, a base 1130, a first side edge 1124, and a second side edge 1134. The exterior wall panel 1702 includes a support frame 1125. The support frame 1125 can provide support for the other layers of the exterior wall panel 1702 and structure to the exterior wall panel system 1700. The exterior wall panel 1702 comprises a fireblocking frame 1175 that comprises a fireblocking top form 1760, a left fireblocking vertical form 1163, a right fireblocking vertical form 165, and a fireblocking base form 1766. The fireblocking base form 1766, the left fireblocking vertical form 1163, the right fireblocking vertical form 1165, and the fireblocking top form 1166 cooperate to enclose or bound all the concealed spaces 1180 formed within the interior of the exterior wall panel 1702.

Attached to the support frame 1125 is a base layer 1126. The base layer 1126 can be formed of gypsum and glass matting. The base layer 1126 provides a substrate extending across the length and width of the panel to provide a surface to which the other panel layers can be affixed. A waterproof membrane 1128 is disposed on the base layer 1126. The waterproof membrane 1128 can be formed of a latex-based coating, such as STO GOLD COAT®, manufactured by Sto Corp, or other coating providing waterproof performance characteristics. The waterproof membrane 1128 can serve to prevent moisture and air penetration of the base layer 1126. In the exterior wall panel 1702, vertical strips of adhesive ribbon 1132 can be applied to the waterproof membrane 1128. The adhesive ribbon 1132 can be formed of any appropriately performing adhesive and serves as a means for attaching the insulation layer 1162 to the base layer 1126.

The insulation layer 1162 extends across a central portion of the width of the exterior wall panel 1702. The insulation layer 1162 can be formed of any appropriate material, such as expanded polystyrene (EPS), extruded polystyrene (XPS), graphite polystyrene (GPS), rock wool and/or mineral wool having insulative properties and other desired performance characteristics. The insulation layer 1162 can comprise a continuous board that is sized and shaped to fit within the exterior wall panel 1702.

The fireblocking base form 1766 is disposed in the exterior wall panel 1702 between the base 1130, the insulation layer 1162, the left fireblocking vertical form 1163, and the right fireblocking vertical form 1165. The fireblocking base form 1766 is rectangular and abuts both the left fireblocking vertical form 1163, and the right fireblocking vertical form 1165. The fireblocking base form 1766 extends across a lower center portion of the width of the exterior wall panel 1702. The fireblocking base form 1766 is formed of a fire-resistant material 1275, such as mineral wool or rock wool that is provided in a plurality of lamellar layers, thereby forming a fire-resistant lamella. The fireblocking base form 1766 can be of various sizes and configurations.

The exterior wall panel 1702 of the exterior wall panel system 1700 optionally can include edge wraps 1176 disposed on the edges of the panel body. The edge wraps can include one or more layers that provide the desired performance characteristics. For example, the edge wrap 1176 can include a joint reinforcement, a mesh substrate, and/or a water air barrier membrane. The edge wrap 1176 can extend across the entire edge of the exterior wall panel 1702 or a portion thereof. For example, the edge wrap 1176 can extend from behind the exterior layer 1112 along the second side edge 1134 to the support frame 1125. A first edge wrap can be disposed on a first side edge of a panel and a second edge wrap can be disposed on a second side edge of the panel. Furthermore, the edge wrapping can extend over all or a portion of the top edge 1120 and/or the base 1130, so as to provide a barrier with desired performance features along all the edges of the panel.

The exterior wall panel system 1700 comprises a plurality of exterior wall panels 1702 that are mounted on a building in an arrangement similar to that of the exterior wall panel system 1100 shown in FIG. 28, but with each vertically aligned exterior wall panel 1702 separated by a horizontally aligned gap in which are disposed a plurality of channels and a plurality of weep tubes, a first backer rod and one or more layers of sealant disposed proximal to the sheathing layer and posterior to the wall panels and a second backer rod and second layer of sealant similar to the arrangement of components of the field-applied exterior wall system assembly 1600, shown in FIG. 30. Each weep tube of the plurality of weep tubes would be aligned on the top side 1752 of the fireblocking top form 1760, with the front opening of each weep tube open to the front face of the wall through the layers of sealant. With this arrangement, water can flow downward from concealed spaces behind and/or within the exterior wall panels 1702 to the top side of the panel 1702 aligned directly below and then out of the front of the exterior wall panel system 1700 through the plurality of weep tubes.

The first water-resistant ribbons 366, 466, 566, 666, 766, 866, 966, and 1466 and the second water-resistant ribbons 368, 468, 568, 668, 768, 868, 868, and 1468 can comprise any water-resistant composition suitable for use in an exterior wall assembly and that can tend to inhibit or prevent penetration of water into the ribbon. The first water-resistant ribbons 366, 466, 566, 666, 766, 866, 966, and 1466 and the second water-resistant ribbons 368, 468, 568, 668, 768, 868, 868, and 1468 can comprise a caulk, sealant bead, tape, or other suitable material for forming the side walls of the channels. In one aspect, the first water-resistant ribbons 366, 466, 566, 666, 766, 866, 966, and 1466 and the second water-resistant ribbons 368, 468, 568, 668, 768, 868, 868, and 1468 can comprise a polymeric water-resistant composition. In another aspect, the polymeric water-resistant composition can comprise a silane polymer. In a further aspect, the polymeric water-resistant composition can comprise a calcium carbonate. In another aspect, the first water-resistant ribbons 366, 466, 566, 666, 766, 866, 966, and 1466 and the second water-resistant ribbons 368, 468, 568, 668, 768, 868, 868, and 1468 can comprise STO RAPIDGUARD® air-barrier and waterproofing material available from Sto Corp. of Atlanta, Georgia, USA.

The exterior wall system assemblies, the exterior wall system component subassemblies, and the exterior wall system components of the present disclosure can be of various heights, widths, and configurations. The fireblocking base forms, the fireblocking vertical forms, and the fireblocking frameworks of the exterior wall system assemblies, the exterior wall system component subassemblies, and the exterior wall system components herein have been described as comprising a fire-resistant material. In addition to rock wool, mineral wool, foamed concrete, cementitious materials, and glass matt faced gypsum sheathing or glass matt gypsum admixture, these fireblocking forms can be formed of any fire-resistant material and/or fireblocking material that complies with applicable laws, rules and ordinances for building structures and otherwise suitable for use in such exterior wall system assemblies, exterior wall system component subassemblies, and exterior wall system components and can be configured in rectangular shapes with flat surfaces horizontally aligned with the bottom surface or wedge shapes with a sloped top surface. The fireblocking base forms and fireblocking frameworks set forth herein can be used in wall assemblies of various construction, including masonry cavity wall assemblies.

The exterior wall system assemblies, the exterior wall system component subassemblies, and the exterior wall system components can be configured to comply with any one or more of NFPAR® 285 Standard Fire Test Method For Evaluation Of Fire Propagation Of Exterior Wall Assemblies Containing Combustible Components; ASTM E330/E330M-14 (Reapproved 2021) Standard Test Method For Structural Performance Of Exterior Windows, Doors, Skylights And Curtain Walls By Uniform Static Air Pressure Difference; ASTM E2273-18 Standard Test Method For Determining The Drainage Efficiency Of Exterior Insulation And Finish Systems (EIFS) Clad Wall Assemblies; 2022 NYC Building Code Section 1408 Exterior Insulation And Finish Systems (EIFS); and, 2022 NYC Building Code Section 718.2.6.1 Exterior Wall Coverings Containing Plastics, Metal Composite Materials (MCM) Or High-Pressure Decorative Exterior-Grade Compact Laminates (HPL) Panels.

The embodiments set forth herein are provided to illustrate, not limit, the scope of the present disclosure. Alternative combinations and modifications of the features disclosed herein are contemplated by the present disclosure. Alternatives, variations, and modifications of the embodiments described herein will be apparent to one of ordinary skill in the art are encompassed by the present disclosure.

What is claimed is:

1. An exterior wall system component subassembly comprising:

a wedge comprising a front side, a rear side spaced apart from the front side, a bottom side extending between the front side and the rear side, a top side extending between the front side and the rear side, wherein the top side is aligned oblique to the front side, wherein the top side and the front side cooperate to form a top front edge, wherein the top side and the rear side cooperate to form a top rear edge;

a waterproof membrane aligned on the top side of the wedge;

a first water-resistant ribbon aligned on the waterproof membrane, wherein the first water-resistant ribbon comprises a first water-resistant ribbon end; and, a second water-resistant ribbon aligned on the waterproof membrane, wherein the second water-resistant ribbon comprises a second water-resistant ribbon end, wherein the second water-resistant ribbon end is spaced apart from the first water-resistant ribbon end, wherein the waterproof membrane, the first water-resistant ribbon and the second water-resistant ribbon cooperate to form a channel, and wherein the first water-resistant ribbon end and the second water-resistant ribbon end cooperate to define a channel outlet of the channel.

2. The exterior wall system component subassembly of claim 1, wherein the first water-resistant ribbon extends from the first water-resistant end to a first water-resistant ribbon apex.

3. The exterior wall system component subassembly of claim 2, wherein the second water-resistant ribbon extends from the second water-resistant end to a second water-resistant ribbon apex.

4. The exterior wall system component subassembly of claim 3, wherein the first water-resistant ribbon apex and the second water-resistant apex are aligned proximal to the top rear edge of the wedge and the channel outlet is aligned distal to the top rear edge of the wedge.

5. The exterior wall system component subassembly of claim 2, wherein the first water-resistant ribbon apex is disposed at the top rear edge of the wedge.

6. The exterior wall system component sub assembly of claim 2, wherein the first water-resistant apex is disposed intermediate between the top rear edge and the top front edge of the wedge.

7. The exterior wall system component subassembly of claim 1, wherein the channel is in fluid communication with a weep tube.

8. The exterior wall system component subassembly of claim 7, wherein the weep tube is aligned on the top side of the wedge.

9. The exterior wall system component subassembly of claim 8, wherein the first water-resistant ribbon and the second water-resistant ribbon contact the weep tube.

10. The exterior wall system component subassembly of claim 1, wherein the wedge, the first water-resistant ribbon, the second water-resistant ribbon, and the waterproof membrane are disposed in an exterior wall panel, wherein the wall panel comprises a support frame and a front face, wherein the wedge is mounted to the support frame and disposed intermediate between the support frame and the front face, wherein wall panel comprises a plurality of weep holes defined in the front face, and wherein the channel is in fluid communication with a weep hole of the plurality of weep holes.

11. The exterior wall system component subassembly of claim 1, comprising a fireblocking base form aligned below the wedge.

12. The exterior wall system component subassembly of claim 1, wherein the wedge comprises a fire-resistant material.

13. An exterior wall system component subassembly comprising:

a wedge comprising a front side and a top side aligned oblique to the front side, wherein the top side comprises a top front edge and a top rear edge;

a plurality of channels aligned on the top side of the wedge, wherein each channel of the plurality of channels comprises a waterproof membrane aligned on the top side of the wedge, a first water-resistant ribbon aligned on the waterproof membrane, and a second water-resistant ribbon on the waterproof membrane, and wherein each channel of the plurality of channels comprises a channel outlet aligned distal to the top rear edge and proximal to the top front edge.

14. The exterior wall system component subassembly of claim 13, comprising a fireblocking base form, and wherein the wedge is aligned above the fireblocking base form.

15. The exterior wall system component subassembly of claim 13, wherein the first water-resistant ribbon extends from a first water-resistant ribbon apex to a first water-resistant ribbon end, wherein the first water-resistant ribbon apex is aligned proximal to the top rear edge and distal to the top front edge, and wherein the first water-resistant ribbon end is aligned proximal to the top front edge and distal to the top rear edge.

16. The exterior wall system component subassembly of claim 15, wherein the first water-resistant ribbon apex is disposed at the top rear edge.

17. The exterior wall system component subassembly of claim 15, wherein the first water-resistant ribbon apex is disposed intermediate between the top rear edge and the top front edge.

18. The exterior wall system component subassembly of claim 15, wherein the first water-resistant ribbon end is disposed at the top front edge.

19. The exterior wall system component subassembly of claim 15, wherein the first water-resistant ribbon end is disposed intermediate between the top rear edge and the top front edge.

20. The exterior wall system component subassembly of claim 13, wherein the first water-resistant ribbon is arcuate.

21. The exterior wall system component subassembly of claim 13, comprising a plurality of weep tubes aligned on the top side of the wedge.

22. The exterior wall system component subassembly of claim 21, wherein each weep tube of the plurality of weep tubes is in fluid communication with a channel outlet of a channel of the plurality of channels.

23. The exterior wall system component subassembly of claim 13, wherein the wedge and the plurality of channels are disposed in an exterior wall panel, wherein the wall panel comprises a support frame and a front face, wherein the wedge is mounted to the support frame and disposed intermediate between the support frame and the front face, wherein wall panel comprises a plurality of weep holes defined in the front face, and each channel of the plurality of channels is in fluid communication with a weep hole of the plurality of weep holes.

24. The exterior wall system component subassembly of claim 23, wherein the exterior wall panel further comprises a plurality of weep tubes, wherein each weep tube of the plurality of weep tubes is in fluid communication with a channel of the plurality of channels, and wherein each weep tube of the plurality of weep tubes is in fluid communication with a weep hole of the plurality of weep holes.

25. An exterior wall system component subassembly comprising:

a wedge comprising a front side, a rear side spaced apart from the front side, a bottom side extending between the front side and the rear side, a top side extending between the front side and the rear side, wherein the top side is aligned oblique to the front side, wherein the top side and the front side cooperate to form a top front edge, wherein the top side and the rear side cooperate to form a top rear edge;

a waterproof membrane aligned on the top side of the wedge;

a plurality of channels aligned on the top side of the wedge, wherein each channel of the plurality of channels comprises the waterproof membrane, a first water-resistant ribbon aligned on the waterproof membrane, and a second water-resistant ribbon on the waterproof membrane, wherein the first water-resistant ribbon extends from a first water-resistant ribbon end to a first water-resistant ribbon apex, wherein the second water-resistant ribbon extends from a second water-resistant ribbon end to a second water-resistant ribbon apex, wherein the first water-resistant end is spaced apart from the second water resistant end, wherein the first water-resistant end and the second water-resistant end cooperate to form a channel outlet, and wherein the channel outlet is aligned distal to the top rear edge and proximal to the top front edge of the wedge.

* * * * *